US011117008B2

(12) United States Patent
Ananth et al.

(10) Patent No.: US 11,117,008 B2
(45) Date of Patent: Sep. 14, 2021

(54) SILOXANE AND GLUCOSIDE SURFACTANT FORMULATION FOR FIRE-FIGHTING FOAM APPLICATIONS

(71) Applicant: The Government of the United States of America, as represented by the Secretary of the Navy, Arlington, VA (US)

(72) Inventors: Ramagopal Ananth, Bryn Mawr, PA (US); Arthur W. Snow, Alexandria, VA (US); Katherine Hinnant, Washington, DC (US); Spencer L. Giles, Lorton, VA (US)

(73) Assignee: The Government of the United States of America, as represented by the Secretary of the Navy, Washington, DC (US)

( * ) Notice: Subject to any disclaimer, the term of this patent is extended or adjusted under 35 U.S.C. 154(b) by 223 days.

(21) Appl. No.: 16/356,254

(22) Filed: Mar. 18, 2019

(65) Prior Publication Data

US 2019/0321670 A1 Oct. 24, 2019

Related U.S. Application Data

(60) Provisional application No. 62/661,824, filed on Apr. 24, 2018.

(51) Int. Cl.
*A62D 1/02* (2006.01)
*A62C 5/02* (2006.01)

(52) U.S. Cl.
CPC ..... *A62D 1/0071* (2013.01); *A62C 5/02* (2013.01)

(58) Field of Classification Search
None
See application file for complete search history.

(56) References Cited

U.S. PATENT DOCUMENTS 2,404,313 A * 7/1946 Rodman ..... C09D 127/06 428/342
6,680,290 B1 * 1/2004 Lenoir ..... C11D 1/721 510/506
9,446,272 B2 9/2016 Blunk et al.
9,687,686 B2 6/2017 Blunk et al.
(Continued)

OTHER PUBLICATIONS

Anath et al., "Liquid-Pool Fire Extinction Characteristics of Aqueous Foams Generated from Fluorine-free Surfactants" 36FI-0107, Spring Technical Meeting, Eastern States Section of the Combustion Institute, Mar. 4-7, 2018.
(Continued)

*Primary Examiner* — Joseph D Anthony
(74) *Attorney, Agent, or Firm* — US Naval Research Laboratory; Joseph T. Grunkemeyer

(57) ABSTRACT

Disclosed is a firefighting composition of the surfactants below and water. The values of m, n, x, and y are independently selected positive integers. R is an organic group. R' is a siloxane group.

21 Claims, 33 Drawing Sheets

(56) References Cited

U.S. PATENT DOCUMENTS

2004/0077516 A1* 4/2004 Man ..... C11D 1/825
510/466
2004/0097382 A1* 5/2004 Li ..... C10M 105/14
508/206
2004/0121680 A1* 6/2004 Yahiaoui ..... D06M 13/165
442/118
2005/0245158 A1* 11/2005 Yahiaoui ..... C08L 23/16
442/118
2009/0117174 A1* 5/2009 Cunningham ..... A61K 8/894
424/443
2009/0259062 A1* 10/2009 Wang ..... B01F 17/0071
556/431

OTHER PUBLICATIONS

Conroy et al., "Surface Cooling of a Pool Fire by Aqueous Foams" Combustion Science and Technology 2017, vol. 189, No. 5, 806-840.

Hinnant et al., "Evaluating Foam Degradation and Fuel Transport Rates through Novel Surfactant Firefighting Foams for the Purpose of AFFF Perfluorocarbon Replacement" Spring Technical Meeting, Eastern States Section of the Combustion Institute, Mar. 4-7, 2018.

Hinnant et al., "Influence of fuel on foam degradation for fluorinated and fluorine-free foams" Colloids and Surfaces A: Physicochem. Eng. Aspects 522 (2017) 1-17.

Hinnant et al., "Simultaneous measurement of fuel transport and foam degradation for firefighting foams to improve understanding of fire suppressing mechanisms" 11th U. S. National Combustion Meeting Organized by the Western States Section of the Combustion Institute Mar. 24-27, 2019.

Hinnant et al., "Measuring fuel transport through fluorocarbon and fluorine-free firefighting foams" Fire Safety Journal 91 (2017) 653-661.

Hinnant et al., "An Analytically Defined Fire-Suppressing Foam Formulation for Evaluation of Fluorosurfactant Replacement" J. Surfact. Deterg. (2018).

* cited by examiner

SILOXANE AND GLUCOSIDE SURFACTANT FORMULATION FOR FIRE-FIGHTING FOAM APPLICATIONS

This application claims the benefit of U.S. Provisional Application No. 62/611,824, filed on Apr. 24, 2019. The provisional application and all other publications and patent documents referred to throughout this nonprovisional application are incorporated herein by reference.

TECHNICAL FIELD

The present disclosure is generally related to fire suppressant materials.

DESCRIPTION OF RELATED ART

Prior to the 1960s, foams based on proteinaceous waste products were used to extinguish hydrocarbon fuel fires (Ratzer, "History and Development of Foam as a Fire Extinguishing Medium", *Ind. Eng. Chem.* 48, 2013 (1956)). In the 1960s fluorocarbon surfactants were introduced to fire-fighting foam formulations and largely displaced the slow acting protein foams (Tuve et al., "Compositions and Methods for Fire Extinguishment and Prevention of Flammable Vapor Release", U.S. Pat. No. 3,258,423 (1966); Tuve et al., "A New Vapor-Securing Agent for Flammable-Liquid Fire Extinguishment", Naval Research Laboratory Report 6057, DTIC Document No. ADA07449038, Washington D.C. (1964)). It was proposed that the fluorocarbon surfactants form an aqueous film under the foam layer that seals off fuel vapors emerging from the pool surface. The aqueous film was attributed to spread on the pool surface because fluorocarbon surfactants reduce the surface tension to an extremely low value (<17 dynes/cm). The foam layer's role was thought to protect the aqueous film from heat and was a water delivery mechanism to the aqueous film. The aqueous film was considered to be responsible for the high fire suppression performance of aqueous film forming foam (AFFF). AFFF formulations over time have evolved into complex recipes with many ingredients to serve multiple purposes. Many AFFF commercial formulations are understandably complex and proprietary. Hydrocarbon surfactants were added to the fluorocarbon surfactants to reach dynamic surface tension more quickly for spreading of the aqueous film. Other components in addition to water include: organic solvents (viscosity control, storage stabilization at subzero or elevated temperatures); polymers (precipitated barrier formation on polar/alcohol fuels); salts (surfactant shielding); chelating agents (polyvalent ions sequestering); buffers; corrosion inhibitors; and biocides (Martin, "Fire-Fighting Foam Technology," in *Foam Engineering: Fundamentals and Applications*; P. Stevenson, Ed.; Ch. 17, Wiley-Blackwell, West Sussex, UK (2012)). U.S. Pat. No. 5,207,932 discloses some particularly informative recipe examples. Since their introduction, they have been used by the civilian and military worldwide including most airports internationally and are considered the equivalent of a gold standard in pool firefighting because of their high fire suppression performance, which is defined more generally as the ability to extinguish completely a given fire quickly using minimal amount of solution. The fire performance is defined more specifically by U.S. MilSpec Mil-F-24385F, which is used to certify the performance of AFFFs for use in DOD firefighting applications and probably the most stringent compared to other standards of performance (e.g., International Civil Aviation Organization-ICAO, Underwriters Laboratories Inc.-UL) used in civilian applications. One of the test performed under U.S. MilSpec is a fire extinction test that specifies that a 6-ft diameter gasoline pool fire be extinguished in less than 30 s using less than 1 U.S. gallon of solution.

While fluorocarbon-containing AFFF formulations have been highly effective, the fluorocarbon surfactants contained in AFFF are found to pose serious environmental and health hazards (Moody et al., "Perfluorinated Surfactants and Environmental Implications of their Use in Firefighting Foams", *Environ. Sci. Tech.,* 34, 3864 (2000)). Elimination or replacement of the fluorocarbon surfactant component in the AFFF formulation is an important and imperative research objective; legal authority such as U.S. EPA and equivalent European government agencies have been restricting the use of fluorocarbons in firefighting foams either on a voluntary basis or by law, and may in the future require a total discontinuation (Zhang et al., "Review of Physical and Chemical Properties of Perfluoro Octanyl Sulphonate (PFOS) with Respect to its Potential Contamination on the Environment", *Adv. Mater. Res.,* 518, 2183 (2012)). In addition to the environmental and health hazards, there has always been an economic driver in place for many years as the cost of the fluorocarbon surfactants "represents 40-80% of the cost of the concentrate" (U.S. Pat. No. 5,207,932).

Fluorine-free surfactant formulations may significantly reduce the environmental and health impacts, as they do not contain one of the most stable bonds, between carbon and fluorine, in organic chemistry. However, the problem is that it is extremely difficult to achieve aqueous film formation without the fluorine due to the inability to achieve extremely low surface tension (<17 dynes/cm). After decades of research, the firefighting community has not been able to find fluorine-free surfactants that reduce the surface tension to extremely low values. In 2016, a fluorine-free fire suppressing formulation containing a surfactant composed of a glucoside head group bonded to a siloxane tail group was custom synthesized (U.S. Pat. Nos. 9,446,272 and 9,687,686). A formulation containing the custom synthesized trisiloxane with a glucoside head group, a hydrocarbon surfactant (Glucopon 215 UP, BASF Inc.), and a solvent (diglycol butyl ether, DGBE) was able to lower the surface tension to 20 dynes/cm to achieve the aqueous film formation marginally on a limited number of fuels (kerosene and jet fuel) having relatively high surface tension. The siloxane formulation was unable to form an aqueous film on n-heptane or gasoline fuel, which is employed in U.S. MilSpec tests (Mil-F-24385F). Furthermore, the siloxane surfactant was prepared by a multistep synthesis with relatively low yield, which is of questionable practicality for large scale synthesis. Blunk et al. also considered four, non-glucoside, trisiloxane surfactants as counter-examples for comparison that did not form the aqueous film. They were tri-siloxanes with oxyethylene head group (4, 6, and 12 unit lengths) terminated with hydroxyl similar to the commercial trisiloxane surfactant component described herein. However, Blunk et al. rejected the trisiloxanes with oxyethylene head group for fire suppression on the basis that the siloxanes did not form the aqueous film. In summary, no fluorine-free replacement surfactants have been found with film formation ability comparable to that of AFFF on low surface tension fuels (gasoline and heptane).

To compensate for the loss of the aqueous film, the foam industry (e.g., RF6, Solberg, Inc. product and Angus 3%, National Foam, Inc. product) developed fluorine-free foams that reduce drainage and hold more water in the foam layer. The increased liquid content in the foams was achieved by using hydrocarbon surfactants and viscosity modifying additives to control liquid loss by drainage from the foams. However, these approaches to replacing the fluorocarbon surfactants sacrifice AFFF's high fire suppression performance because of the use of less fuel resistant hydrocarbon surfactants and excess solution for comparable fire extinction time. Because only a limited amount of the solution can be carried to the fire site, the commercial fluorine-free foams will not be able to put out large fires as quickly as AFFF on a per unit mass of liquid basis. As a result, the fluorine-free formulations are not expected or claimed to have passed the more stringent U.S. MilSpec (Mil-F-24385F) by the manufacturers. However, some of the commercial fluorine-free foams have been qualified by European standards (ICAO) for civilian firefighting applications.

In summary, all surfactant AFFF formulations to date that meet the Military Specification (MilSpec) requirements for fire extinguishing (Mil-F-24385F) contain fluorocarbon surfactants. Fluorine-free firefighting foam formulations do exist but to date have not met the MilSpec requirements.

BRIEF SUMMARY

Disclosed herein is a composition comprising a first surfactant having the formula (1), a second surfactant having the formula (2), and water. The values of m, n, x, and y are independently selected positive integers. R is an organic group. R' is a siloxane group.

(1)

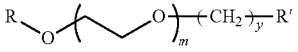

(2)

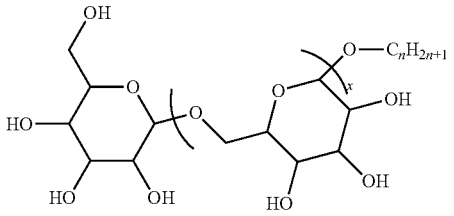

Also disclosed herein is a method comprising: forming a composition of the first surfactant, the second surfactant, and water.

BRIEF DESCRIPTION OF THE DRAWINGS

A more complete appreciation will be readily obtained by reference to the following Description of the Example Embodiments and the accompanying drawings.

DETAILED DESCRIPTION OF EXAMPLE EMBODIMENTS

Figure 1:
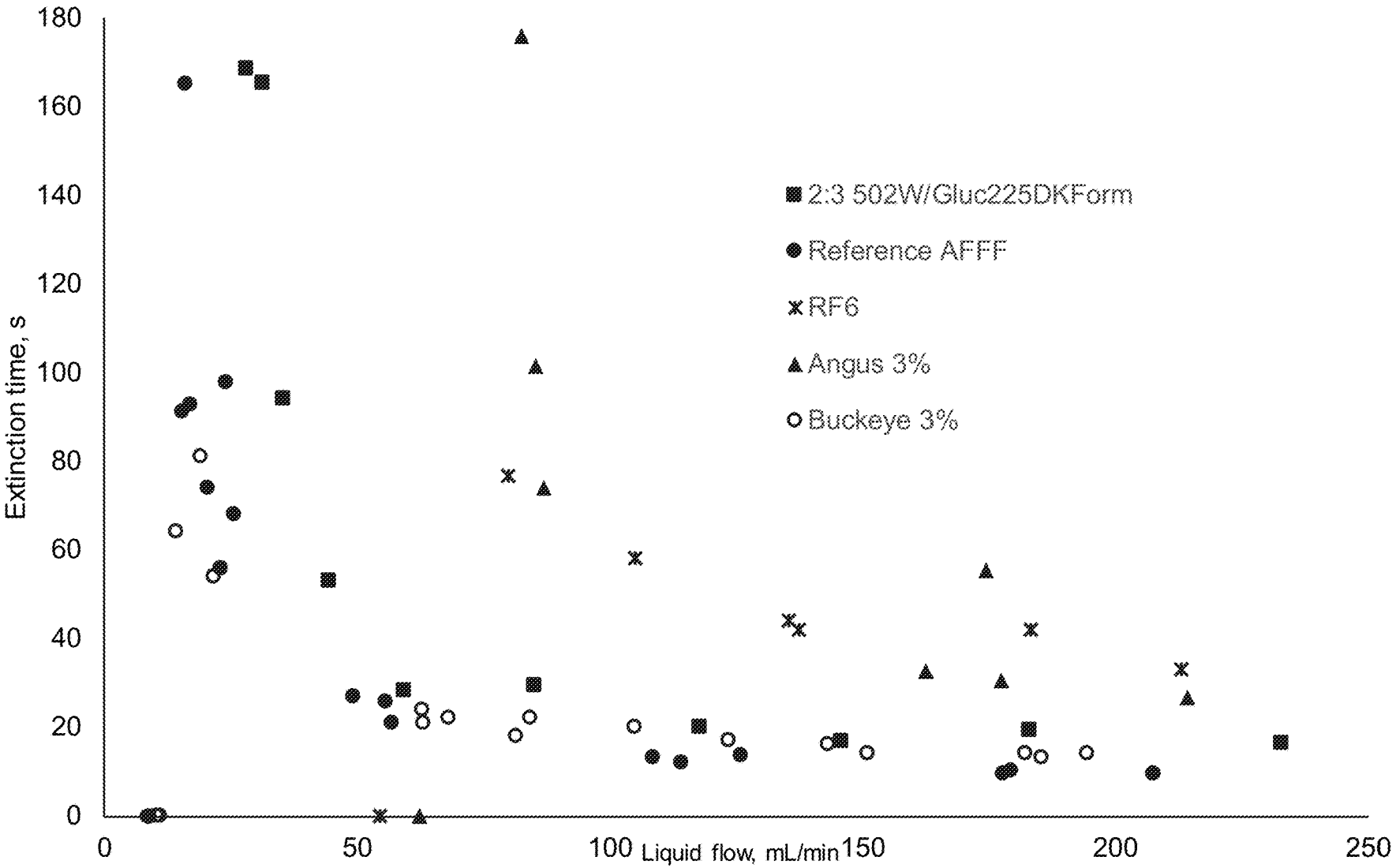
FIG. 1 shows fire performance extinction time versus liquid surfactant formulation flow rate to foam generating apparatus onto a 19-cm diameter heptane pool fire, with a 60 sec preburn and 1 cm lip. U.S. MilSpec qualified fluorocarbon surfactant containing commercial (Buckeye Fire Equipment Co. 3% MIL SPEC AFFF (BFC-3MS)) AFFF (open circles), RefAFFF (solid circles), siloxane (fluorine-free) surfactant formulation with composition shown in Table 1 (square), and the two leading commercial fluorine-free formulations, RF6 (X) and Angus 3% (triangle). (Data points on x-axis represent no extinction). Commercial fluorine-free concentrate viscosities are 20 to 1500 times the MIL-F-24385F specification and the present invention is within the MilSpec (see Table 3).

In the following description, for purposes of explanation and not limitation, specific details are set forth in order to provide a thorough understanding of the present disclosure. However, it will be apparent to one skilled in the art that the present subject matter may be practiced in other embodiments that depart from these specific details. In other instances, detailed descriptions of well-known methods and devices are omitted so as to not obscure the present disclosure with unnecessary detail.

Described is a preparation of fluorine-free surfactant formulations to generate foams that have high fuel vapor resistance property per unit volume of solution comparable to that of the firefighting foam used currently, world-wide, Aqueous Film Forming Foam (AFFF), which contains fluorocarbon surfactants with significant environmental impact. It is demonstrated that the fuel vapor resistance property leads to extinguishment of hydrocarbon pool fires by blocking fuel supply to the fire with an efficiency approaching that of AFFF even though the formulation may not have extremely low surface tension, and may not form the aqueous film. As an example, a surfactant formulation composed of trisiloxane poly(oxyethylene) and alkyl polyglucoside surfactants and other components is shown to spread quickly, suppress the fuel vapors, and extinguish a pool fire using smaller amount of solution compared to the leading commercial fluorine-free foams, and closer to the values measured for AFFF. Described are surfactant structural features, formulation compositions' effect on the foam's resistance to the fuel vapors emerging from the pool surface that correlate with fire suppression effectiveness, and dynamic surface tension that can affect foamability. The structural features include a range of head and tail dimensions. Compositions include the range of relative amounts of siloxane to hydrocarbon surfactants to achieve synergistic extinction and increased foam spreading on the pool surface. Fuel vapor resistance is quantified by the ranges of fuel/heat induced foam degradation and fuel vapor permeation rate relative to AFFF. Dynamic surface tension shows time scale for lowering the surface tension of a freshly formed bubble and foamability is indicated by the expansion ratio (or liquid content).

It has been demonstrated that the fuel vapor resistance property of surfactants is crucial for fire suppression efficiency rather than a liquid layer either in the form of aqueous film formation or high liquid content of foams ("Measuring Fuel Transport through Fluorocarbon and Fluorine-free Firefighting Foams", *Fire Safety Journal,* 91, 653-661 (2017) and "Influence of Fuel on Foam Degradation for Fluorinated and Fluorine-free Foams", *Colloids and Surfaces A,* 522, 1-17 (2017)). The disclosed formulation does not form the aqueous film on n-heptane fuel but forms a foam layer, which is effective in suppressing fuel vapors emerging from the pool from reaching into the fire. The amount of surfactant solution contained in the foam used for suppressing a fixed size fire in fixed time is less than the leading commercial fluorine-free foams available to date and is 50% more than that used by AFFF. As a result the formulation has fire suppression effectiveness well above the existing fluorine-free formulations and is more than 50% fire suppression effectiveness of AFFF's based on benchtop measurements. The superior fire suppression effectiveness is due to increased oleophobicity of the trisiloxane tail that blocks the fuel vapor permeation through foam covering the pool surface while maintaining amphiphilicity with increased oxyethylene head group size to reduce fuel/heat induced foam degradation. Also significant is the synergistic interaction with hydrocarbon co-surfactant, where the fuel/heat induced foam degradation and fire extinction times are smaller for the combination of the surfactants compared to those for the two surfactants individually. The synergism reduces foam degradtion by heptane and blocks the fuel permeation and contributes to faster extinction without using excess solution. The polar head group of the hydrocarbon surfactant can also significantly enhance the synergism.

The disclosed composition is a formulation that includes two classes of surfactants: poly(oxyethylene)-trisiloxane surfactants and poly(glucoside)-alkane surfactants. General chemical formulas for these two surfactants are shown in formulas (1) and (2). The general structures of these two surfactant classes may be available as commercialized surfactants and analytical or custom synthesized surfactants. The parameters m, n, and x are all positive integers, and y is a non-negative integer. For example, m may be between 2 to 50, y may be between 0 and 5, n may be between 1 and 20, and x may be between 0 and 4. The $C_nH_{2n+1}$ group may be linear or branched. R can be any functional group including —OH and —$CH_3$—. R' can be any siloxane group such as —$Si(CH_3)[OSi(CH_3)_3]_2$ or —$S[O—Si(CH_3)_2]_q$—$O—Si(CH_3)_3$, where q is a positive integer such as 2. It is demonstrated that when a member of each class is combined in a foam generating formulation, the foam produced displays an effective fire suppression capability, depending on the values of the parameters. It may or may not also include a solvent whose general class of structure is depicted in Eq. (3) with parameters p and z being positive integers. For example, p may be between 4 and 12, and z may be between 1 and 40. Formulations were prepared by mixing the three components in proportions shown in Table 1.

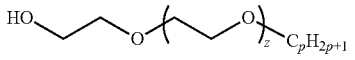

(3)

TABLE 1

Fluorine-free formulation containing a siloxane surfactant (e.g., 502W, Dow Corning Inc.), a hydrocarbon surfactant (e.g., Glucopon225DK, BASF Inc.), a solvent (diethyleneglycol butylether, DGBE, Dow Chemical Co.) in distilled water. Also shown is a reference AFFF formulation (RefAFFF) containing a fluorocarbon surfactant (Capstone 1157, Chemours Inc.).

| Siloxane Formulation | RefAFFF Formulation[1] |
|---|---|
| 0.2% siloxane surfactant (502W) | 0.2% Capstone 1157 |
| 0.3% hydrocarbon surfactant (Glucopon225DK) | 0.3% Glucopon215 CS UP |
| 0.5% solvent (DGBE) | 0.5% DGBE |
| 99% distilled water | 99% distilled water |

[1]It has been shown that RefAFFF passed the 28 $ft^2$ U.S Mil-F-24385F fire test with an extinction time of 26 s, burnback time of 562 s, 25% liquid drainage time of 317 s, foam expansion ratio of 7.5 (Hinnant et al., "An Analytically Defined Fire-Suppressing Foam Formulation for Evaluation of Fluorosurfactant Replacement" J. Surfactants and Detergents, 21(5), 711-722 (2018))

The components of the RefAFFF formulation are: Glucopon® 215 CS UP (an alkyl polyglucoside concentrate contributed by BASF Corporation, Ludwigshafen, Germany and referred to as "Gluc215" (Hinnant et al., *Surfactant and Detergents,* 21, 711-722, (2018)) (For 215UP, x is 0.5 and n is 8 to 10. For 225DK, x is 0.7 and n is 8 to 10. For 600UP, x is 0.4 and n is 12 to 14); Capstone™ 1157 (fluorotelomer sulfonamide alkylbetaine concentrate contributed by Chemours Inc., Wilmington, Del. and referred to as "Cap") (Hinnant et al. (2018)); Butyl Carbitol™ (Dow Chemical Co., Midland, Mich. purchased as diethyleneglycol butylether, "DGBE", from Sigma Aldrich, St. Louis, Mo.) (Hinnant et al.). The RefAFFF composition and properties have been previously characterized in Hinnant et al. (2018).

The Siloxane-Gluc215 formulation was prepared by replacing Cap in RefAFFF with Dow Corning® 502W Additive, which is a silicone polyether copolymer, a 100% by weight concentrate contributed by Dow Corning Co., Midland, Mich. density 0.97 $g/cm^3$.[37]. The Siloxane-Gluc225 and Siloxane-Gluc600 formulations were prepared by replacing the BASF Glucopon® 215 CS UP with Glucopon® 225DK (an alkyl polyglucoside, a 68-72% by weight concentrate in water, contributed by BASF Corporation and referred to as "Gluc225" in this paper, density 1.13 $g/cm^3$) and with Glucopon® 600 CS UP (50 to 53% by weight concentrate) in the Siloxane-Gluc215 formulation respectively. The resulting solutions were used for generating foams for fire suppression as well as for foam and solution properties' measurements.

U.S. MilSpec compliant commercial AFFF formulations are typically sold as 3% or 6% concentrates, such that the final formulation used for generating the foam should contain 3% or 6% of the concentrates in water respectively. Buckeye Fire Equipment Company, Kings Mountain, N.C. (BFC-3MS, Lot #120050, 2003) and Dafo Fomtec AB, Tyreso, Sweden (FOMTEC AFFF 3% M USA, Batch # US-16-07-07, Aug. 4, 2016) provided 3% concentrates. They were used as received for the analytical characterization described by Hinnant et al. The Buckeye and Fomtec concentrates were diluted with water at 3% by volume for generating the foams for fire suppression.

Dynamic surface tension was measured using a bubble pressure tensiometer (Model BP2, KRUSS, Hamburg, Germany) as a function of bubble's age (1/frequency, 10 ms to 10000 ms). The tensiometer generates bubbles at a capillary tube lip (0.22 mm diameter) continuously at a specified frequency by pushing nitrogen through the capillary immersed in a surfactant solution. Surfactant diffuses from the solution to the bubble surface, where it gets absorbed and suppresses the surface tension. Pressure inside the bubble increases and reaches a maximum when the bubble diameter is equal to the capillary tube diameter before the bubble detaches from the capillary. Surface tension is calculated from the measured maximum pressure using Young's equation. Critical micelle concentrations (CMC) and static surface tensions for the Siloxane-Gluc600, Siloxane-Gluc215 and Siloxane-Gluc225 were measured using a ring (radius 9.58 mm, wire radius 0.185 mm) tensiometer at 20° C. (Du Nouy Model Sigma 701, Biolin Scientific Inc., Gothenburg, Sweden). Surface tension was measured at different concentrations of the total surfactant. CMC values were determined from the log plot of surface tension against volume % of the sum of 502W and Glucopon surfactant concentrates supplied by the manufacturers. Interfacial tensions were measured with the ring tensiometer between n-heptane and the siloxane formulations at 20° C. The viscosity was measured at 20° C. using a Cannon™-Fenske viscometer (Fisher Model 50 13616B, capillary size #50).

Foams can be generated using a device that mixes air and water at different ratios known as the expansion ratio (e.g., volume of foam/volume of liquid). As an example, foams are generated by sparging air continuously at a constant rate through a porous disc while feeding solution continuously to maintain a constant liquid column height (3-cm) above the porous disc (25-50 μm pores, 1.9-cm diameter) by using a leveling system. Foam collects to form 5.5-cm thick layer above the solution surface while flowing out from a 2.5-cm diameter outlet tube connected to the cap of a 0.7-liter plastic bottle (7.6-cm diameter, 15.9-cm height). Foam flow rate is maintained constant during fire extinction and are measured by recording time taken to collect 500 mL volume before and after fire extinction. Foam expansion ratio (volume of foam/weight of foam) is also measured before and after each fire extinction experiment in order to calculate liquid flow rate (foam flow rate/expansion ratio). To apply the foam continuously on to burning fuel pool, the outlet tube from the foam generating plastic bottle is placed about 1-inch above the pool surface. The foam is applied directly to the center of a burning heptane pool (circular shape) and allowed to spread to the edges until fire extinction or a maximum time of 3 minutes. Extinction experiments are conducted at different values of liquid (or foam) flow rates. The heptane pool is allowed to burn for 60 s (preburn time) prior to the foam application. The pool consisted of 1-cm thick fuel layer above a 5-cm thick water layer. The fuel level is maintained at 1-cm below the rim of the 19-cm diameter crystallizing dish to accommodate the foam and prevent overflow of the fuel by using a leveling system. The apparatus used for generating the foams and conducting fire extinction were developed previously (Hinnant et al., "An Analytically Defined Fire-Suppressing Foam Formulation for Evaluation of Fluorosurfactant Replacement" *J. Surfactants and Detergents,* 21(5), 711-722 (2018)).

The foams were characterized by measurements of initial bubble size, initial expansion ratio, and liquid drainage rate versus time at bench scale and large scale. Expansion ratio is the volume of foam per unit volume of liquid contained in the foam. Expansion ratio was measured by generating a fixed volume of foam into a graduated cylinder and measuring the foam's mass, which was converted to liquid volume using the density of water. Foams were generated with air externally using the extinction apparatus at a constant foam flow rate between 950 to 1000 mL/min and fed directly to fill the glass container of a Dynamic Foam Analyzer (DFA100, KRUSS GmbH, Matthews, N.C.) for the bench-scale measurements. The DFA container (40 mm diameter, 25 cm height cylinder) has part of its walls (inner and outer) shaped flat. The flat surface is in contact with the bubbles of the foam. A prism attached to the flat surface reflects light forming a mirror image of the foam-surface bubbles at a video camera's focal plane. The camera is placed 13 cm from the top of the foam column. Starting within one minute of the foam generation, the video images are continuously analyzed by the computer software (ADVANCE) to provide plots of bubble size distributions, average bubble size, and the position of foam-solution (drained solution) interface with time. In addition to the bubble size distributions, the plots provide bubble coarsening and liquid drainage rates from the 25 cm height foam column.

As prescribed in MilSpec MIL-F24385F, the foam is sprayed on to an aluminum plate and the foam is collected into a container for characterization. The foam fills a rectangular glass container (4.2 cm×4.2 cm×30.5 cm) affixed with a millimeter ruler positioned in front of a digital camera (Nikon DSLR) placed at 13-cm height of the 30.5-cm foam column. Images of the foam in the column with the ruler were taken within two minutes of the foam being collected. The diameter of 50 to 100 bubbles for three independent images (150 to 300 total bubbles) were measured using open source software (ImageJ). The liquid drainage rate was measured by collecting a 28-cm height column of foam into a 500 mL graduated glass cylinder (5-cm diameter) and measuring the change in liquid level at the base of the container with respect to time.

Foam degradation was measured following a procedure similar to those described elsewhere (Hinnant et al., "Influence of Fuel on Foam Degradation for Fluorinated and wo Fluorine-free Foams", *Colloids and Surfaces A,* 522, 1-17 (2017)). The foam height was measured as a function of time in a 100 mL glass beaker (5.0 cm diameter) in a water bath (150 mL) controlled by using a heating tape and a thermostat set at 60° C., based on previous measurements of the foam-pool interface temperature during fire extinction (Conroy et al., "Surface Cooling of a Pool fire by Aqueous Foams", *Combustion Science and Technology,* 189, 806-840 (2017)). The preheated liquid fuel (55 mL) was then poured into the beaker using a funnel, leaving a head space of 4-cm height to accommodate the foam layer. Foam was generated using nitrogen gas at a constant foam flow rate between 950 to 1000 mL/min using a constant nitrogen flow of 900 mL/min by the sparging method and fed directly into the beaker. A spatula was used to scrape excess foam from the top of the beaker, forming an even 4 cm foam layer on top of the preheated liquid fuel. Care was taken to keep the water bath level just below the foam-fuel interface in the beaker so that the foam was not heated by the water bath directly. A video camera monitored the foam height over time. The thickness of foam was determined by measuring the height of the top surface of the foam layer and the liquid fuel surface seen in the recorded video. In the cases where a gas bubble or "gap" lifted the entire foam layer from the liquid fuel surface, the volume of the gap was excluded from the total foam height. The "gap" is a result of foam bubbles bursting and coalescing to form a single bubble that spans the width of the container when in contact with the liquid fuel (Hinnant et al.). Thus, the gap contains the nitrogen that was inside the foam bubbles and also contains the warm fuel vapor.

A flux chamber was used to measure fuel flux through a foam layer with an initial thickness of 4 cm, placed on a hot heptane pool. A two-piece transport chamber was designed to quantify the initial dynamics of fuel transport as soon as a foam layer was placed on the pool. Similar experiments were conducted at room temperature using a plastic chamber previously (Hinnant et al., "Measuring Fuel Transport through Fluorocarbon and Fluorine-free Firefighting Foams", *Fire Safety Journal,* 91, 653-661 (2017)). The chamber was modified to conduct measurements on a heated fuel. The chamber consisted of a bottom glass cylindrical piece, 5 cm in diameter, 8 cm long and a top glass cylindrical piece. The pieces were joined together by placing an O-ring in an extruded glass section of the bottom piece and matching the extruded glass section of the top piece. A large black clamp was then screwed tightly to put pressure on the O-ring and seal the container. The top piece transitioned from a cylinder, 5 cm in diameter, into a cone shape with the top containing a screw cap that affixed a porous glass frit to the inside of the top piece. The glass frit, pore size 25-50 μm, was 3 cm in diameter, and positioned 1 cm from the open end of the top piece. The screw cap on the top piece had an additional outlet with ¼" plastic tubing that extended to a Midac FTIR (Fourier Transform Infrared Spectrometer, Midac I Series, Model 14001, Serial 587, Midac Corporation, Westfield, Mass., USA). The sparger brought nitrogen into the transport chamber to sweep fuel vapors from the foam surface. The outlet then carried this swept gas to an FTIR. The bottom glass piece was filled with 70 mL of n-heptane, leaving 4 cm of headspace in the bottom piece. The piece was then lowered into a water bath, heated by an external thermostat heating tape, and the n-heptane was heated to 60° C. Foam was then generated using a sparger method with nitrogen (25-50 μm pore size, at a constant foam application rate between 950 to 1000 mL/min using a constant nitrogen flow rate of 900 mL/min) directly into the bottom piece. A spatula was used to scrape foam from the bottom piece, forming a flat level surface of the foam layer covering the entire pool surface. The O-ring was then put in place and the system was closed tight. Nitrogen flowed from the sparger into the top piece at a rate of 500 mL/min. The inlet to the FTIR was then opened and the system began to take measurements of fuel concentration as ppm versus time. A nitrogen bypass on the FTIR allowed us to analyze large n-heptane quantities over a longer period of time without saturating the instrument. The nitrogen bypass flow rate was 100 mL/min. The test was stopped when the n-heptane surface was exposed as the foam layer degrades over time and the FTIR signal reached a steady value of 6000 ppm at 59° C. (corresponds to a fuel flux $1.4\times10^{-7}$ mol/cm$^2$/s) or 2480 ppm at 18° C. Nitrogen flow rates were controlled using Sierra Instrument flow controllers (Sierra Instruments, Monterey, Calif., USA, two 840-L-2-OV1-SV1-D-V1-S1 controllers with flow ranges 0-1000 sccm for foam generation and 0-2000 sccm for nitrogen sweep, one 840-L-2-D-S1 controller with flow range 0-500 sccm for nitrogen bypass). Tests were run in triplicate. The measured concentration of fuel by FTIR was converted to molar flux by multiplying the heptane vapor concentration (volume fraction, #ppm/1000000) with molar flow rate ($4.45\times10^{-4}$ mol/sec) of total nitrogen flowing (600 mL/min) through the FTIR and dividing by the surface area of the foam layer (19.63 $cm^2$).

Figure 2:
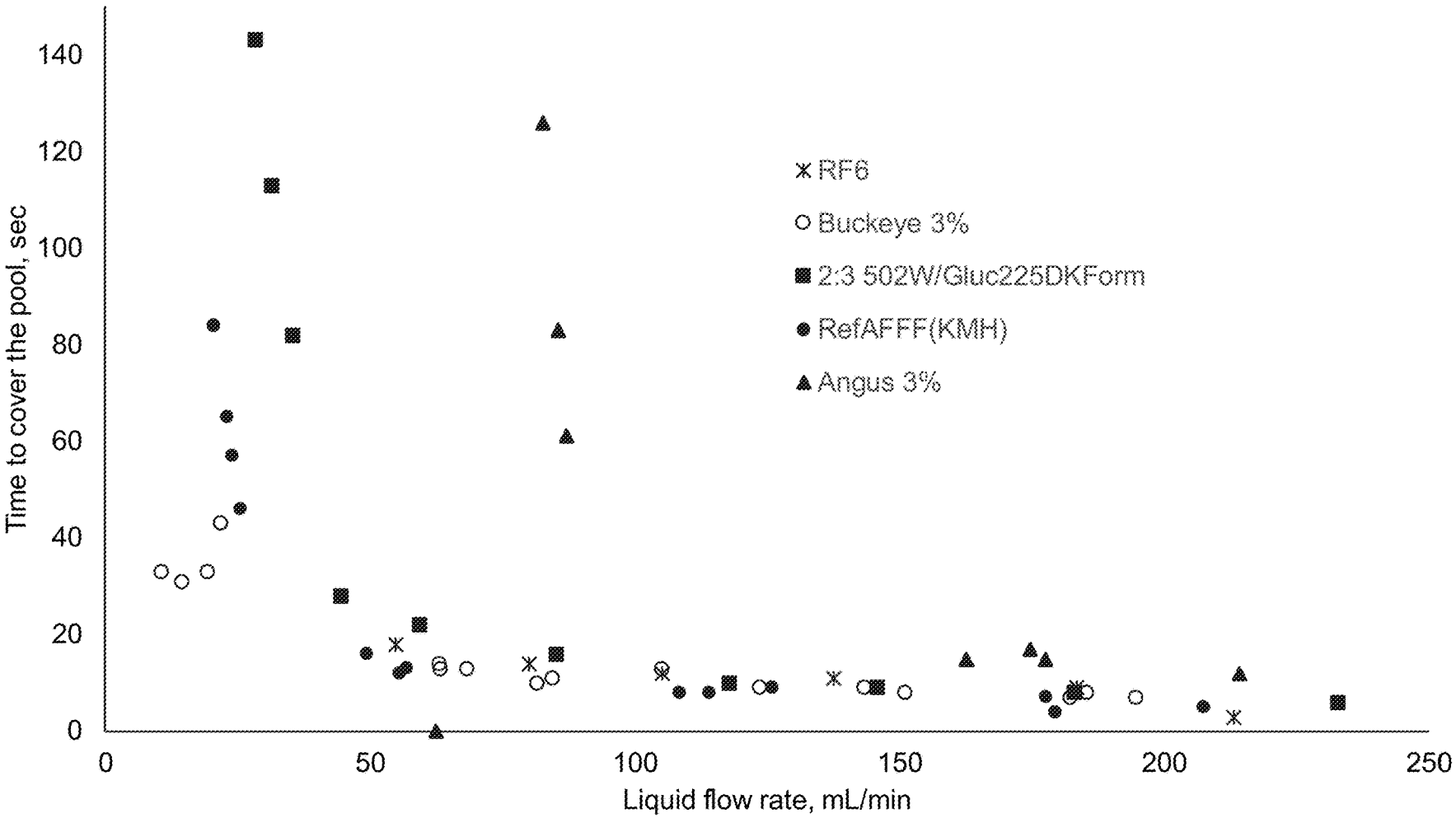
FIG. 2 shows fire performance foam spread time to cover the pool surface versus liquid surfactant formulation flow rate during fire extinction, for the same conditions as FIG. 1. Below 100 mL/min liquid flow, RF6 spreads and covers the pool quickly but takes 60 s or more to extinguish the fire unlike the siloxane formulation. A liquid flow of 100 mL/min corresponds to 3.5 kg/m$^2$/min application rate and a foam flow rate of 840 mL/min.

Fire extinction can be conducted by applying the foams from the foam generating device on to a burning liquid fuel pool at different application rates. For example, fire extinction testing has been conducted on benchtop 19-cm heptane pool fires with 60 second preburn, and 1-cm lip to accommodate a foam layer on top of the pool. Examples of such testing results are depicted in FIG. 1 where the extinction time is measured as a function of measured solution/liquid flow rate for a 2:3:5 formulation ratio of poly(oxyethylene)-trisiloxane:poly(glucoside)-alkane:diethyleneglycol-monobutylether at a concentration (0.2:0.3:0.5%) well above (>2 times) its critical micelle concentration in water. For comparison extinction results for the MilSpec compliant RefAFFF formulation and for two leading commercial fluorine-free AFFF formulations (RF6, Solberg, Inc. product and Angus 3%, National Foam, Inc. product) are also plotted. These results demonstrate the close approach in pool fire extinction. Both foam spread and fire extinction times are comparable to AFFF above 50 mL/min (1.75 $kg/m^2/min$) application rate, as shown in FIG. 2 and FIG. 1 respectively. FIG. 1 shows that the commercial fluorine-free foams contain excess solution for comparable fire extinction time. For fixed liquid flow, extinction is faster with the siloxane formulation than the commercial fluorine-free formulations. Because only a limited amount of the solution can be carried to the fire site, the commercial fluorine-free foams will not be able to put out large fires as quickly as the siloxane formulation and AFFF on per unit mass of liquid basis.

Six foot diameter pool fire tests outlined in MIL-F-24385F were performed with a heptane pool. However, the fuel was changed from gasoline to heptane in the present work. Only tests related to fire extinction performance were performed in the current study. These tests were conducted on candidate formulations prepared using fresh water at full strength. The extinction time was measured from the time of initiating deposition of the foam onto the 28 $ft^2$ heptane pool fire, which had been burning 10 sec (pre-burn) before starting the foam application, until the time of extinguishment. The burnback test involved a reignition of the extinguished pool fire after 90 sec of total foam application (includes time to extinguish fire). The foam covered pool was reignited by lowering a 30.5-cm diameter pan of burning heptane-fuel into the center of the pool and recording the time for fire re-involving 25% of the pool surface. The film-and-seal test was conducted by covering the cyclohexane fuel surface in a small container with foam, then inserting a wire screen to scoop out the residual foam, waiting 60 sec then placing a small butane lighter flame approximately ½ inch above the surface to ignite the fuel vapors permeating through the water-surfactant film on the fuel surface. If the cyclohexane fuel did not ignite, it received a pass.

Figure 3:
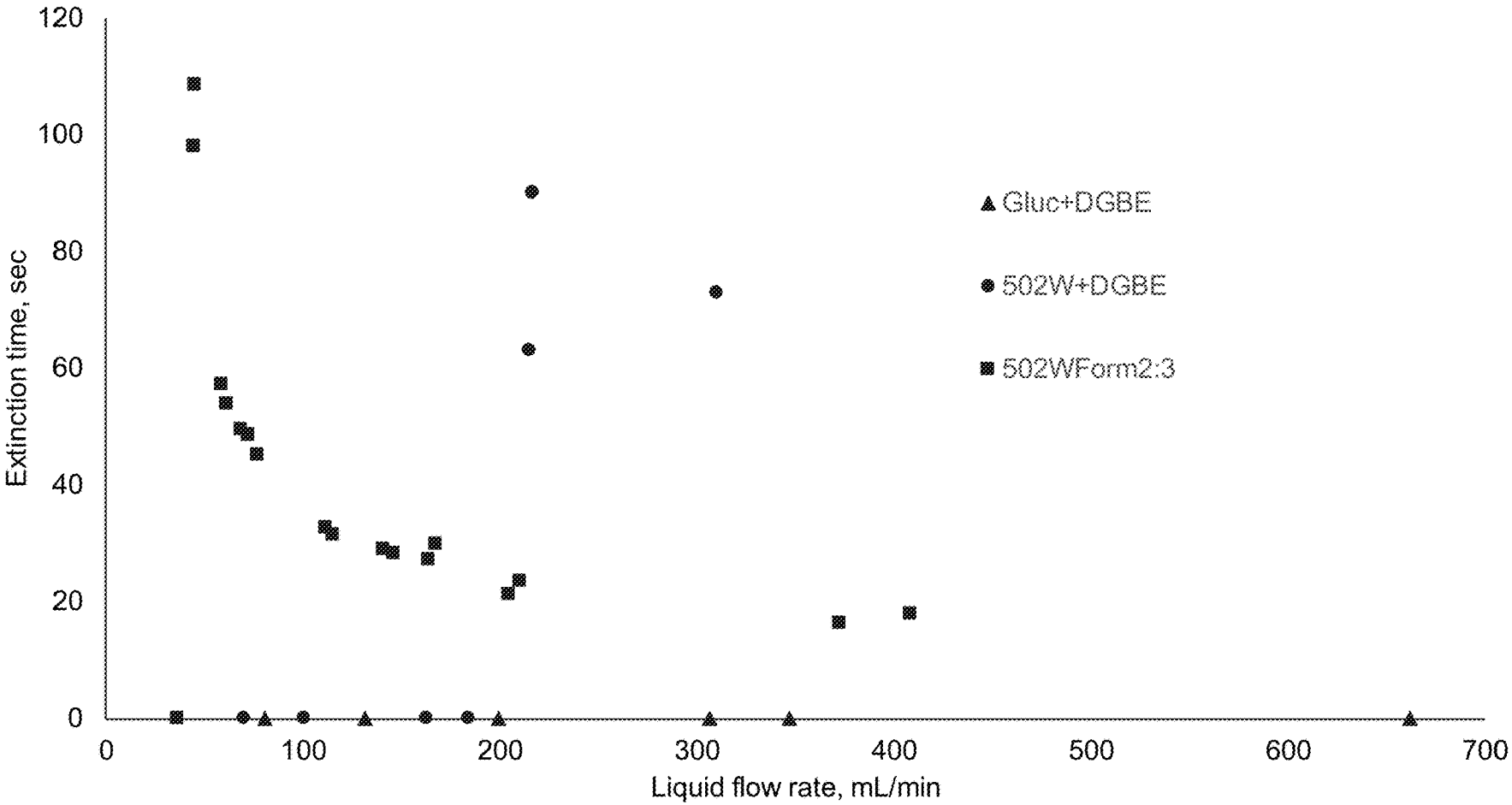
FIG. 3 shows 19-cm diameter heptane pool fire performances of extinction time vs liquid surfactant solution flow rate for the siloxane formulation of two surfactants (square), and the individual surfactants alone (circle and triangle) showing synergistic extinction. A liquid flow of 100 mL/min corresponds to 3.5 kg/m$^2$/min application rate and foam flow rate of 840 mL/min. (Data points on x-axis represent no extinction).
Figure 4:
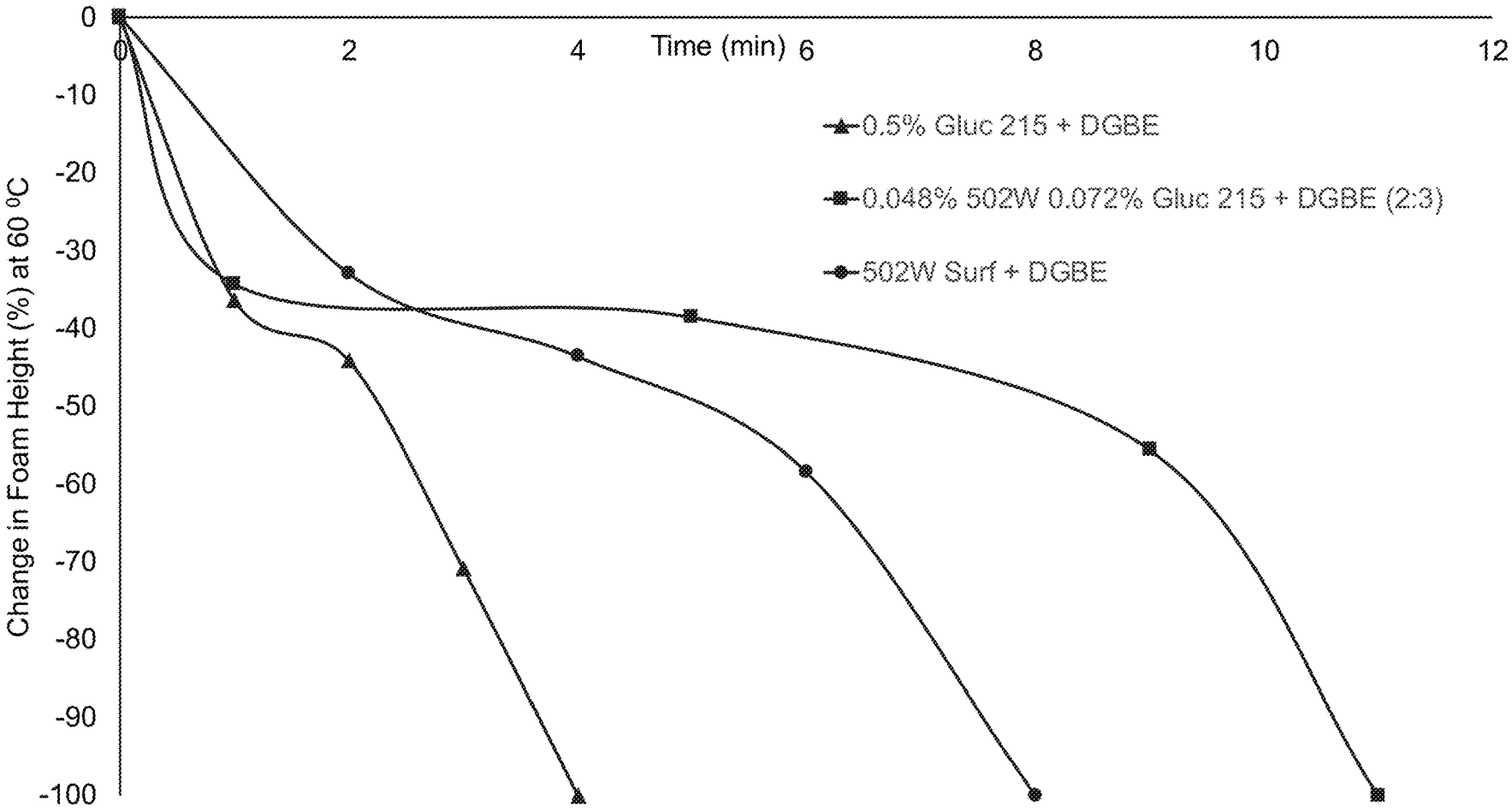
FIG. 4 shows the change in foam layer thickness due to fuel induced degradation vs time for the siloxane formulation of two surfactants (square), and the individual surfactants alone (circle and triangle) showing synergistic foam stability. Foams are applied from the foam generation device on to a hot heptane pool placed in a beaker in the absence of fire until a 4-cm thick layer builds. The bottom part of the beaker containing heptane pool was placed in a hot water bath to maintain constant temperature 60° C.

It is important to note that the superior fire extinction performance is partly due to a synergism between the poly(oxyethylene)-trisiloxane and poly(glucoside)-alkane surfactant components in that their use in combination far exceeds the extinction performance of using equivalent quantities of each surfactant alone. An example of this result is depicted by the plot in FIG. 3. Data points along the x-axis represent no extinction in FIG. 3. Such synergisms are not obvious or predictable and need to be verified by experimental demonstration. Furthermore, a similar synergism also exists in foam degradation as measured by the lifetime of a foam layer placed on a hot fuel pool. As an example, 4-cm foam layer is applied onto n-heptane pool, which is maintained at a constant temperature of 60° C. as shown in FIG. 4. The improved fuel/heat induced degradation of the combined surfactant system contributes significantly to the superior fire suppression performance of the siloxane formulation.

Figure 5:
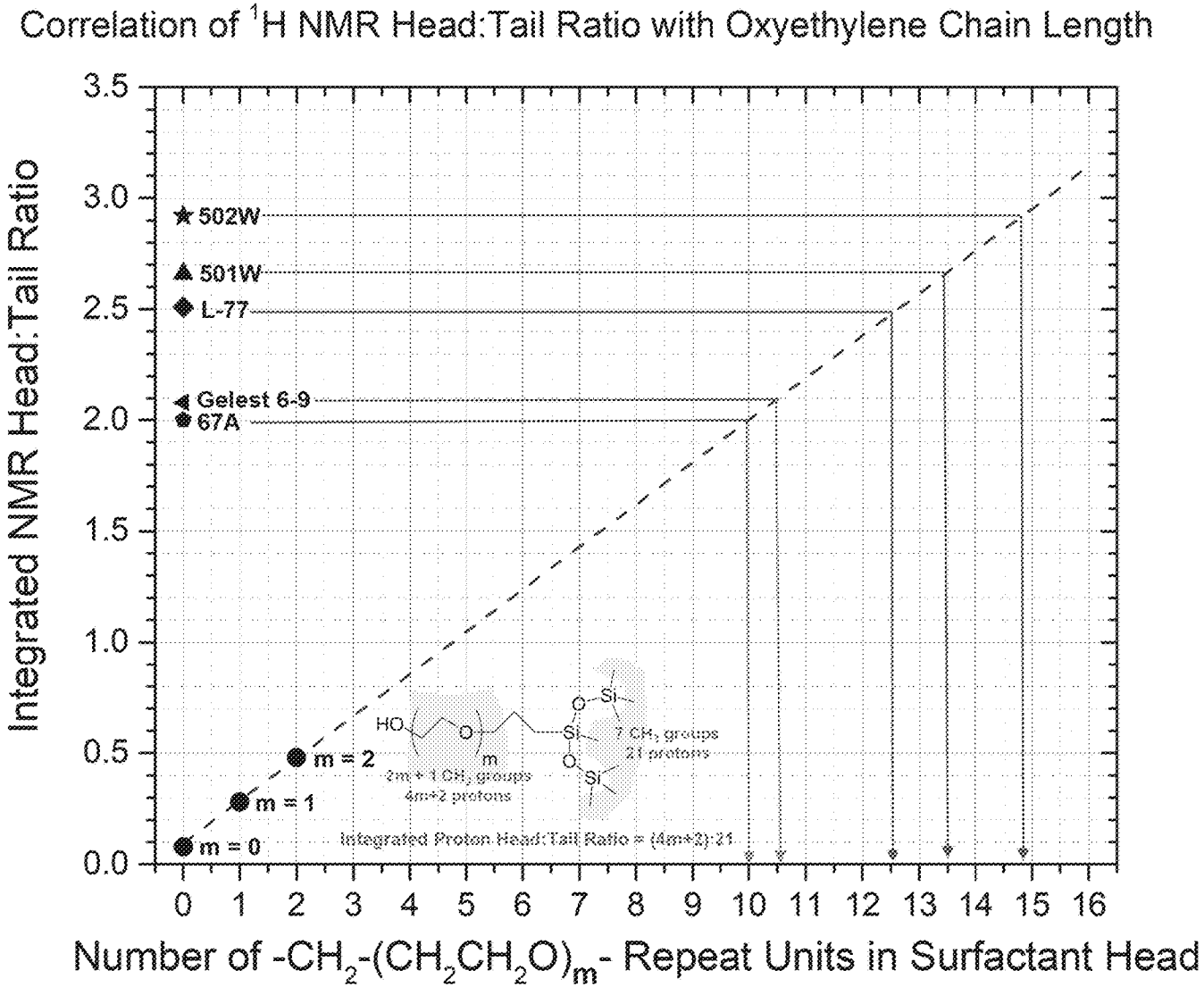
FIG. 5 shows the use of analytical $^1$H NMR data from synthesized poly(oxyethylene) trisiloxane (m=0, m=1, m=2) surfactants for estimation of structural descriptors in analog commercial surfactants (Dow Corning: 502W, 501W and 67A; Momentive: Silwet L-77; Gelest: SIH6185 m=6-9).

Another feature is that the length of the oxy-ethylene group can significantly improve fire extinction. The oxyethylene group can be on the trisiloxane surfactant, on the solvent and on the hydrocarbon surfactant. Similarly, the size of glucoside group can also improve the fire extinction. The numerical ranges of the m, n, p, x, y, and z descriptors and the identity of R in the surfactant structural formulae above, when combined in a siloxane-glucoside-DGBE-water foam generating formulation, can rapidly extinguish hydrocarbon fuel pool fires. Suppliers of commercial surfactants in these two general categories will provide the general formulae but the m, n, x, and y descriptors and R identities are often considered proprietary. These surfactants often have a dispersity of chain lengths making analyzed values of the m, n, x, and y an averaged number. Evaluation of fire suppression activity of foams generated from siloxane-glucoside formulations containing these commercial surfactants finds some to be highly effective. By using analytical monodisperse or synthesized surfactants with known m, n, x, and y parameters and known R identities, numerical thresholds and ranges were defined for these parameters and used to calibrate m, n, x, y, and R of commercial surfactants as well. An example using $^1H$ NMR spectral measurements to calibrate the structural features of m and y of the poly(oxyethylene)-trisiloxane surfactant is depicted in FIG. 5.

Figure 6:
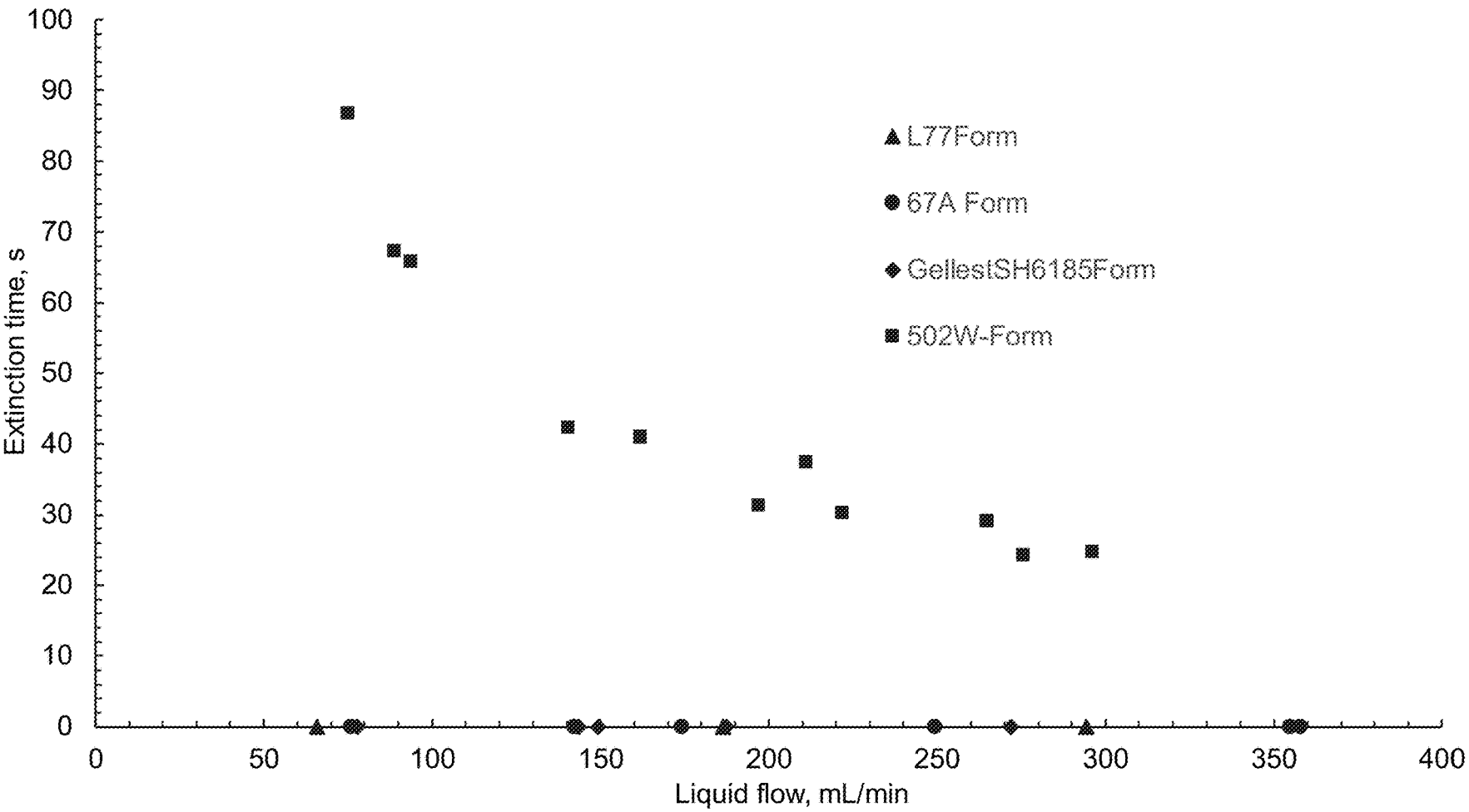
FIG. 6 shows the effect of number of oxyethylene units (displayed in FIG. 5) on comparative 19-cm diameter heptane pool fire suppression performance of commercial poly (oxyethylene) trisiloxane surfactants (502W, 501W, L-77, Gelest 6-9, and 67A), where the commercial trisiloxane surfactant is used to replace the fluorosurfactant in RefAFFF formulation shown in Table 1. A liquid flow of 100 mL/min corresponds to 3.5 kg/m$^2$/min application rate and foam flow rate of 840 mL/min. (Data points on x-axis represent no extinction).
Figure 7:
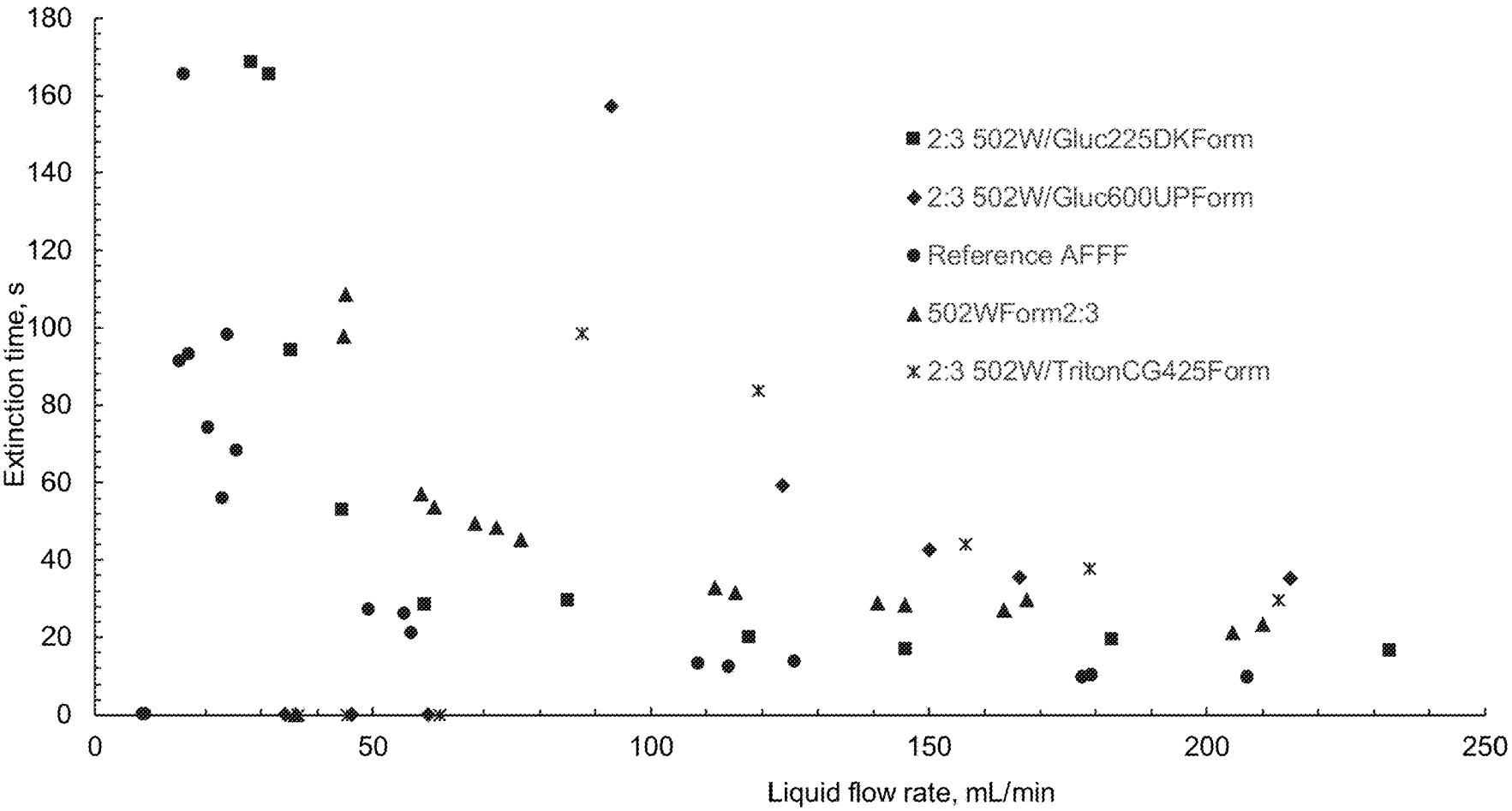
FIG. 7 shows the effect of a hydrocarbon surfactant's head and tail sizes on 19-cm diameter heptane pool fire extinction performance for the siloxane formulations with Glucopon225DK having x=0.7, n=8-10 (square), with Glucopon215UP having x=0.5, n=8-10 (triangle), with Glucopon600UP having x=0.4, n=12-14 (diamond), with TritonCG425 having x=unknown, n=8-14 (star) compared with AFFF (circle). Larger values of x and n represent larger head and tail sizes of the alkyl poly(glycoside) surfactant structure shown in FIG. 1. A liquid flow of 100 mL/min corresponds to 3.5 kg/m$^2$/min application rate and a foam flow rate of 840 mL/min. (Data points on x-axis represent no extinction).
Figure 8:
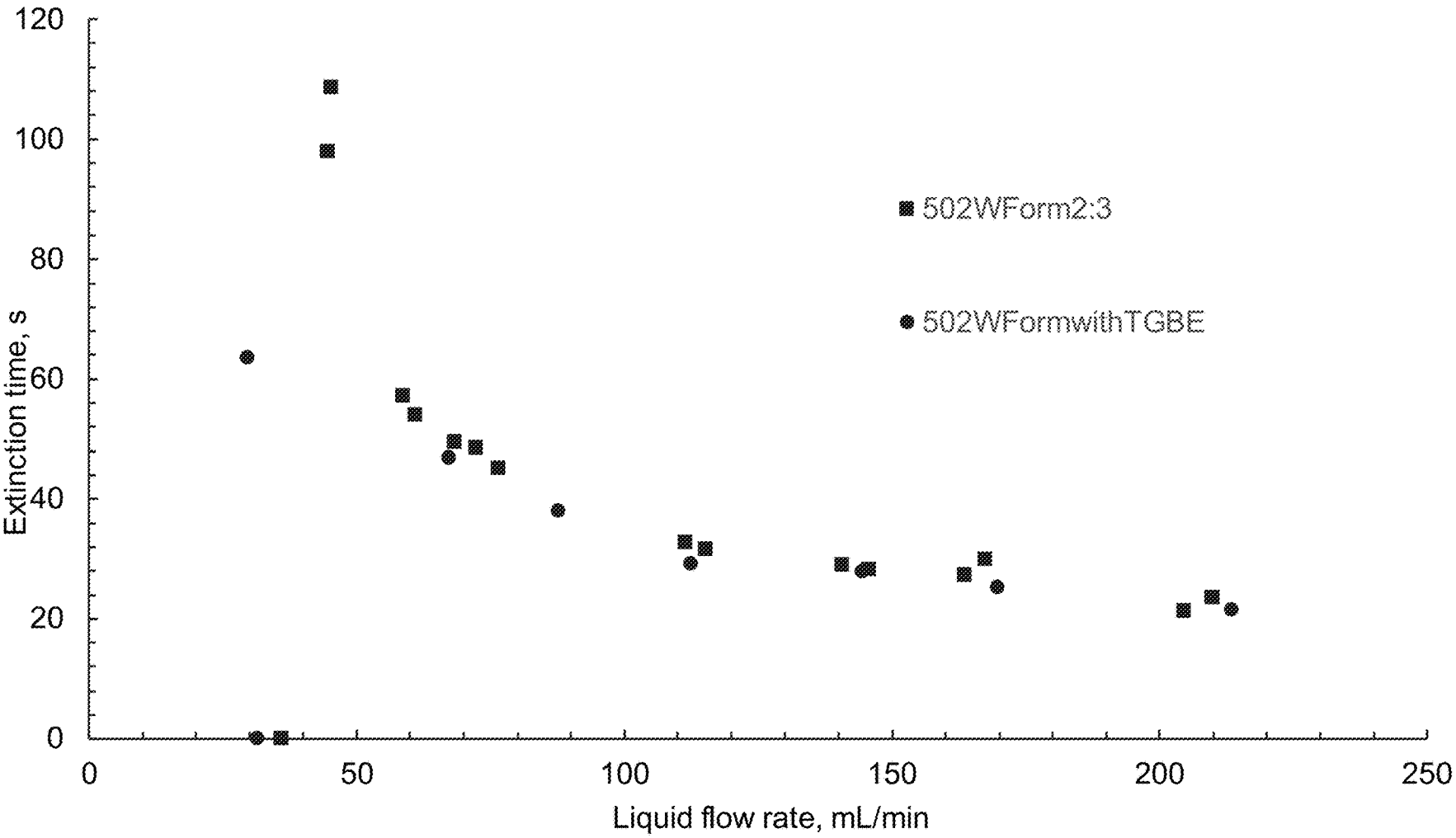
FIG. 8 shows the effect of the solvent's oxyethylene length on 19-cm diameter heptane pool fire performance for the siloxane formulation with diethylene (squares) and triethylene (circles) glycol monobutylethers. (Data points on x-axis represent no extinction).
Figure 9:
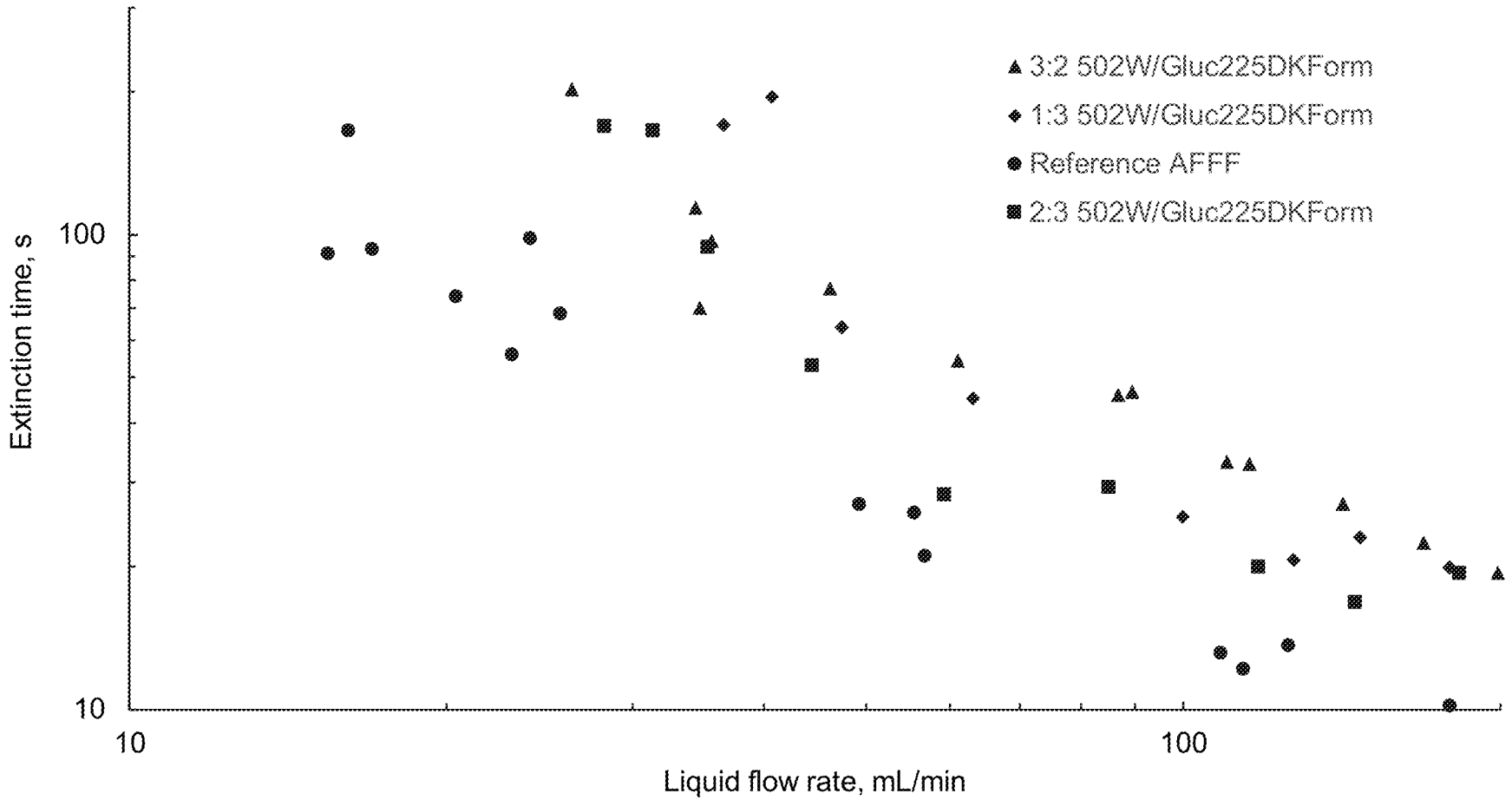
FIG. 9 shows the effects of varying the ratio of 502W/Glucopon225DK (1/3, 2/3, 3/2) surfactants on the 19-cm diameter heptane pool fire performance of the siloxane formulation, while keeping the total surfactant constant. 83 mL/min liquid flow corresponds to 2.9 kg/m$^2$/min liquid flux (used in 28 ft$^2$ pool MIL-F-24385F) and a foam flow of 698 mL/min. (Data points on x-axis represent no extinction).
Figure 10:
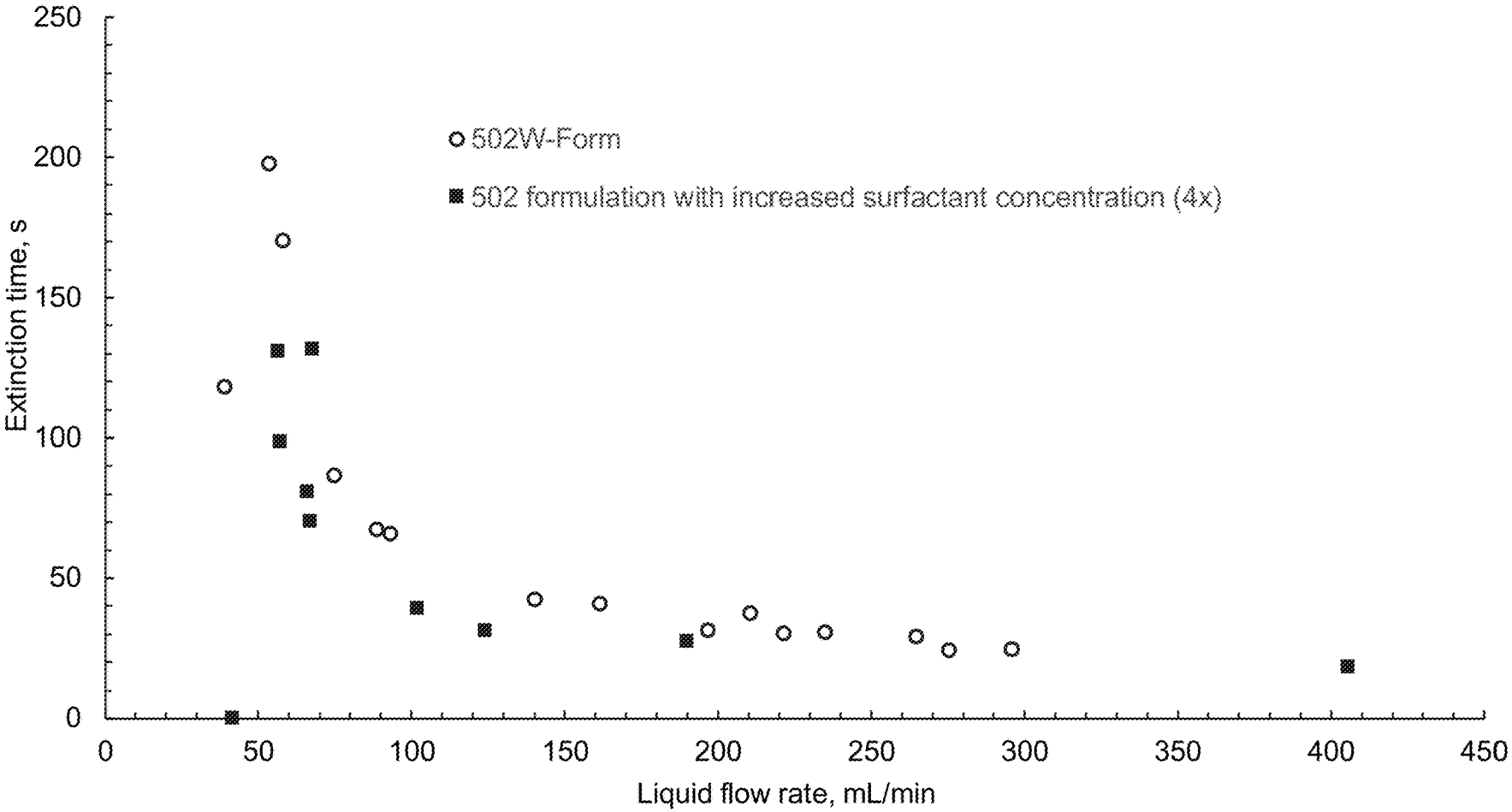
FIG. 10 shows the effects of varying total surfactant from 0.125% to 0.5% in the siloxane formulation on 19-cm diameter heptane pool fire suppression performance, while keeping the total siloxane surfactant to hydrocarbon surfactant ratio constant (3:2). (Data points on x-axis represent no extinction).

FIGS. 6 to 10 show examples of variations in the structural parameters of the two surfactants, solvent, and variation in the composition and surfactant amount, and their effects on fire extinction. Data points along the x-axis represent no fire extinction in FIGS. 6 to 10. As examples, FIG. 6 shows fire suppression performance of the commercial poly(oxyethylene) trisiloxanes shown in FIG. 5 as formulations. As the number of oxyethylene units (parameter m) increases, the fire suppression is shown to increase, with 67A having low suppression and 502W having high fire suppression. There is a range of oxyethylene chain lengths for a formulation to be most effective as a fire suppressant. As examples, FIG. 7 shows the effect of variation in parameters n and x in the glucoside surfactant structure shown in FIG. 1 on the fire extinction. Glucopon 225DK and Glucopon 215CS UP have a mean length of tail (n=8 to 10) but different lengths of head with x values of 0.7 and 0.5 respectively. Glucopon 600CS UP has a mean length of the tail (n=12-14) and head length x=0.4. Siloxane formulations were prepared with 502W/Glucopon/DGBE, 0.2/0.3/0.5%. Triton CG425 has longer alkyl chain length of 8 to 14. The effects of glucoside unit length, x, and alkyl chain length, n, on fire suppression are significant. The solvent also can affect the fire extinction. As examples, FIG. 8 shows the effect of increasing the parameter z, which is the length of oxyethylene chain, diethylene glycol butylether, and triethyleneglycol butylether. Siloxane formulations were prepared with solvent/502W/Glucopon, 0.5/0.2/0.3%.

Figure 11:
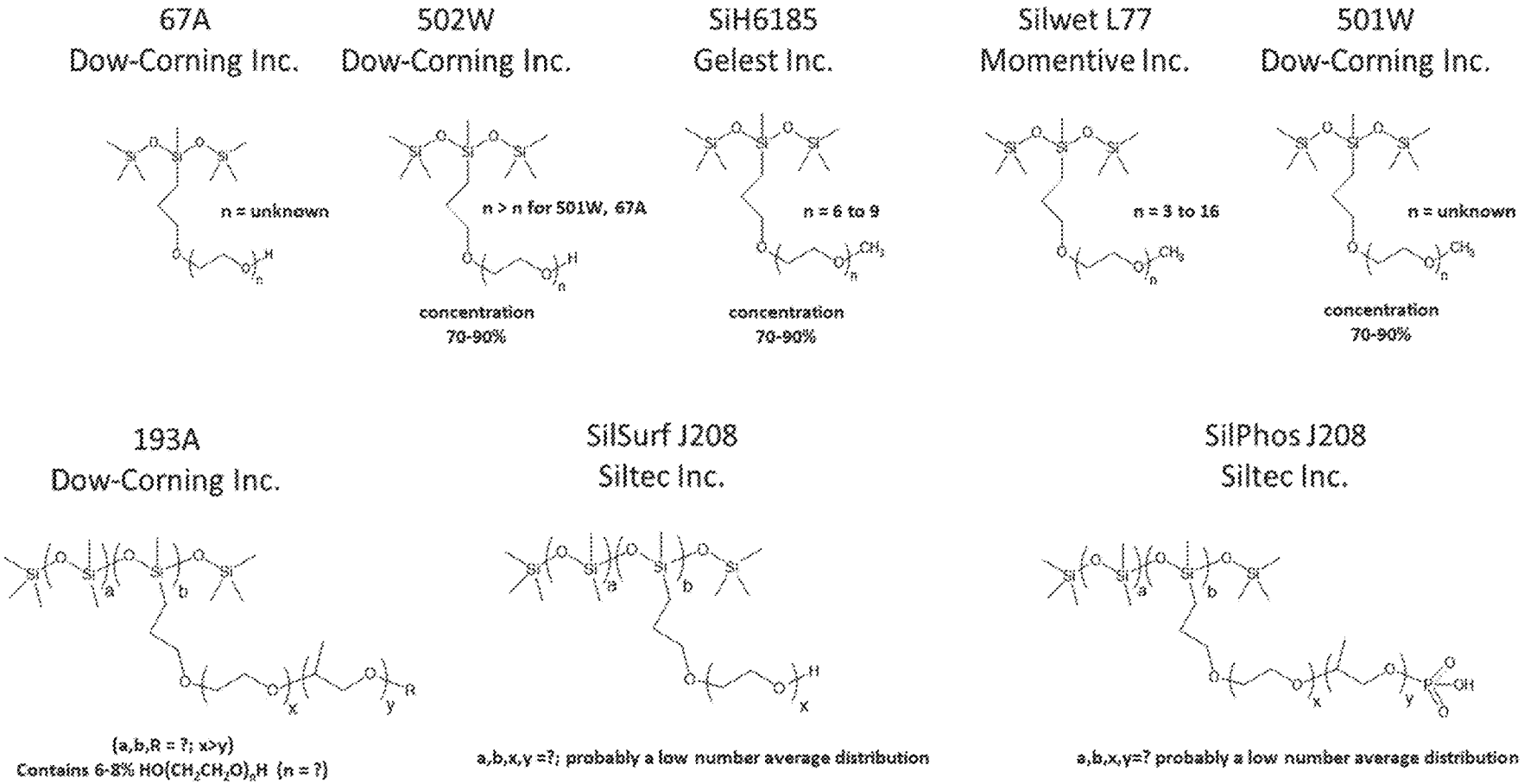
FIG. 11 shows example siloxane surfactants. Top row: all have identical trisiloxane tails with unspecified distribution of oxy-ethylene units (n) in the head group terminated with a hydroxyl unit. However, FIG. 5 gives estimated values of n=15, 13.5, 12.5, 10.5, and 10 for 502W, 501W, L77, GelestSiH6185, and 67A respectively based on analytical NMR data. GelestSiH6185 has n=6 to 9 and 502W has larger head than 501W and 67A. The other three are similar but have head groups terminated with a methyl unit. Bottom row: grafted surfactants with multiple tails and heads, but differing in the number of siloxane, oxy-ethylene and oxy-propylene units. Silphos is similar but has an anionic head group.
Figure 12:
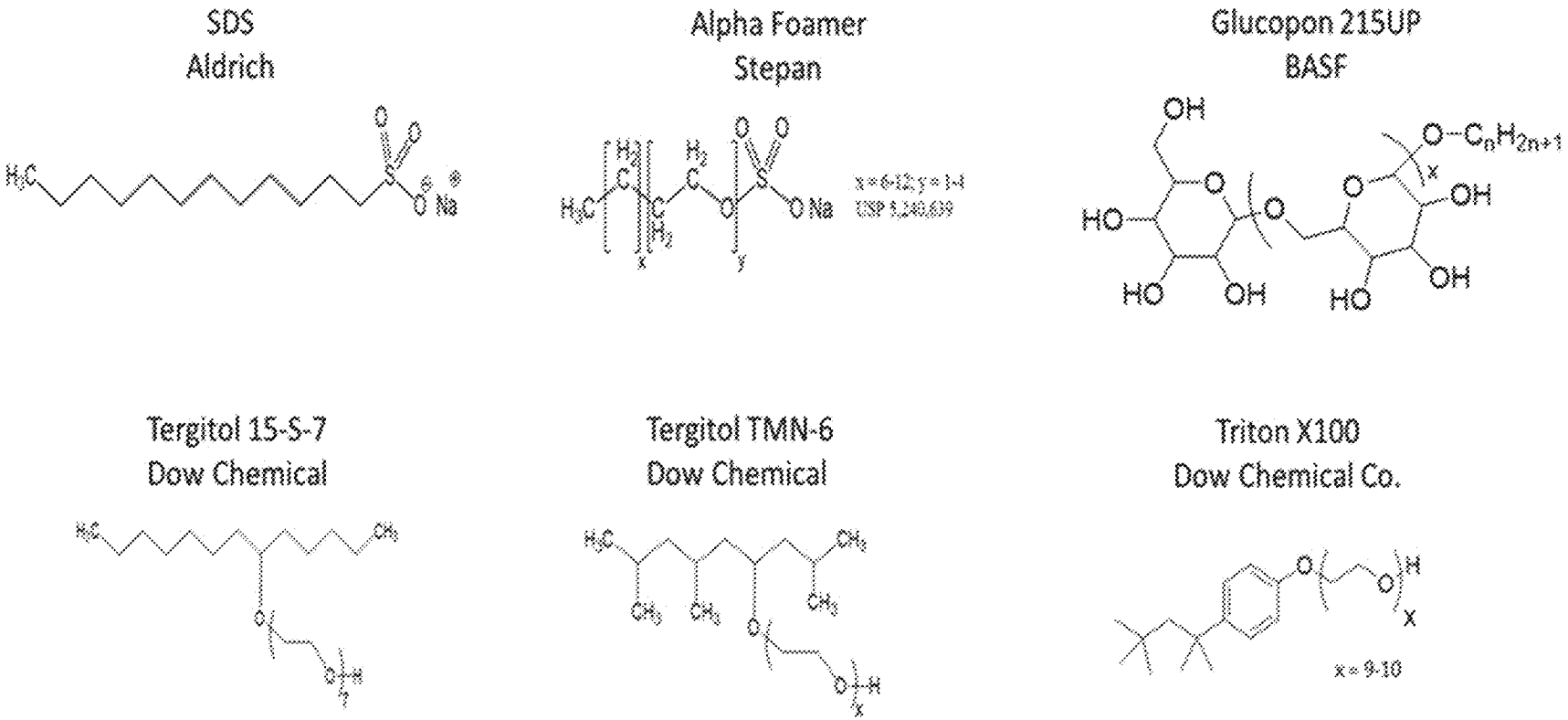
FIG. 12 shows hydrocarbon surfactants. Top row: SDS and Alpha Foamer differ by an oxy-ethylene unit in the head group; Alpha Foamer has a distribution of chain lengths including the dodecyl similar to SDS's tail. Glucopon 215UP has x=0.5, n=8-10, Glucopon225DK has x=0.7, n=8-10, and Glucopon600UP has x=0.4, n=12-14. Bottom row: Tergitols have twin hydrocarbon tails and similar head groups containing different length poly oxy-ethylene units. Tergitol TMN6 also has pendant methyl units. Triton is linear with phenyl linker.

A methodology is disclosed to rank numerous (14) commercial surfactants and numerous (14) siloxane formulations, and identify the siloxane formulation described above. The chemical structures of the commercial siloxane and hydrocarbon surfactants are shown in FIGS. 11 and 12 and serve as comparative examples to 502W commercial siloxane surfactant. The methodology consists of ranking surfactant chemical structures by their fuel resistance properties, which are measured in the absence of a fire. The fuel resistance properties are correlated with fire extinction performance. An example of fire extinction measurement consists of the foam application on to a burning pool described above but using a 12-cm diameter heptane pool, instead of the 19-cm diameter pool. Use of a smaller pool size to evaluate lower performing surfactants and formulations enables measurement of fire extinction times for quantitative comparison and structure-property correlation among surfactants. Fire extinction times are measured at different values of the foam flow rates. For the purpose of establishing the correlation, relative fire extinction was defined as the foam flow rate needed to achieve 30 second fire extinction and is expressed as relative to the measured value for RefAFFF formulation (140 mL/min for 30 s fire extinction). The fire performance of most hydrocarbon surfactants and siloxane surfactants could not be quantified by conducting fire extinction with the 19-cm diameter heptane pool fire. The order of ranking obtained by the fire performance agrees with the ranking by measured fuel resistance properties in the absence of a fire as discussed below.

Figure 13:
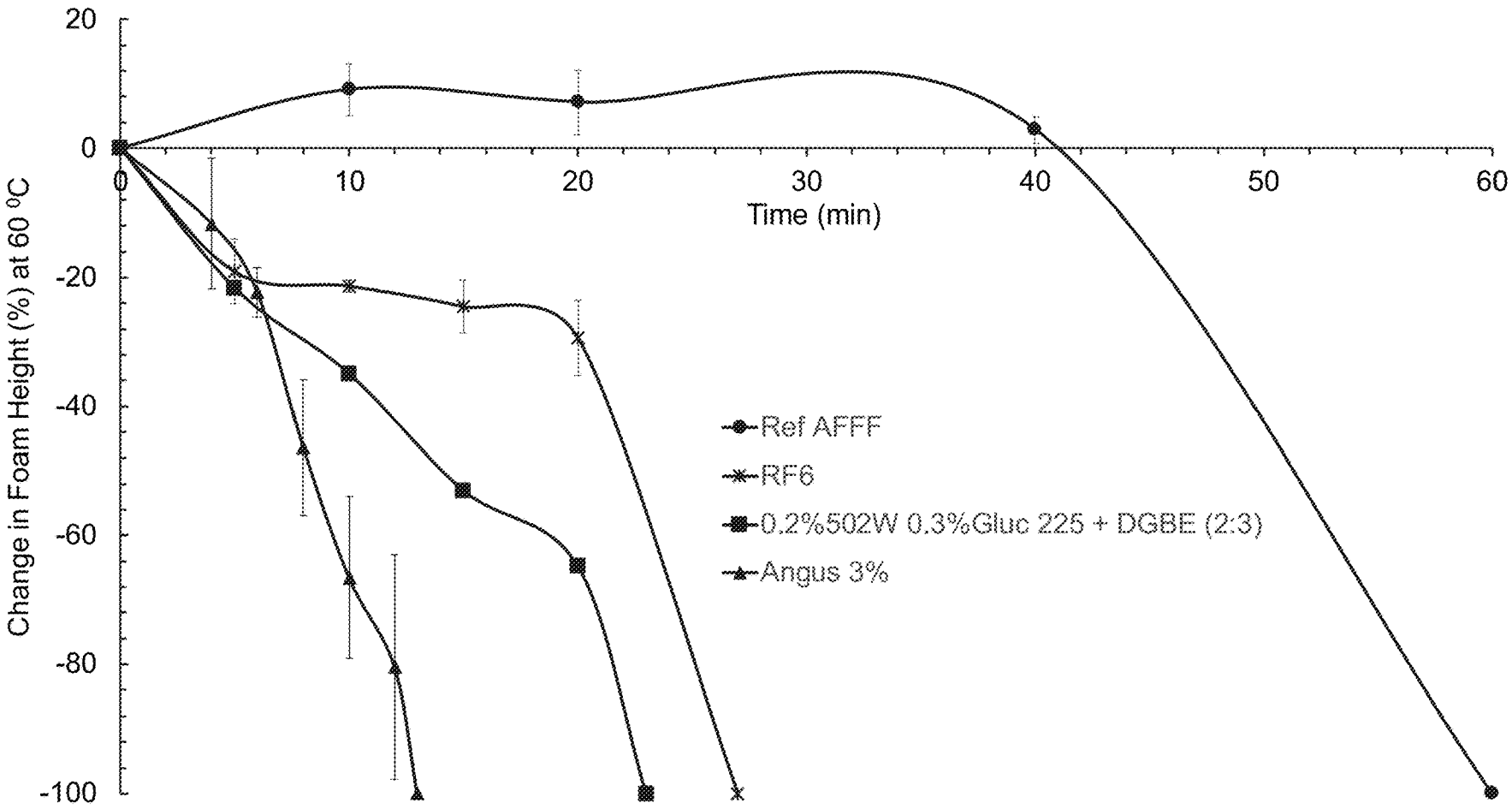
FIG. 13 shows decrease in foam thickness with time when a 4-cm layer is placed on top of hot 60° C. heptane pool. Comparison with commercial fluorine-free foams and reference AFFF. The bubbles close to the pool surface coalesce and drain liquid more rapidly than the bubbles farther from the interface; very little change in bubbles occurs when the foam layer is placed on hot water. Foam degradation is induced by the fuel.

Fuel resistance properties include measurements of foam degradation rate by fuel and fuel vapor diffusion rate through a foam layer placed on top of a fuel pool, which should be maintained at a constant temperature. An example of the apparatus, measurement methods used, and results were described elsewhere ("Measuring Fuel Transport through Fluorocarbon and Fluorine-free Firefighting Foams", *Fire Safety Journal,* 91, 653-661 (2017) and "Influence of Fuel on Foam Degradation for Fluorinated and Fluorine-free Foams", *Colloids and Surfaces A,* 522, 1-17 (2017)). As an example, foams were generated the same way as in the fire extinction measurements described above by aspirating inert gas (nitrogen is used instead of air to prevent potential fire) at a constant flow rate (900 mL/min). Foam flow was directed onto a hot heptane pool placed in an open beaker to form a 4-cm thick foam layer quickly. The bottom part containing fuel in the beaker was placed in a hot water bath to maintain a constant fuel temperature. As shown in FIG. 13, change in foam height was recorded with time to measure the degradation induced by the exposure to hot fuel.

Figure 14:
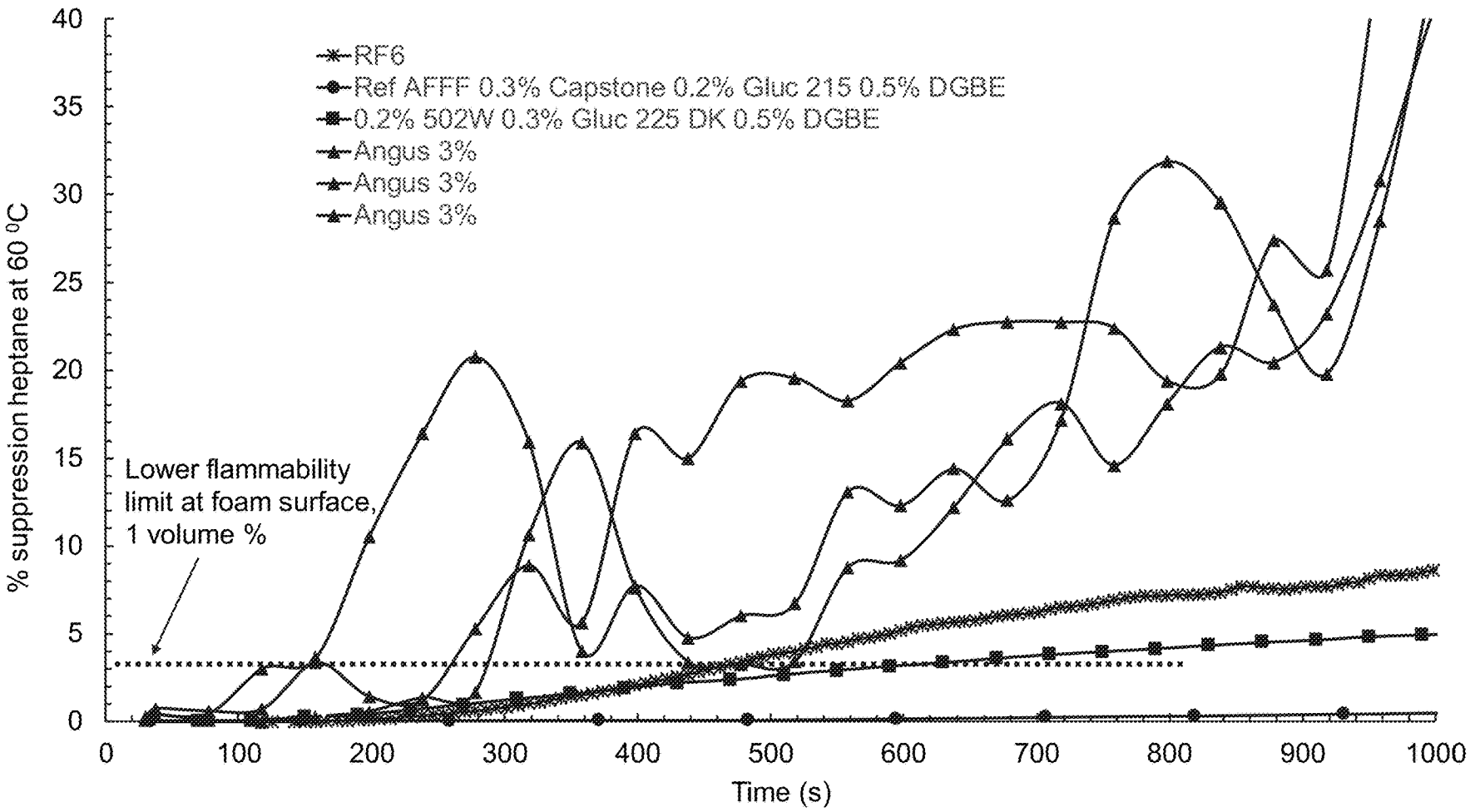
FIG. 14 shows percent suppression in heptane vapor concentration versus time when a 4-cm thick foam layer is applied onto a hot 60° C. heptane pool at time zero. As time progresses, heptane vapor permeates through the foam layer, which also decreases in its thickness as shown in FIG. 13. The time (indicated by vertical arrows) when the fuel concentration above the foam surface reaches lower flammability limit indicates the degree of fuel resistance of the surfactant formulation. Large variation is seen among the three trials for the commercial foam Angus 3%.

Similarly, as an example, measurement of fuel transport is described below. To measure fuel transport rate through foam, fuel and foam were introduced into the bottom half of a glass chamber in the same way as in the foam degradation experiment. The bottom part of the chamber was placed in hot water bath to maintain the fuel temperature at 60° C. The glass chamber was then closed tight and nitrogen gas was continuously fed (500 mL/min) into the chamber. The gas swept the surface of the foam carrying any fuel vapors permeated through the foam into FTIR, which recorded fuel vapor concentration with time until the foam degraded, exposing the bare fuel pool (19.6 $cm^2$ area). To obtain fuel vapor suppression fraction versus time, the fuel concentration was measured by the FTIR with the foam covering the pool divided by the measured concentration (5675 ppm, $1.3\times10^{-7}$ mole/$cm^2$/s) for bare heptane fuel. The suppression fraction with time is shown in FIG. 14. The fuel vapor concentration at the foam surface was obtained by multiplying the suppression fraction with the fuel vapor concentration on uncovered heptane pool (i.e. vapor pressure of heptane at 60° C., 29.5 vol %). FIG. 14 shows that the commercial fluorine-free foams (RF6 and Angus) have fuel resistance inferior to the siloxane formulation.

Foams were generated using a commercial surfactant solution by itself and as part of the formulation shown in Table 1 at a total surfactant concentration 4 to 10 times the critical micelle concentration. Time for complete degradation of 4-cm layer foam by the fuel is indicative of foam degradation rate for a given surfactant. Relative foam degradation rate is defined as the time for complete degradation of 4-cm thick foam layer generated using RefAFFF formulation divided by the corresponding value for the candidate surfactant. Similarly, time taken for the fuel vapor concentration at the foam surface to reach the lower flammability limit for heptane (1 volume %) is indicative of the fuel transport rate for a given surfactant. Relative transport rate is defined as time to reach 1 volume % on the surface of the foam layer generated from RefAFFF formulation divided by the corresponding value for a candidate surfactant.

Figure 15:
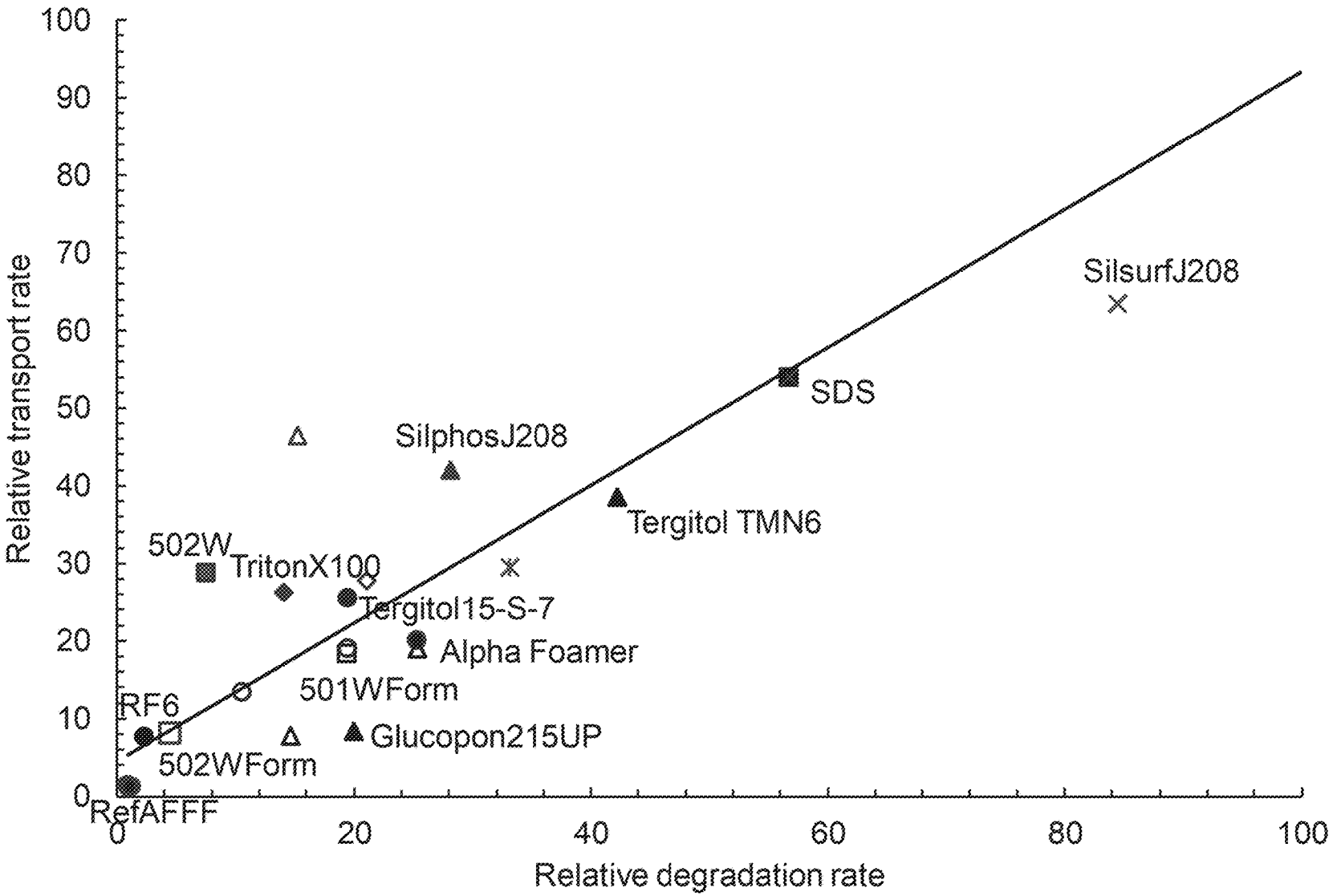
FIG. 15 shows fuel permeation rate and degradation of foam by the fuel vapor relative to AFFF, which is shown near origin. The fluorine-free siloxane foam (Siloxane A-Form) and RF6 (the leading commercial fluorine-free foam) are closest to the origin compared to the rest of the commercial surfactants tested. But, the siloxane foam suppresses the fuel vapor permeation and foam degradation by using significantly less solution than the commercial RF6. (Solid markers: surfactant solutions, open markers: custom formulations, "Form", line: best-fit.)
Figure 16:
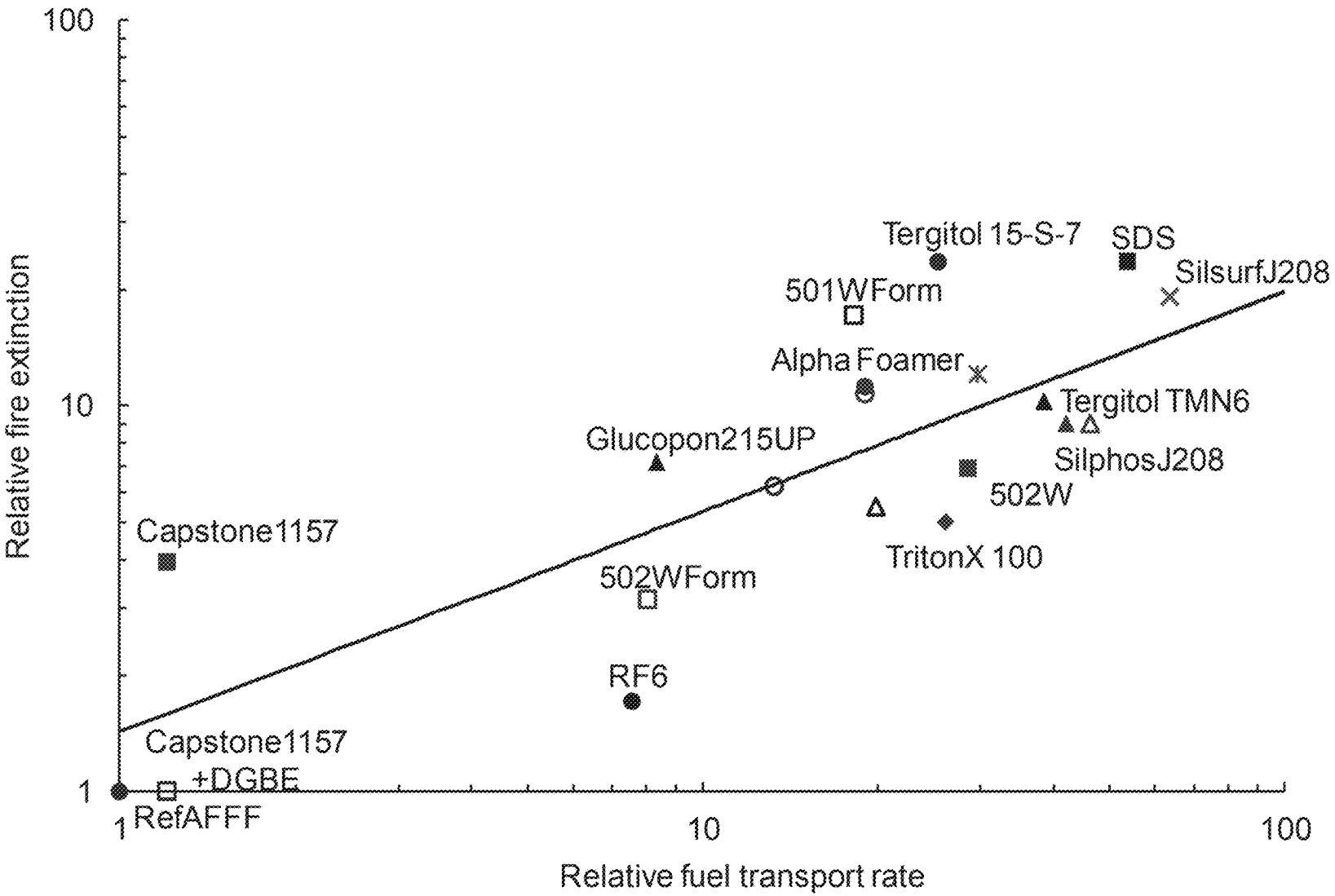
FIG. 16 shows 12-cm heptane pool fire extinction versus fuel permeation rate relative to AFFF showing a direct correlation. Fire extinction is within a factor of 3 of AFFF for the fluorine-free foams of Siloxane A-Form and RF6 (Solberg Inc.) but use significantly different amounts of solution to do so. Other commercial surfactants are far inferior as indicated by the distance away from the origin, where AFFF is placed.

FIG. 15 shows a correlation between relative fuel transport rate through foam and relative foam degradation rate for 28 commercial siloxane and hydrocarbon surfactants and their formulations. FIG. 15 shows how the chemical structure variations shown in FIGS. 11 and 12 affect the fuel resistance properties of the foams. FIG. 15 shows that the fluorocarbon surfactant formulation RefAFFF near the origin having the slowest fuel transport rate and foam degradation rate (highest fuel resistance properties, time for complete degradation of foam: 3800 s, time for fuel vapor concentration to reach 1 vol. % at foam surface: 3619 s). All of the fluorine-free surfactants are placed at different distances from the origin, based on their relative rates (relative rate=time for RefAFFF/time for a candidate foam). Among the surfactants tested, the most commonly used sodium dodecyl sulfonate (SDS) and a siloxane SilsurfJ208 (Siltec Inc.) are farthest from the origin indicative of their low fuel resistance properties. FIG. 15 shows that the siloxane formulation ("502WForm" is 502W/Glucopon215UP/DGBE 0.075/0.05/0.5% by volume) and the leading commercial fluorine-free formulation (RF6, Solberg Inc.) are the closest to RefAFFF among the surfactants tested. FIG. 16 shows a correlation of the relative fire extinction with the relative fuel transport rate for 28 commercial siloxane and hydrocarbon surfactants and their formulations. The fluorocarbon surfactants (Capstone1157, RefAFFF) are closest to the origin and SDS and SilsurfJ208 are the farthest indicating that faster fuel transport results in longer fire extinction time. Again, the siloxane formulation (502WForm) and the commercial fluorine-free formulation, RF6 are the closest to RefAFFF (foam flow needed to achieve 30 s extinction time=140 mL/min, time for fuel vapor concentration to reach 1 vol. % at foam surface=3619 s). The ranking of various surfactant by their distance from origin generally follow the trends shown in FIG. 15; few exceptions such as Capstone1157 with DGBE is due to the synergistic effects caused by the solvent. Because the relative extinction was defined based on foam flow rate rather than liquid flow rate, the siloxane formulation (502WForm) appears closer to RF6. On per unit liquid basis, the siloxane performs better than RF6. Relative fire extinction was defined as the foam flow rate needed to achieve 30 second fire extinction and is expressed as relative to 140 mL/min.

A summary of extinction results corresponding to commercial surfactants evaluated by themselves and as part of formulation (where capstone is replaced by the fluorine-free surfactant in RefAFFF and denoted as "Form") are shown in Table 2. 502WForm shown in Table 2 consists of 502W/

GlucoponCS215UP/DGBE of 0.075/0.05/0.5% and has an extinction time of 25 s. Siloxane formulation shown in Table 2 consists of 502W/Glucopon225DK/DGBE of 0.2/0.3/0.5% and has one of the longest fuel transport and foam degradation times among the fluorine-free formulations tested.

TABLE 2

Fire extinction time for foams generated by different surfactant solutions for 12-cm diameter n-heptane pool with 2-cm lip and 30 seconds preburn. Extinction is based on foam flow rate, not liquid flow rate.

| Surfactant | Extinction@500 mL/min foam flow | Transport time to reach 1 vol % on foam surface, s | Degradation time for 4-cm foam layer, s |
|---|---|---|---|
| RefAFFF | 12 | 3619 | 3800 |
| Capstone1157 + DGBE | 12 | 2790 | 2700 |
| RF6 | 17 | 478 | 1620 |
| 502WForm | 25 | 448 | 840 |
| Capstone1157 | 38 | 2710 | 2100 |
| Glucopon215UP | 40 | 433 | 190 |
| TritonX100 | 44 | 138 | 270 |
| Tergitol TMN6Form | 70 | 182 | 150 |
| 502W | 70 | 126 | 500 |
| Tergitol 15-S-7Form | No extinction | 272 | 360 |
| 501WForm | No extinction | 198 | 195 |
| AlfafoamerForm | No extinction | 190 | 195 |
| Alfafoamer | No extinction | 190 | 150 |
| Tergitol 15-S-7 | No extinction | 142 | 195 |
| SilsurfForm | No extinction | 122 | 115 |
| Tergitol TMN6 | No extinction | 94 | 90 |
| SilphosJ208 | No extinction | 86 | 135 |
| SilphosForm | No extinction | 78 | 250 |
| SDS | No extinction | 67 | 67 |
| SilsurfJ208 | No extinction | 57 | 45 |
| 501W | No extinction | 20 | 20 |
| 67A (0.5%) | NA | 76 | 120 |
| Glucopon215UP + DGBE | NA | 470 | 260 |
| TritonX100 + DGBE | NA | 130 | 180 |

TABLE 2-continued

Fire extinction time for foams generated by different surfactant solutions for 12-cm diameter n-heptane pool with 2-cm lip and 30 seconds preburn. Extinction is based on foam flow rate, not liquid flow rate.

| Surfactant | Extinction@500 mL/min foam flow | Transport time to reach 1 vol % on foam surface, s | Degradation time for 4-cm foam layer, s |
|---|---|---|---|
| Angus 3% | NA | 158 | 780 |
| Siloxane Formulation | NA | 630 | 1380 |

Figure 17:
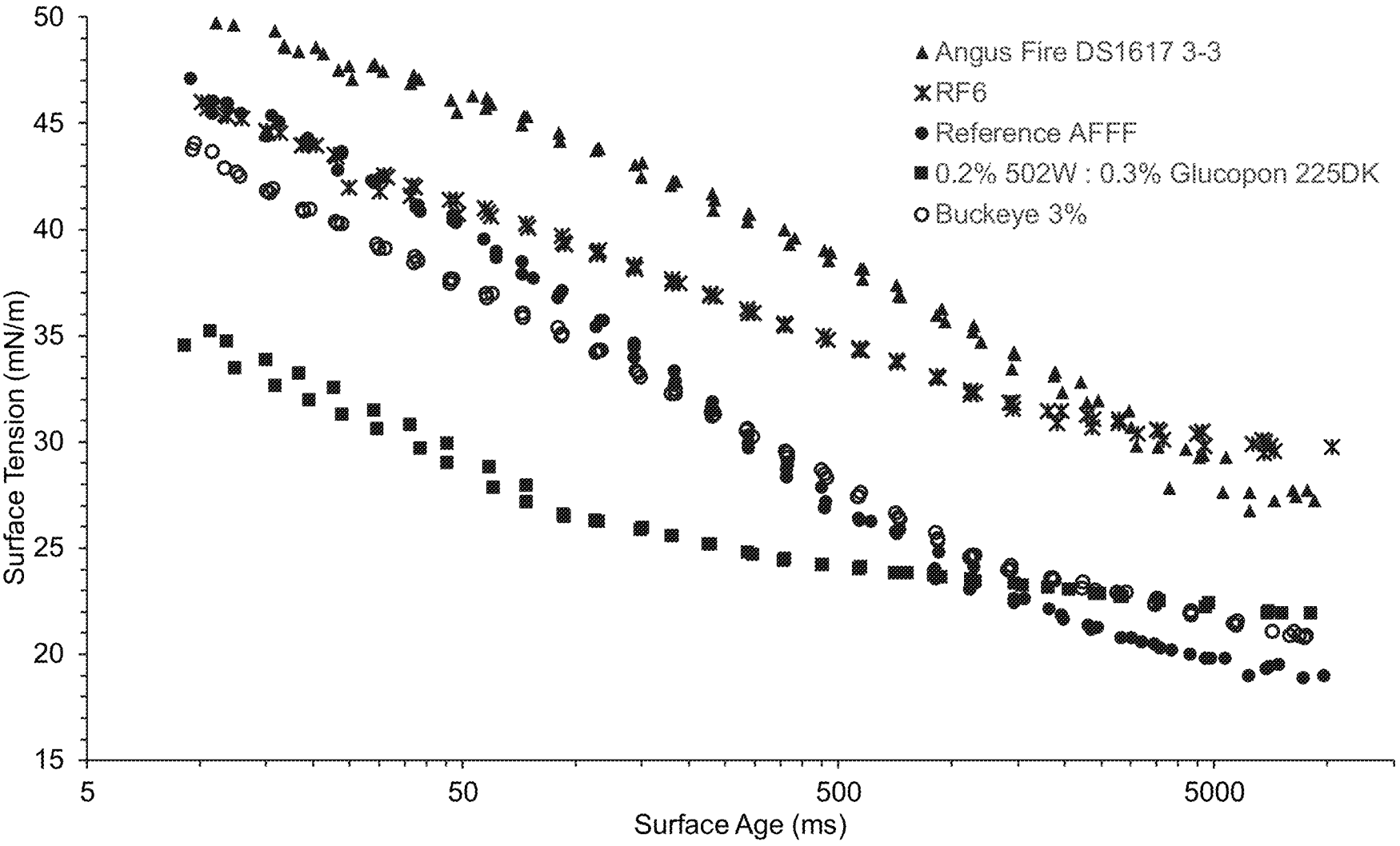
FIG. 17 shows dynamic surface tension versus time for the siloxane formulation and other hydrocarbon and fluorocarbon surfactant formulations. At small times, the siloxane formulation exhibits unique and rapid decrease in surface tension relative to the other commercial formulations shown. At long times, the siloxane formulation has slightly greater surface tension than AFFF.

Dynamic surface tension is important for making high quality foams with small bubble sizes. The dynamic surface tension as measured by KRUSS bubble tensiometer and example results are shown in FIG. 17. The siloxane formulation reaches low surface tension very quickly compared to the commercial fluorine-free foams (RF6, Solberg Inc. and Angus/National Inc.'s Respondol 3%). This is consistent with small bubbles observed for the siloxane formulation compared to other hydrocarbon surfactant based formulations shown in FIG. 17. The rapid reduction in surface tension is important because bubbles are formed rapidly in large scale fire application where pressurized nozzle is used to generate the foam rapidly from solution. Surprisingly, the siloxane foam reaches low values of surface tension more rapidly than AFFF. However, AFFF is expected to reach lower value of the surface tension at long times than the siloxane foam. Therefore, aqueous film formation is not expected to occur for the siloxane formulation unlike that of AFFF.

Table 3 shows solution properties of three siloxane formulations in columns 3 to 5, two commercial fluorine-free formulations (RF6 and Angus) in columns 6 and 7, commercial AFFF (Fomtec Inc.) in column 8, and RefAFFF in column 9. As expected, fluorine-free formulations have near zero or negative spreading coefficients.

TABLE 3

Comparison of siloxane surfactant formulations with a commercial AFFF formulation (Fomtec), commercial fluorine-free formulations (3% concentrate Respondol DS1617 ATF 3/3 of Angus Inc., 6% concentrate RF6 of Solberg/3M Co. 2005) and MilSpec criteria.

| MilSpec Test | Criteria | 2:3 502W/ Glucopon225DK | 3:2 502W/ Glucopon225DK | 1:3 502W/ Glucopn225DK | Angus 3% | RF6 | FomtecAFFF | RefAFFF |
|---|---|---|---|---|---|---|---|---|
| 3% concentrate viscosity at 20° C. (cP) | >2 | 5.3 | 6.29 | 5.09 | 5892 | * | 4.3 | 3.19 |
| 3% concentrate viscosity at 5° C. (cP) | <20 | 7.41 | 8.23 | 6.9 | NA | NA | 8.92 | 4.73 |
| Premix solution viscosity (cP) | NA | 1.14 | 1.11 | 1.14 | 12 | 2.75 | NA | 1.12 |
| 3% concentrate refractive index | >1.363 | 1.3706 | 1.3720 | 1.3709 | 1.3656 | 1.3701 | 1.3737 | 1.3617 |
| 3% concentrate pH | 7-8.5 | 6-8 | 6-8 | 6-8 | 6-8 | 6-8 | 8.22 | 6-8 |
| Premix solution surface tension (mN/m) | NA | 22.4 | 21.95 | 22.9 | 23.2 | 26.25 | NA | 15.2 |
| Premix solution interfacial tension with cyclohexane (mN/m) | NA | 2.289 | 2.587 | 2.008 | 1.0 | 2.557 | NA | 4.483 |
| Premix solution spreading coefficient on cyclohexane (mN/m) | >3 | −0.4 | −0.2 | −0.6 | −3.4 | −4.5 | 6.27 | 8.1 |

* Too high to measure

Additional testing compares bench scale performance to large pool performance. Fire extinction measurements were conducted for the compositions shown in Table 4. Transport, degradation, and other solution and foam properties were also measured. Table 4 shows the compositions of three Siloxane-Gluc formulations and the RefAFFF formulation used for making the foams. The percentages of surfactants and DGBE refer to the amounts of the surfactant concentrates and DGBE supplied by the respective manufacturers. The surfactant concentrations shown in Table 4 for the Siloxane formulations are two and half (3:2 Siloxane-Gluc215) to ten times (2:3 Siloxane-Gluc225 and 2:3 Siloxane-Gluc600) the respective CMC values, and the RefAFFF is 5 times the CMC value. Increasing the concentrations of the siloxane and glucoside surfactants to 0.3% and 0.2% respectively in 3:2 Siloxane-Gluc215 formulation shown in Table 4 did not result in a significant change (<10%) in fire extinction, degradation, and transport properties in the bench scale measurements possibly because they are significantly higher than CMC.

TABLE 4

Fluorine-free siloxane surfactant formulations and fluorinated RefAFFF formulation. The values shown under each column are volume percentages of the individual components (or concentrates) in distilled water. The formulations were used for foam generation, property and fire performance measurements.

| 2:3 Siloxane-Gluc225 | 2:3 Siloxane-Gluc600 | 3:2 Siloxane-Gluc215 | 3:2 Cap-Gluc215 (RefAFFF) |
|---|---|---|---|
| 0.2% 502W | 0.2% 502W | 0.075% 502W | 0.3% Capstone |
| 0.3% Glucopon 225 DK | 0.3% Glucopon 600 CS UP | 0.05% Glucopon 215 CS UP | 0.2% Glucopon 215 CS UP |
| 0.5% DGBE | 0.5% DGBE | 0.5% DGBE | 0.5% DGBE |

Fire extinction time measurements using the benchtop heptane pool-fire apparatus was described previously to compare RefAFFF, commercial AFFF, and commercial fluorine-free foams (Conroy et al., "Surface Cooling of a Pool fire by Aqueous Foams", *Combustion Science and Technology,* 189, 806-840 (2017); Hinnant et al., *Surfactant and Detergents,* 21, 711-722, (2018); Williams, "Properties and Performance of Model AFFF Formulations", Workshop on Firefighting Foams in the Military, Naval Research Laboratory, Washington, D.C., (Dec. 16-18, 2004)). Here, the fire suppression data for a commercial AFFF (Buckeye 3%) and the four formulations shown in Table 1 are compared, namely the RefAFFF, the Siloxane-Gluc225, Siloxane-Gluc600, and Siloxane-Gluc215 surfactants formulations. In a 19-cm diameter heptane pool fire using a foam application rate of 1000 mL/min, at 0 seconds, the foam is introduced to the pool fire surface after the pool has been burning for 60 seconds. Within the first 5 seconds of foam application, a significant suppression is not observed in all cases. After 10 seconds of foam application, the 3:2 Cap-Gluc215 (RefAFFF) formulation extinguished most of the fire (knockdown) similar to a commercial AFFF (Buckeye), while the Siloxane-Gluc225 formulation did not suppress the fire to the same degree After 15 seconds there was complete extinction by Buckeye and RefAFFF, while Siloxane-Gluc225 suppressed most of the fire (knockdown). Siloxane-Gluc225 took longer (20 seconds) to completely extinguish the fire unlike the other two fluorinated foams, 3:2 Cap-Gluc215 and Buckeye 3%, which took 12 and 16 seconds respectively for complete extinction. For the two fluorinated foams and the fluorine-free foam, fire persisted for a few seconds above the foam even in the regions of the pool covered with the foam and also subsequent to complete coverage of the pool by the foams. In the case of the two fluorinated foams, the fire persisted above the foam layer for as long as 50% of the extinction time and may underscore the significant role the foam layer plays in fire extinction relative to any "aqueous film" layers that may exist underneath the foams. Also, the persistent fire above the foam layer may be indicative that the fuel vapor emanating from the hot pool surface permeates through the foam layer feeding the fire above. The fuel transport through the foam ceases as the foam layer thickens due to continued application of the foam, resulting in fire extinction due to lack of the fuel supply. During the extinction process, foam also degrades and delays building a thick foam layer. This can be noticed at very slow foam application rates, where the foam was unable to cover the pool despite continuous application of the foam for a long time (up to 6 min) because foam was degraded by the hot fuel and the fire. At high flow foam application rates subsequent to the fire extinction, the residual foam layer disappeared quickly with time especially for the fluorine-free foams. Thus, high fuel transport and high foam degradation can increase the minimum volume of foam (or minimum foam layer thickness) needed to extinguish a fire, which is a performance measurement of a given formulation (For example, MilSpec requires a 28 $ft^2$ fire to be put out in 30 s using less than 1 gallon of surfactant solution, which translates to 5 to 10 gallons of foam depending on the expansion ratio). It is difficult to measure fuel transport and foam degradation during the rapid extinction process. However, they can be measured under controlled conditions as performance characteristics of a given formulation.

Figure 18:
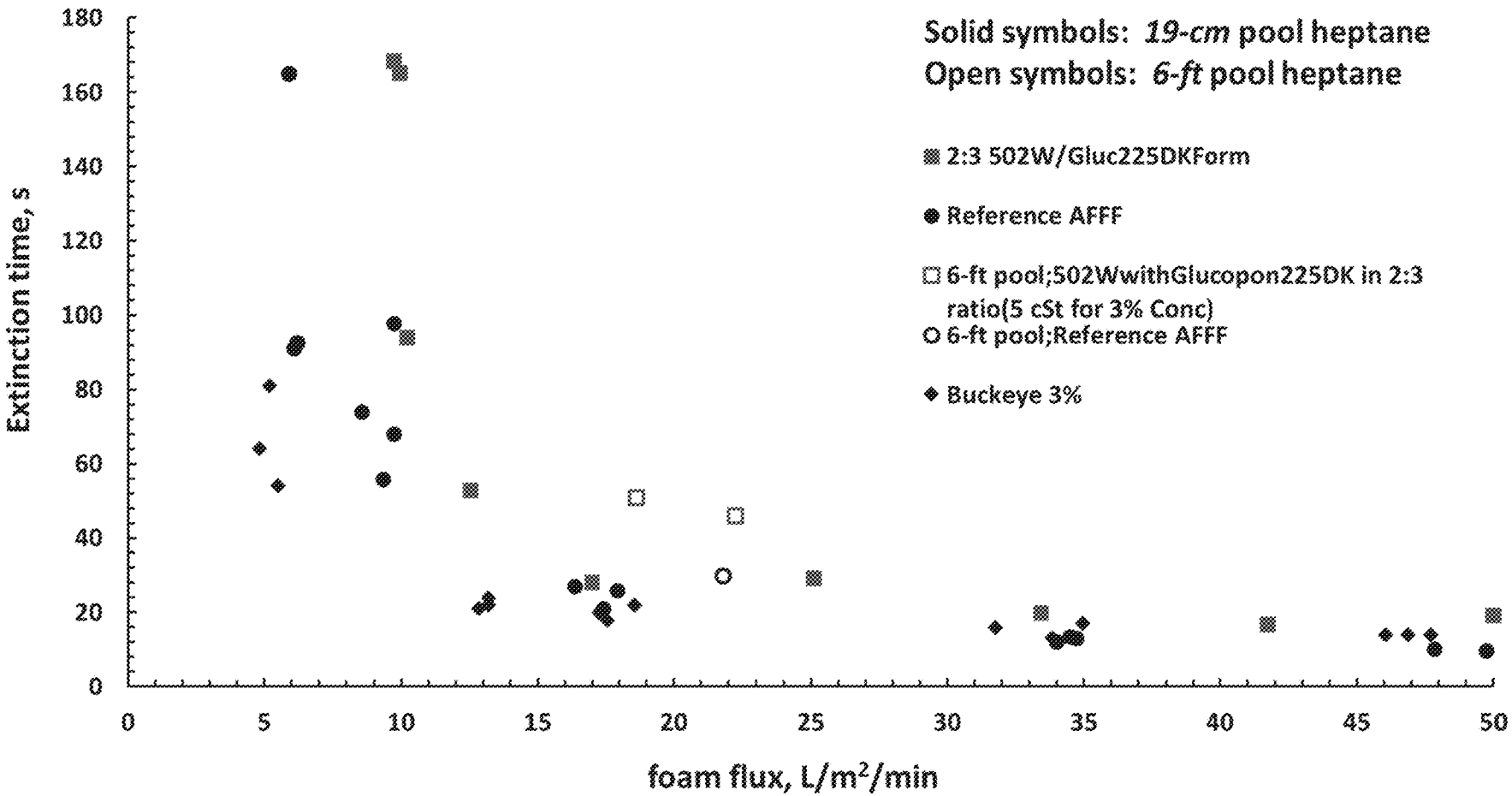
FIG. 18 shows bench-scale (19-cm dia.) and large scale (6-ft dia.MIL-F-24385F) extinction of heptane pool fire showing extinction times of Siloxane-Gluc225 surfactant formulation in Table 1 relative to the RefAFFF and commercial formulation (Buckeye 3%) at different measured foam application rates. For the 6-ft fire, the foam and liquid flux values correspond to 2 and 3 gallons/min solution flow rates.

FIG. 18 shows extinction times measured for bench top (19-cm diameter) and large scale (6-ft diameter) heptane pool fires as functions of foam application rate per unit area (flux) of the pool. The 6-ft pool fire test is same as the MilSpec MIL-F-24365F but the gasoline fuel is replaced with heptane. For the benchtop, fire extinction times for the Siloxane-Gluc225 surfactants formulation (solid square) are compared with RefAFFF (solid circle) and the commercial AFFF (Buckeye 3%, solid diamond) foams. As the foam application rate is decreased, the extinction time increases. and When the extinction time is greater than 180 seconds, the foam application is stopped and the fire is extinguished by placing a tray over the pool. The RefAFFF and the Siloxane-Gluc225 formulations could not extinguish the flame within 180 seconds at foam application rate below 5.9 and 9.7 $L/m^2/min$ respectively. The extinction times for the siloxane formulation are closer (<1.5 times that of RefAFFF) to the AFFFs at large foam application rates. For the 6-ft (1.8 m) heptane pool fire, the extinction times for the Siloxane-Gluc225 formulation are compared at fixed solution flow rates of 7.6 and 11.4 L/min (2 and 3 gallons per minute) which correspond to 18.6 and 22.2 $L/m^2/min$ of foam flow rates respectively. The foam flow rates are calculated by multiplying the measured liquid flow rates with the measured expansion ratio values. The extinction times for the Siloxane-Gluc225 formulation are compared with that of RefAFFF formulation for the 6-ft heptane fire in FIG. 18. The extinction times are 45 and 30 seconds for the Siloxane-Gluc225 and RefAFFF respectively at a fixed foam flux of about 22 $L/m^2/min$. Thus the extinction times for the siloxane formulation are within 1.5 times those for the RefAFFF, consistent with the bench-scale data for the same foam flux. Despite significant differences in the foam generation and foam properties between the bench and large scales, the fire extinction data are surprisingly consistent possibly because the surfactant-fuel interactions and the foam application rate per unit area have more significant effects. Although the foam application rate 22 L/m$^2$/min is about the same for the two formulations, the solution application rate 11.4 L/min (3 gallon/min, expansion ratio 5.1) is higher for the Siloxane-Gluc225 than 7.6 L/min (2 gallon/min, expansion ratio 7.5) for the RefAFFF because of the differences in the foam expansion ratio in the large scale testing. The foam expansion ratio of Siloxane-Gluc225 decreases from 6.4 to 5.1 as the solution flow rate increases from 2 gpm to 3 gpm during the large scale foam generation. The extinction data shown in FIG. 18 are plotted as function of solution application rate in FIG. 19. Comparing FIG. 18 with FIG. 19, the large and small scale data are closer for a fixed foam application rate rather than for a fixed liquid application rate as one may expect. Also, for a fixed extinction time of 51 seconds, the foam application rate is 1.5 times higher for the large scale heptane pool than for the small scale data shown in FIG. 19.

The fluorinated surfactant formulation (RefAFFF) was able to extinguish the heptane pool fire in 90 seconds as the foam application rate was decreased to less than 5.9 L/m$^2$/min in FIG. 18 (solid circles). Replacing the fluorocarbon surfactant with a commercial siloxane surfactant in a simple four-component formulation required only 50% greater foam application rate (9.7 L/m$^2$/min) to achieve an equivalent extinction time (90 seconds) as shown in FIG. 18 (solid squares). Given the simplicity of the formulations evaluated compared to a commercial formulation, the fire suppression performance of the Siloxane-Gluc225 is reasonably good, and may lead to further improvements in fire suppression with further optimization.

Fire suppression was conducted in the 6-ft diameter pool (28 ft$^2$) MilSpec standard pool fire by foams generated from Siloxane-Gluc225 and Cap-Gluc215 (RefAFFF) formulations listed in Table 5 using heptane as the fuel so that the results can be compared with the bench-scale results. Tests were performed at solution flow rates of 2 gpm and 3 gpm (expansion ratio 5.1) and with Cap-Gluc215 (RefAFFF, expansion ratio 7.5) at 2 gpm. Even though the solution application rates are different between Siloxane-Gluc225 and RefAFFF formulations, the foam application rates (22 L/m$^2$/min or 57.3 L/min or 15 gpm) shown in 3$^{rd}$ row of Table 5 are about the same because of the higher expansion ratio measured for RefAFFF (expansion ratio 7.5) than for Siloxane-Gluc225 (expansion ratio 5.1); the foam application rates are calculated by multiplying the solution flow rates with the expansion ratio and are not measured directly as a part of the MilSpec testing. The foams are applied at 0 seconds after the heptane pool has burned for 10 seconds. After 15 seconds, the Siloxane-Gluc225 did not suppress the fire to the extent RefAFFF did. After 30 seconds, the Siloxane-Gluc225 suppressed most of the fire while RefAFFF completely extinguished it. The fire extinction time for the siloxane-Gluc225 decreased from 51 to 45 seconds as the solution flow rate increased from 2 to 3 gallon/min compared to the extinction time of 30 seconds for the RefAFFF.

TABLE 5

Comparison of Siloxane-Gluc225 formulation at 2 and 3 gpm and with RefAFFF at 2 gpm liquid application rate for 6-ft diameter MilSpec MIL-F-24385 pool fire using heptane as the fuel instead of gasoline[1].

| MilSpec test with heptane fuel | 2:3 Siloxane-Gluc225 | | RefAFFF 3:2 Cap/Gluc215 | Criteria (based on gasoline) |
|---|---|---|---|---|
| Liquid flow rate (gpm) | 2 | 3 | 2 | 2 |
| Foam flow rate[2] (gpm) | 12.8 | 15.3 | 15 | N/A |
| 90% extinction (s) | 43 | 26 | 21 | N/A |
| Extinction (s) | 51 | 45 | 30 | <30 |
| Burnback (s) | 338 | 424 | 981 | >360 |
| Film and seal | N/A | N/A | PASS | PASS |
| Expansion ratio | 6.4 | 5.1 | 7.5 | 5-10 |
| 25% Liquid Drainage (s) | 198 | 198 | 251 | >150 |
| Average bubble size (μm) | 220 ± 111 | 140 ± 30 | 170 ± 30 | N/A |
| 3% concentrate viscosity, 20° C. (cP) | 5.3 | 5.3 | 3.2 | >2 |
| 3% concentrate viscosity, 5° C. (cP) | 7.4 | 7.4 | 4.7 | <20 |
| Solution viscosity, 20° C. (cP) | 1.14 | 1.14 | 1.12 | N/A |
| Spreading coefficient on cyclohexane[3], (mN/m) at 20° C. | −0.4 | −0.4 | 6.4 | >3 |
| Interfacial tension on cyclohexane, (mN/m) at 20° C. | 2.2 | 2.2 | 1.9 | N/A |
| Surface tension (mN/m) at 20° C. | 22.4 | 22.4 | 16.7 | N/A |
| 3% concentrate refractive index | 1.371 | 1.371 | 1.362 | >1.363 |
| CMC (% volume of total surfactant concentrates) | 0.05 | 0.05 | 0.1 | N/A |
| 3% concentrate pH | 6-8 | 6-8 | 6-8 | 7-8.5 |

[1]The MilSpec results for unleaded, alcohol-free, gasoline fire suppression using RefAFFF were given in Hinnant et al., *Surfactants and Detergents*, 21, 711-722, (2018)
[2]Foam flow rate is the specified liquid flow rate multiplied by the measured foam expansion ratio
[3]Surface tension of cyclohexane is 25 mN/m at 20° C.

A subset of five metrics in the MilSpec standard MIL-F-24385 were focused on to evaluate the Siloxane-Gluc225 and the RefAFFF formulations. Five parameters were measured and compared with passing criteria, which are based on gasoline fuel rather than the heptane. The parameters measured were (1) 28 ft$^2$ gasoline pool fire extinction time, (2) burnback time, (3) film and seal, (4) expansion ratio, and (5) 25% drainage time, and are described in MilSpec standard MIL-F-24385. The results are shown in Table 5.

Figure 19:
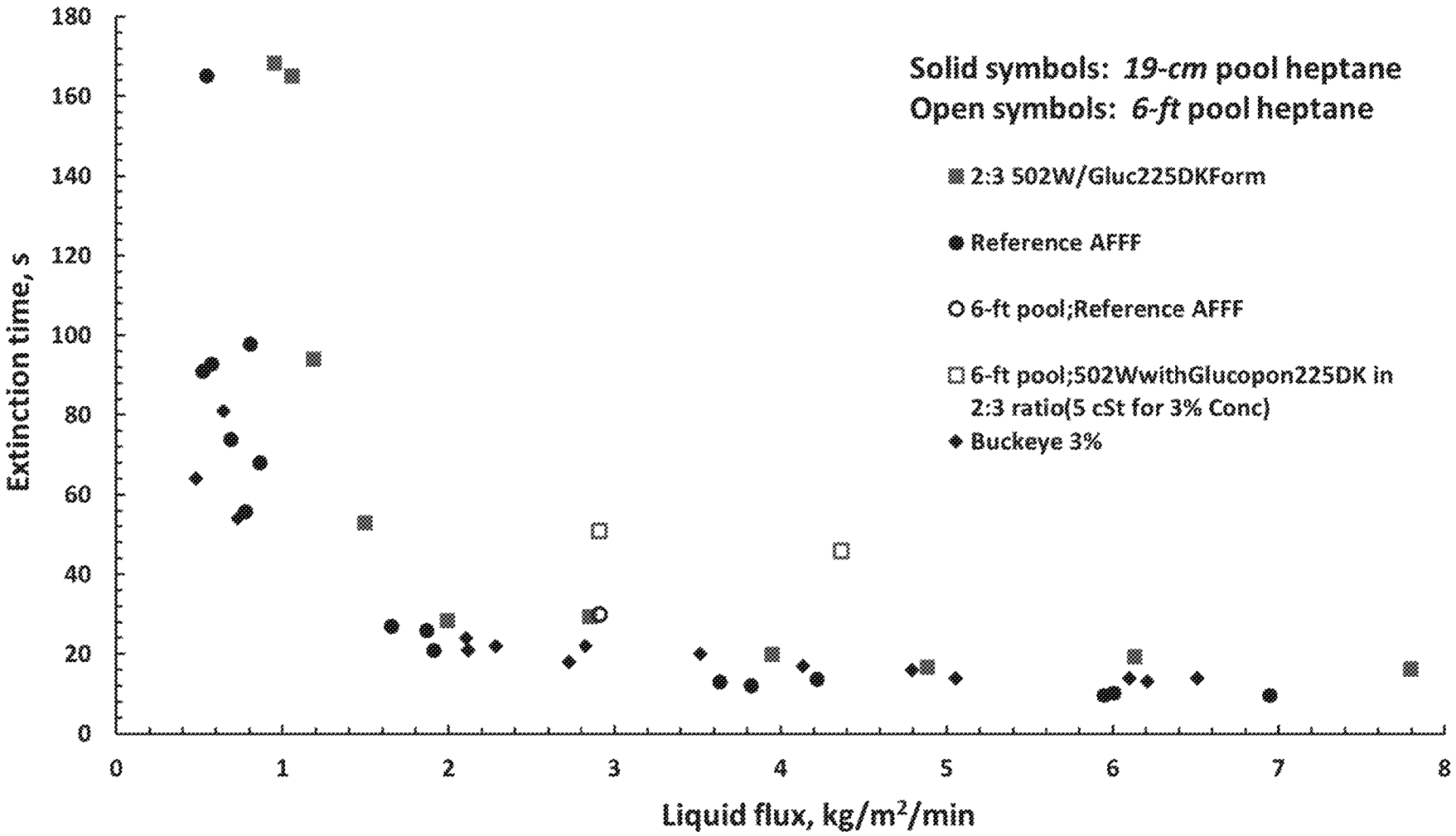
FIG. 19 shows bench-scale (19-cm dia.) and large scale (6-ft dia. MIL-F-24385F) extinction of heptane pool fire showing extinction times of Siloxane-Gluc225 surfactant formulation in Table 1 relative to the RefAFFF and commercial formulation (Buckeye 3%) at different liquid application rates, which are obtained by dividing the foam application rates with measured foam expansion ratios.

Both 90% and 100% extinction times decrease as the foam flow rate is increased as shown in Table 5. At a fixed foam flow rate of about 15 gallons per minute shown in row 3 and columns 3 and 4 of Table 5, the 90 and 100% extinction times for the Siloxane-Gluc225 are less than or equal to a factor of 1.5 times those for RefAFFF. However, at a fixed solution flow rate of 2 gallons per minute, the extinction times differ by as much as a factor of two as shown in columns 2 and 4. The factor 1.5 times is consistent with the bench-scale data as shown in FIGS. 18 and 19. One reason for the longer extinction time for Siloxane-Gluc225 is the larger foam degradation rate, as indicated by the smaller burnback time of 338 s for the siloxane formulation compared to 981 s for the RefAFFF as shown in columns 2 and 4. Foam is applied for a total of 90 s including extinction, therefore the expected burnback time for the siloxane formulation is 544 s, after correcting for the shorter foam application time following fire extinction and for the difference in the expansion ratios. The measured burnback time of 338 s for the siloxane-Gluc225 is significantly smaller than the expected 544 s indicating significantly greater foam degradation. The data in Table 5 show that the increased foam flow rate decreases the extinction time. The foam flow rate can be increased by increasing the foamability or the expansion ratio as well as by increasing the solution flow rate. The expansion ratio and liquid drainage time are smaller for the siloxane formulation than for the RefAFFF. However, increasing the expansion ratio can decrease foam spread rate on the pool and prolong fire extinction. Therefore, in addition to reducing the foam degradation, varying composition of the foam solution to optimize the expansion ratio may also significantly reduce the extinction time. Other properties, especially the viscosity of the concentrate, are within MilSpec criteria. This is important because many commercial fluorine free concentrates have viscosities well above the MilSpec criteria.

Figure 20:
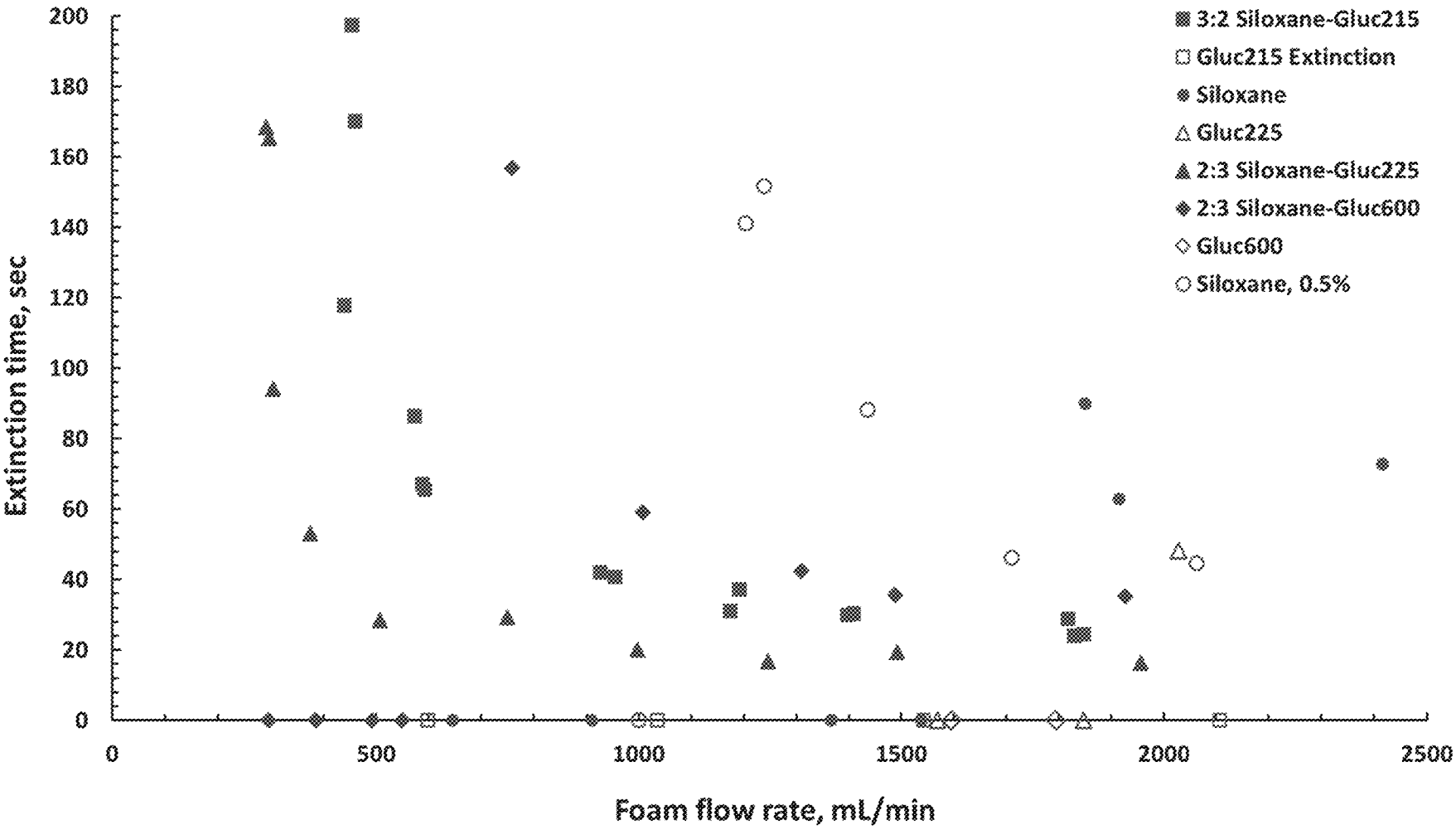
FIG. 20 shows bench-scale (19-cm dia.) extinction of heptane pool fire showing synergisms in extinction time of Siloxane-Gluc mixtures listed in Table 4 relative to the solutions of individual components, which also contain 0.5% DGBE. The data points shown along the x-axis represent no extinction data after 180 s of foam application.

The reason for relatively good fire suppression performance of the Siloxane-Gluc225 formulation is the synergism between the Siloxane and Glucoside surfactants indicated by the smallest foam flow rate at which the formulation can extinguish the fire in a given time (e.g., 180 seconds). FIG. 20 depicts the synergism where the surfactant mixture can extinguish the fire at a much smaller foam application rate than the individual surfactant solutions rather than an intermediate foam flow rate, which is expected following the law of averages. Data points along the x-axis represent no fire extinction. FIG. 20 shows the bench scale heptane pool fire extinction data for 3:2 Siloxane-Gluc215 formulation composition listed in Table 4 and for the three individual surfactant solutions (0.45% Glucopon 215 CS UP, 0.1% siloxane 502W, 0.5% siloxane 502W, 0.5% Glucopon 225 DK, 0.5% Glucopon 600 CS UP all with 0.5% DGBE in distilled water). Gluc215 could not extinguish the fire even at a very high foam flow rate (2100 mL/min or 74 L/m$^2$/min within 180 s) as shown by the data points (open squares) on the x-axis, which represent no extinction. Similarly, 502W siloxane surfactant solution also could not extinguish the fire below a high value of the foam flow rate (1550 mL/min or 54.7 L/m$^2$/min) as represented by the data points (solid circles) on the x-axis. But, when both the surfactants are combined in a 3:2 ratio the foam extinguished the fire at significantly smaller foam flow rate (in 197 s at 453 mL/min or 16 L/m$^2$/min) as indicated by the data (solid squares) for Siloxane-Gluc215 (composition 0.075% 502W, 0.05% Gluc215, and 0.5% DGBE) exhibiting synergism. Similar results are shown for Siloxane-Gluc225DK and Siloxane-Glucopon600UP mixtures.

FIG. 20 also shows the effect of varying Glucopon surfactant's head size and the number of OH functional groups on heptane pool fire extinction because of the synergistic effects. The head size is varied from x=0.4, 0.5, and 0.7 using commercially available Glucopon 600 CS UP, Glucopon 215 CS UP, and Glucopon 225 DK respectively while keeping the composition fixed (0.2% 502W, 0.3% Glucopon, and 0.5% DGBE). Gluc600 has slightly longer alkyl tail than Gluc215 and Gluc225. Increasing the hydrophilicity of the hydrocarbon surfactant increases the synergistic effect, and reduces the foam flow rate where the extinction time is 180 s in FIG. 20. The synergistic extinction between 502W and Glucopon surfactants is unique because for most other commercial surfactants that were examined, the extinction times fell between the extinction times of the individual surfactant following the law of averages. The synergism is responsible for the high extinction performance of the siloxane formulation.

Figure 21:
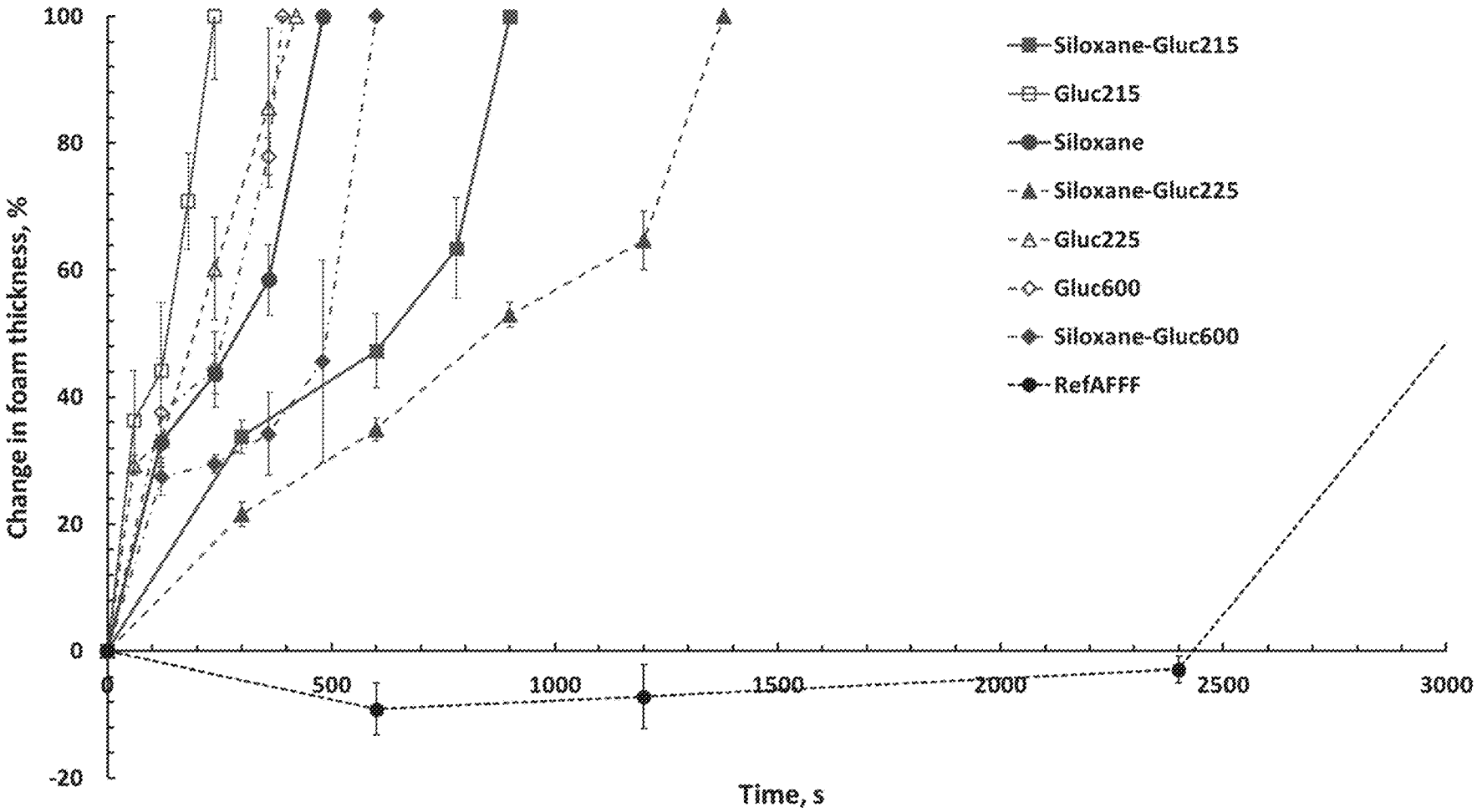
FIG. 21 shows synergisms in measured foam degradation rates for a 4-cm thick (initial thickness) foam layer covering heptane pool at 60° C. with time for the Siloxane-Gluc225, Siloxane-Gluc600, and Siloxane-Gluc215 listed in Table 4, and for the individual surfactant components (0.5% Gluc215, 0.5% Gluc225, 0.5% Gluc600, and 0.1% 502W. All four solutions contain 0.5% DGBE.). Error bars represent one standard deviation calculated between three trials.

The synergistic extinction between 502W siloxane and Glucopons relates to the synergistic foam degradation, which is shown in FIG. 21. Again, FIG. 21 shows that the surfactant mixture exhibits smaller foam degradation rate than the rates for the individual surfactants rather than an intermediate value, which is expected following the law of averages. FIG. 21 shows percent change in foam layer thickness (initial thickness of 4-cm) on top of a hot heptane pool with time due to fuel vapor induced degradation. The foams generated from 0.5% Glucopon 215 CS UP with 0.5% DGBE and 0.1% 502W with 0.5% DGBE degraded in 240 and 480 s respectively. The foam generated from Siloxane-Gluc215 (0.075% 502W, 0.05% Glucopon 215 CS UP, and 0.5% DGBE) degraded completely in a much longer time (900 s) compared to the degradation times of the individual surfactants. FIG. 21 also shows degradation data for the individual surfactant solutions of Gluc600 and Gluc225 and their mixtures with 502W. They also show synergistic effects like those described for Siloxane-Gluc215. Furthermore, as the glucoside head size of the Glucopon is increased, the degradation rate is reduced for the glucoside mixtures with the siloxane surfactant. The synergism is increased by increasing the hydrophilicity of Glucopon's head group as shown by the foam degradation for Siloxane-Gluc600, Siloxane-Gluc215, and Siloxane-Gluc225 formulations in FIG. 21. The number of OH functional groups increased from x=0.4, 0.5 to 0.7 by switching from Gluc600, Gluc215 to Gluc225; Gluc600 has slightly longer alkyl tail. The exact mechanisms for the increased foam stability are not well understood. However, it is possible that the increased hydrophilic interactions between the polyoxyethylene and glucoside head groups may have reduced the surfactant solubility in heptane resulting in increased foam stability over the individual surfactants. FIG. 21 shows that the foam generated from Siloxane-Gluc225 formulation degraded completely in 1380 s versus 900 s for the foam generated from Siloxane-Gluc215 (in a 3:2 ratio), and 500 s for Siloxane-Gluc600. Siloxane-Gluc225 has the smallest degradation rate but is still significantly higher than the RefAFFF as shown in FIG. 21. For comparison, commercial AFFF (Buckeye 3%) and RefAFFF degrade completely in time periods that are 1.7 (2400 s) and 2.6 times (3600 s) longer respectively than the time (1400 s) for Siloxane-Gluc225.

Figure 22:
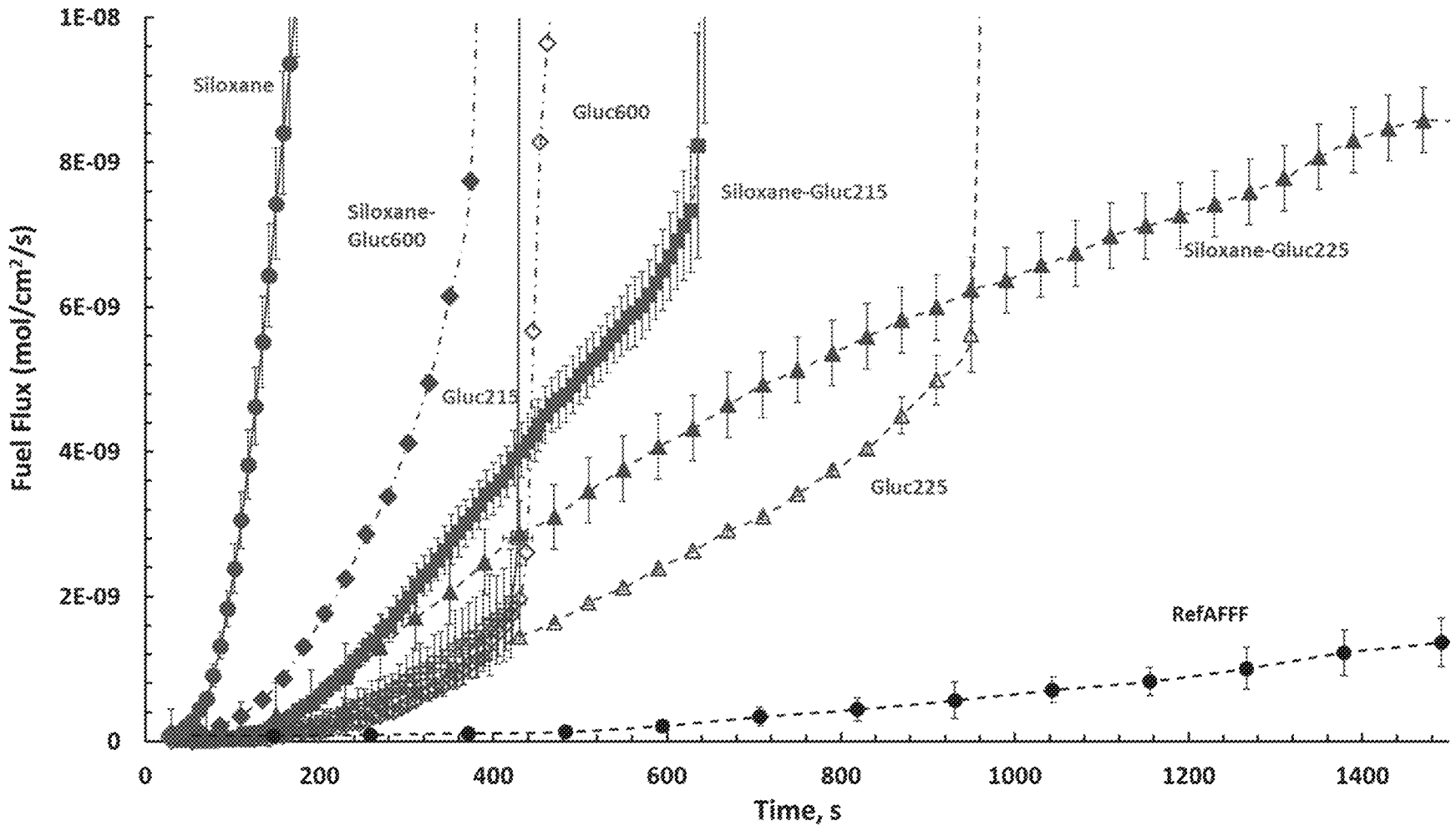
FIG. 22 shows measured heptane vapor permeation rates for a 4-cm thick (initial thickness) foam layer covering heptane pool at 60° C. with time for the Siloxane-Gluc225, Siloxane-Gluc600, and Siloxane-Gluc215 listed in Table 4, and for the individual surfactant components (0.5% Gluc215, 0.5% Gluc225, 0.5% Gluc600, and 0.1% 502W. All four solutions contain 0.5% DGBE. Error bars represent one standard deviation calculated between three trials.

FIG. 22 shows that the fuel permeation rate through foam follows roughly the law of averages and does not show the synergistic effects observed in foam degradation at small times for all three Siloxane-Gluc surfactant combinations. For example, below 450 s, the fuel flux for foam generated from Siloxane-Gluc215 lies between those for foams generated from the individual surfactants. However, the synergism exhibited in foam degradation in FIG. 21 prolongs the foam life time and suppresses the fuel flux shown in FIG. 22 at long times. At longer than 450 s, the surfactant mixture Siloxane-Gluc215 has a smaller fuel flux than the individual surfactants, which exhibit a steep rise in fuel flux because of differences in the foam degradation rate. Thus, the synergism in degradation leads to a dramatic reduction in fuel transport rate for the three surfactant mixtures compared to foams generated with individual surfactants because of the increased lifetimes of the foams for the mixtures. Even though the fuel flux is smaller for Gluc225 than for Siloxane-Gluc225 mixture at short times, Siloxane-Gluc225 lasts longer (1750 s) than Gluc225 (980 s) and the trend reverses. For comparison, commercial AFFF (Buckeye 3%) and RefAFFF have a heptane flux of 0.4 ($2.7\times10^{-9}$ mol/cm$^2$/s) and 0.1 ($7\times10^{-10}$ mol/cm$^2$s) times that of Siloxane-Gluc225 ($6.6\times10^{-9}$ mol/cm$^2$/s) respectively at 1000 s. The reduction in degradation and fuel transport rates decreases the fire extinction times for the mixtures over the individual surfactants shown in FIG. 20. The foams last longer in the fuel transport apparatus because it is closed and the water vapor is contained unlike in the open degradation apparatus. This is especially true for Gluc225 which lasts greater than 980 s in the transport apparatus but less than 400 s in the degradation apparatus. But FIG. 22 shows a steep rise in fuel flux to $1\times10^{-8}$ mol/cm$^2$/s in less than 200 s for the Siloxane foam. It takes much longer than 200 s for the foam to degrade completely and for the fuel flux to reach that of bare heptane's fuel flux (not shown in FIG. 22). The reason the Siloxane foam's fuel transport curve rises rapidly in FIG. 22 is that the heptane vapors travel through the foam very quickly and not because of a significant reduction in foam layer thickness. Thus, the Siloxane foam seems to have significantly higher fuel transport than Gluc225 foam and the Gluc225 foam has only a slightly higher degradation rate than the Siloxane foam. However, the combination of Siloxane with Gluc225 suppresses the foam degradation dramatically and as a result the fuel transport is also suppressed at long times. The fuel transport rate depends on the fuel concentration in surfactant solution, which may depend on the micelle size and number density because most of the fuel is expected to reside inside the micelles. Micelle size can affect the diffusion rate. The exact mechanisms of fuel and micelle transport in the presence of a surfactant remain unclear.

Figure 23:
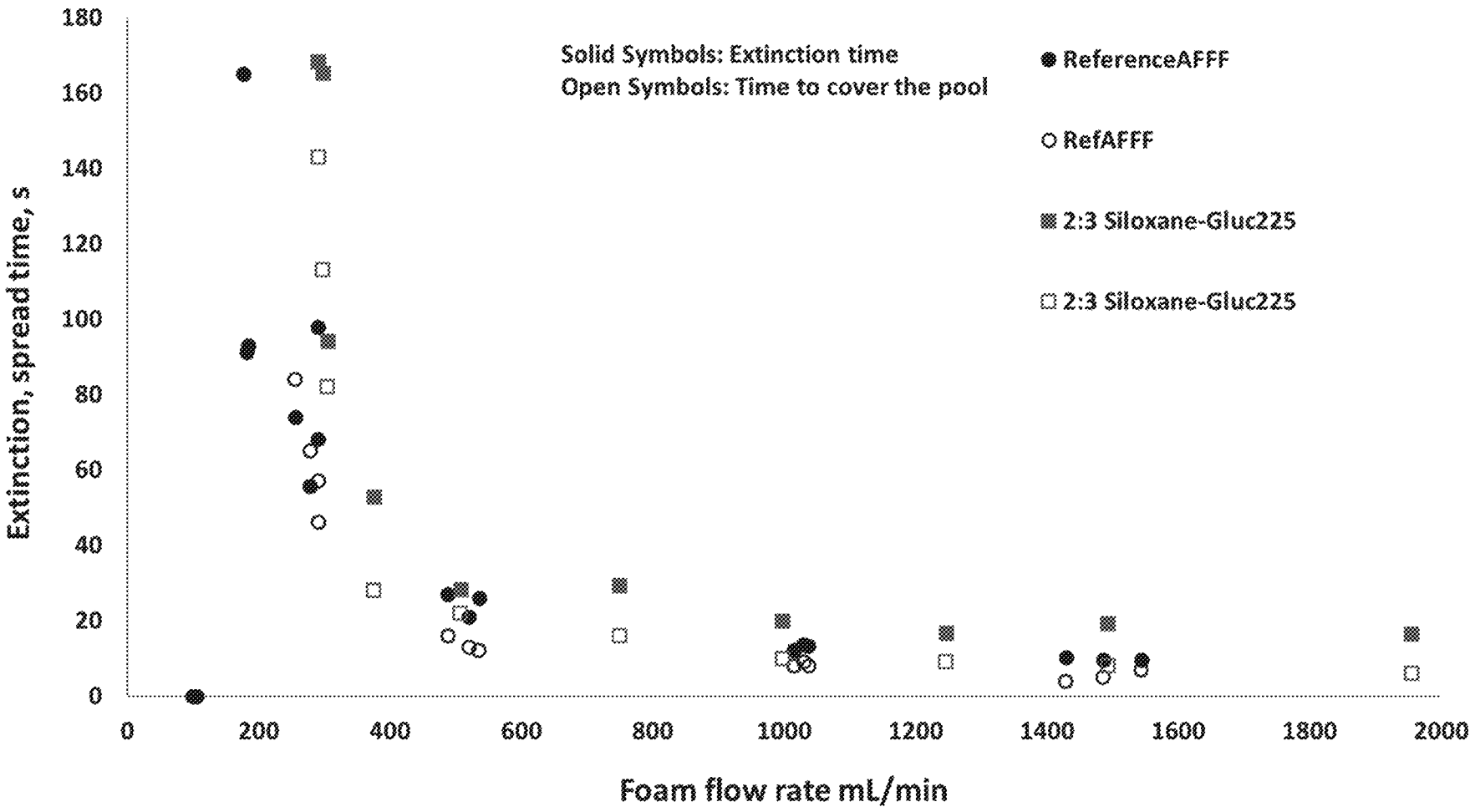
FIG. 23 shows a comparison of foam spread time to fully cover the pool surface during the heptane pool fire suppression with the fire extinction time at different foam application rates for the 19-cm dia. bench-scale heptane pool. Foam is delivered at the center of the pool at a constant flow rate and allowed to spread. Spread times (open symbols) and extinction times (closed symbols) are shown for Siloxane-Gluc225 and RefAFFF listed in Table 4. Data points on x-axis (y=0) show flow rates where fire was not extinguished in 180 s.

If a foam spreads too slowly, it can increase the extinction time because complete coverage of the pool surface is necessary, but not sufficient, to extinguishing a fire. FIG. 23 shows the time to cover a burning heptane pool with foam, which is delivered at the center of the bench-scale pool at a constant flow rate for the Siloxane-Gluc225 and the RefAFFF formulations listed in Table 4. As the foam flow decreases the foam spread time increases as expected. Also shown are the fire extinction times for comparison. The foam spread times are about half the extinction times at high foam flow rates for both the formulations. As the foam flow rate is decreased, the foam spread times become greater than half, but still remain smaller than the fire extinction times. This is likely because foam degrades significantly due to longer exposure to the hot pool and fire. In addition to foam degradation, foam spread also depends on the rheological properties and the expansion ratio, which increases as the foam flow rate decreases in our foam generation apparatus as discussed later in the paper.

Table 6 shows the surface and interfacial tension values for the individual components and mixtures of the Siloxane formulation and the RefAFFF formulation listed in Table 4. The surface tension and interfacial tension values for the Siloxane-Gluc225DK are close to those of the 502W component and the Gluc225DK component respectively. It may support indirectly that 502W may adsorb preferentially on air-water interface while Gluc225DK may adsorb on the heptane-water interface similar to that suggested for fluorocarbon and hydrocarbon surfactants in the literature (Kissa, "Fluorinated surfactants and repellants", *Surfactant Science Series,* 97, New York, Marcel Dekker Inc. (2001)). The surface tension and interfacial tension measurements do not exhibit synergistic effects for the Siloxane-Gluc225DK formulation because the mixture values fall in between those for the two components. Therefore, the surface and interfacial tensions and spreading coefficient values do not explain the synergistic effects shown in fire extinction time data for Siloxane-Gluc225DK in FIGS. 20-22. Even though, the spreading coefficient values listed in Table 6 show that only RefAFFF but not Siloxane-Gluc225DK can form an aqueous film on heptane pool surface, the spreading coefficient does not consistently explain fire extinction performance differences among the individual components and mixtures unlike fuel transport and foam degradation measurements shown in FIGS. 20-22. Even for AFFF, differences in spreading coefficient did not explain differences in fuel transport through a foam layer covering a pool when different fuels were used (Hinnant et al. "Measuring Fuel Transport through Fluorocarbon and Fluorine-free Firefighting Foams", *Fire Safety Journal,* 91, 653-661 (2017)).

TABLE 6

Surface tensions and interfacial tensions for surfactant formulations and individual components with 0.5% DGBE at 20° C. Interfacial tensions and spreading coefficients were measured with heptane (surface tension, 20 mN/m). They are different from those in Table 4 measured with cyclohexane.

| Formulation | Surface Tension | Interfacial Tension | Spreading coefficient |
|---|---|---|---|
| 0.1% 502W<br>0.5% DGBE | 21.1 | 5.6 | −6.7 |
| 0.5% Gluc225DK<br>0.5% DGBE | 28.1 | 2.9 | −11.0 |
| Siloxane-Gluc225 | 22.4 | 2.9 | −5.3 |
| Ref AFFF | 16.7 | 1.9 | 1.4 |

Figure 24:
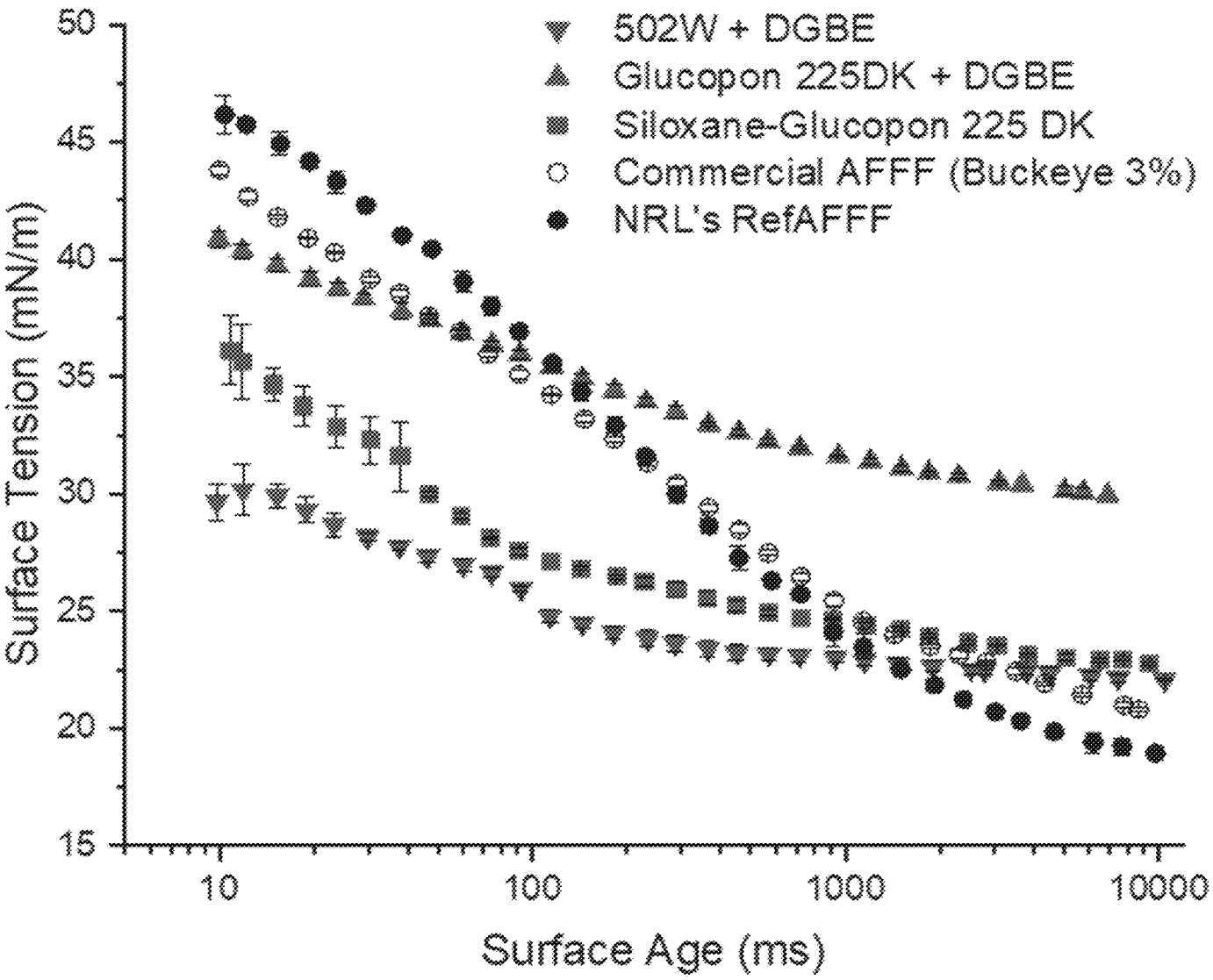
FIG. 24 shows dynamic surface tension versus bubble's age for the Siloxane-Gluc225 and RefAFFF formulations listed in Table 4 at 25° C., and a commercial AFFF (Buckeye 3%) formulation. Also shown are the surface tensions of individual surfactants (0.5% 502W with 0.5% DGBE and 0.5% Glucopon 225 DK with 0.5% DGBE solutions) for comparison with the surfactant mixture and show lack of synergisms.

Ability to achieve a low value of the surface tension quickly is traditionally been considered a requirement for effective fire suppression. The dynamic and equilibrium surface tensions of the siloxane formulation were compared with AFFF and with individual surfactant components and no synergistic effects were found. Dynamic surface tension can play a role in foam generation and affect foam properties. During foam generation, surfactant should be able to diffuse from the solution quickly and adsorb on freshly created bubble surfaces. As more surfactant is adsorbed, the surface tension decreases with time and reaches a steady state when the bubble surfaces are saturated. FIG. 24 shows that the surface tension of Siloxane-Gluc225 reaches steady state value within a few seconds like AFFFs. But, the initial decrease in surface tension is much quicker for the fluorine-free formulation than for the fluorinated formulations (AFFFs) at short time scales (<1 ms). The siloxane formulation is able to adsorb and decrease the surface tension of a freshly created bubble surface quicker than AFFFs. This is an important property for the large scale foam generation where the bubbles are generated at a high frequency. However, due to the lack of a fluorocarbon surfactant, the steady state value of the surface tension is higher for the Siloxane-Gluc225 formulation than for the AFFFs. Furthermore, the individual surfactants have a surface tension-time profile similar to the mixture and no synergism in reducing the surface tension of water is exhibited unlike the observations reported for AFFFs. It was reported that the fluorocarbon and hydrocarbon surfactants exhibited a synergism where the dynamic surface tension of the mixture decreased quicker than the individual surfactants (Dlugogorski et al., "Dynamic Surface and Interfacial Tensions of AFFF and Fluorine-free Class B Foam Solutions", Fire Safety Science-Proceedings of Eighth International Symposium, International Association for Fire Safety Science, 719-730 (2005)). Despite the Siloxane-Gluc225 formulation's ability to achieve steady state surface tension quicker than the fluorinated formulation (RefAFFF), the fire extinction times for the fluorine-free foams are consistently higher than for the RefAFFF. Therefore, the differences in dynamic surface tension are not responsible for the observed differences in fire extinction, fuel transport, and foam degradation shown in FIGS. 20-22.

Figure 25:
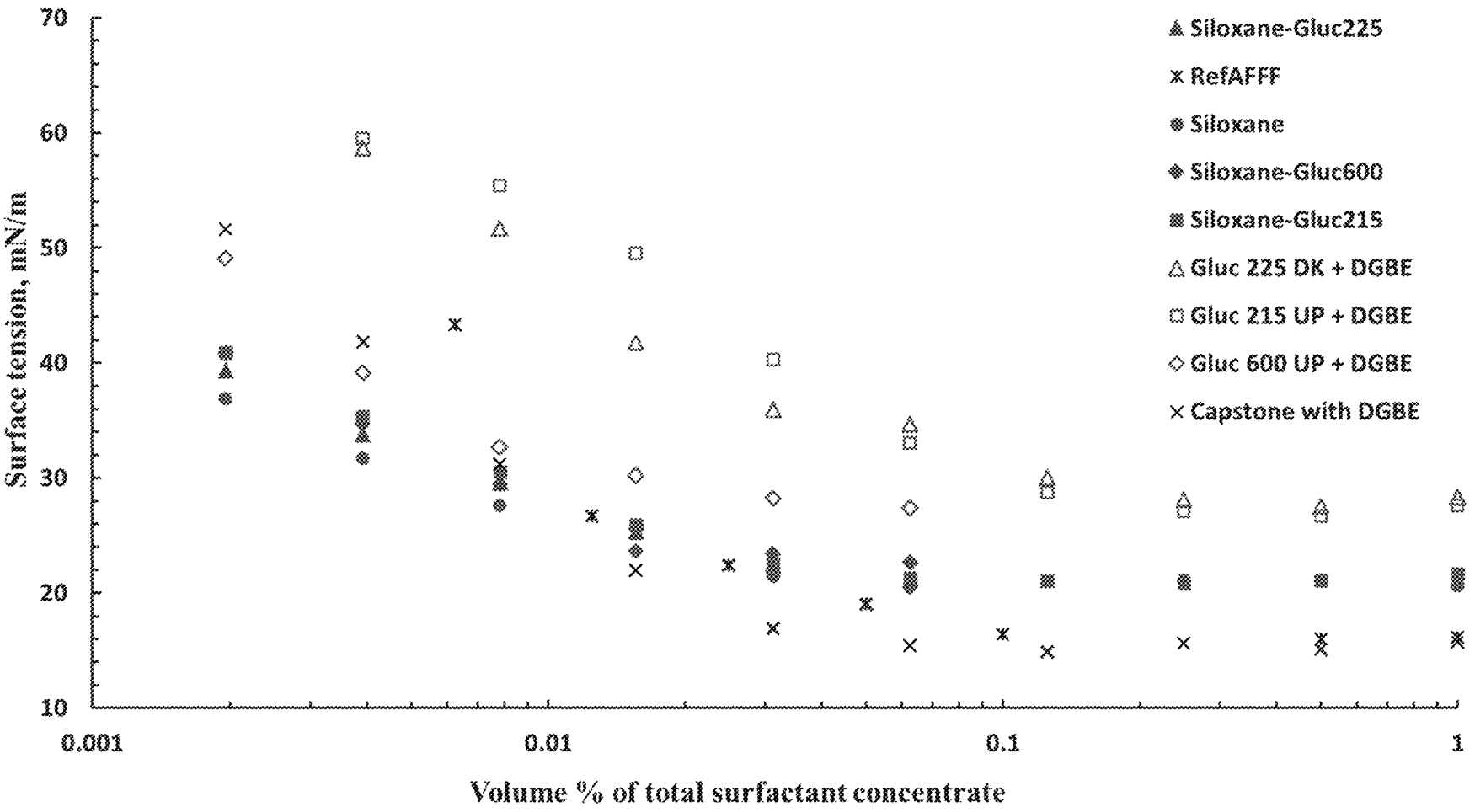
FIG. 25 shows static surface tension at different volume % of the total surfactant concentrate (sum of 502W and Gulcopon 225 DK or 215 CS UP or 600 CS UP concentrates or sum of Capstone™ 1157 and Glucopon 215 CS UP concentrates supplied by the manufacturers, see Table 4) to determine CMC at 20° C.

FIG. 25 shows the static or steady state surface tension at different concentrations of the total surfactant, which is the sum of 502W and Glucopon concentrates or the sum of Capstone™ 1157 and Glucopon 215 CS UP concentrates supplied by the manufacturers. Below the CMC, as the concentration of surfactant in solution is increased, the concentration adsorbed onto the air-solution interface increases, and the surface tension decreases as shown in FIG. 25. Above the CMC, the interface is saturated with adsorbed surfactant and the steady-state surface tension value depends on the formulation. In FIG. 25, the CMC value is determined as the concentration where the surface tension becomes independent of the total surfactant concentration. The concentrations of the total surfactants listed in Table 4 are eight times greater than CMC value of 0.06% for the Siloxane-Gluc225, two times greater than the CMC value of 0.06% for Siloxane-Gluc215, and five time greater than the CMC value of 0.1% for RefAFFF. For comparison, individual surfactant solutions of Gluc225, Gluc215, Gluc600, 502W, and Cap1157 containing equal amount DGBE solvent have CMC values of 0.1, 0.1, 0.06, 0.06, and 0.06% of the surfactant respectively. The CMC values for the Siloxane-Gluc mixtures are closer to the Siloxane surfactant's CMC. The CMC value for the RefAFFF is closer to Gluc215. FIG. 25 shows that the surface tension-concentration profiles and the CMC values are very similar between the fluorine-free and fluorinated formulations.

Figure 26:
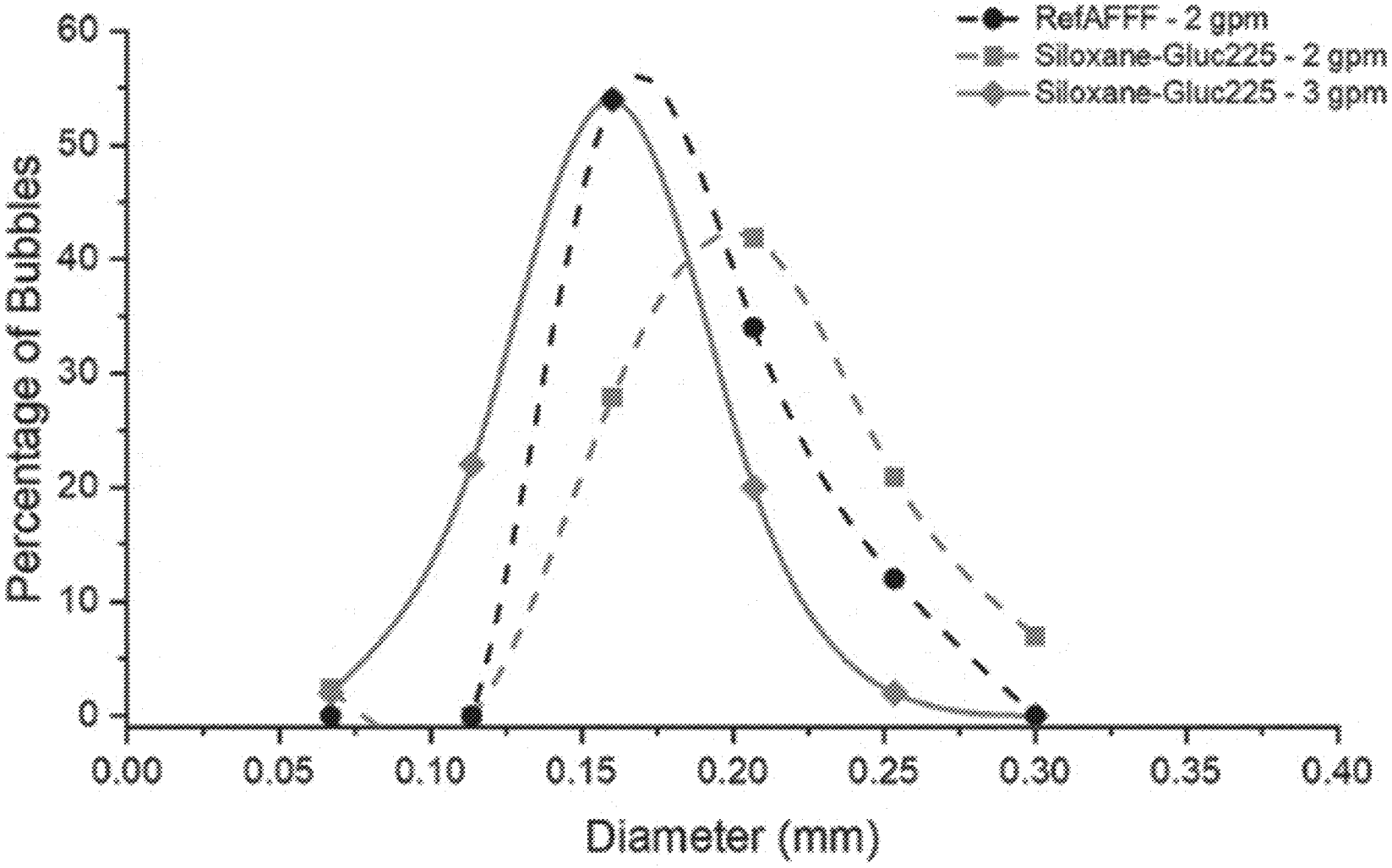
FIG. 26 shows initial bubble size distribution for RefAFFF and Siloxane-Gluc225 formulations listed in Table 4, 2 minutes after large-scale foam generation at 2 and 3 gpm foam solution flow rates through an air-aspirated MIL-F-24385 nozzle.
Figure 27:
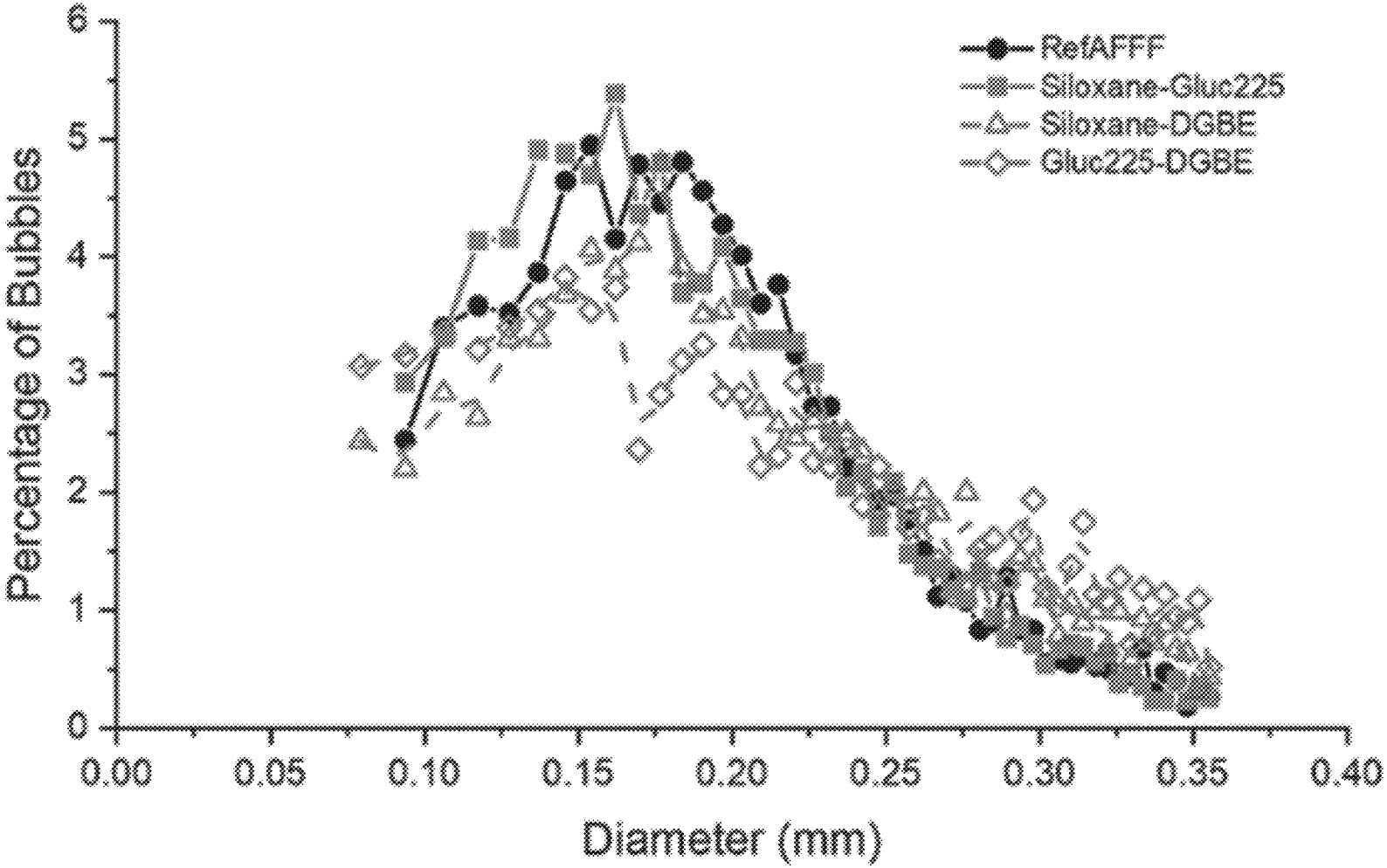
FIG. 27 shows initial bubble size distribution for RefAFFF and Siloxane-Gluc225 formulations listed in Table 4, 30 seconds after bench-scale foam generation with a sparger at 1000 mL/min foam flow rate and fed into the DFA cylinder.

Ability of a foam to extinguish a fire may depend on foam's bubble structure and foam properties. So initial bubble size distributions, liquid drainage profiles, and initial expansion ratio of Siloxane foam were compared with those of AFFF. As soon as foam is generated, the liquid begins to drain from the foam, the bubbles begin to coarsen, and average bubble size increases. The initial bubble size distribution depends on the composition of the surfactant formulation for a given generation method. FIGS. 26 and 27 show the "initial" bubble size distributions for foams generated using different methods at large and bench scales respectively. FIG. 26 shows the distributions for Siloxane-Gluc225 generated at 2 and 3 gpm solution flow rates through an air-aspirated nozzle, and for RefAFFF generated at 2 gpm within 2 minutes after foam (30.5-cm high foam column) is collected into a rectangular glass cylinder (4.2 cm×4.2 cm×30.5 cm). The measurements are made by taking pictures with a digital camera placed at 13-cm below the surface of the foam column. As the solution flow rate is increased from 2 to 3 gpm, the bubble distribution for the Siloxane-Gluc225 formulation seem to approach that of the RefAFFF. This may be because the RefAFFF and Siloxane-Gluc225 generated at 2 gpm and 3 gpm respectively have the same foam flow rate of 15 gpm (see Table 5). The average (arithmetic mean) bubble size decreases from 220 μm to 170 μm as the solution flow is increased from 2 to 3 gpm and approaches 140 μm for the RefAFFF. About 50 to 100 bubbles are divided into six bins to create each distribution curve shown in FIG. 26. FIG. 27 shows that the bubble size distributions for the air sparged foams of Siloxane-Gluc225 are close to those for the RefAFFF at bench-scale within 30 seconds after the foam (25-cm high, 4 cm diameter foam column) is collected into a glass cylinder of the DFA analyzer. The measurements and analysis are made by the DFA's camera and the associated software at 13-cm below the top surface of the foam column. About 3900 to 4900 bubbles are divided into 50 bins to create each distribution curve in FIG. 27. The percentage of bubbles shown on the y-axis are smaller compared to those in FIG. 26 because six to eight times more bins are used to create the distributions. FIG. 27 shows that the bench-scale generated bubble sizes are similar to those generated at the large scale and the distributions depend on the surfactant solution application rate. The RefAFFF and Siloxane-Gluc225 foams have similar bubble size distributions at a fixed foam application rate but show significant differences in fire extinction. FIG. 27 also shows bubble size distributions for the individual surfactants and there may be slightly less number of smaller bubbles compared to the surfactant mixtures, but the differences in average bubble diameters are not significant at 30 seconds after foams are generated.

Figure 28:
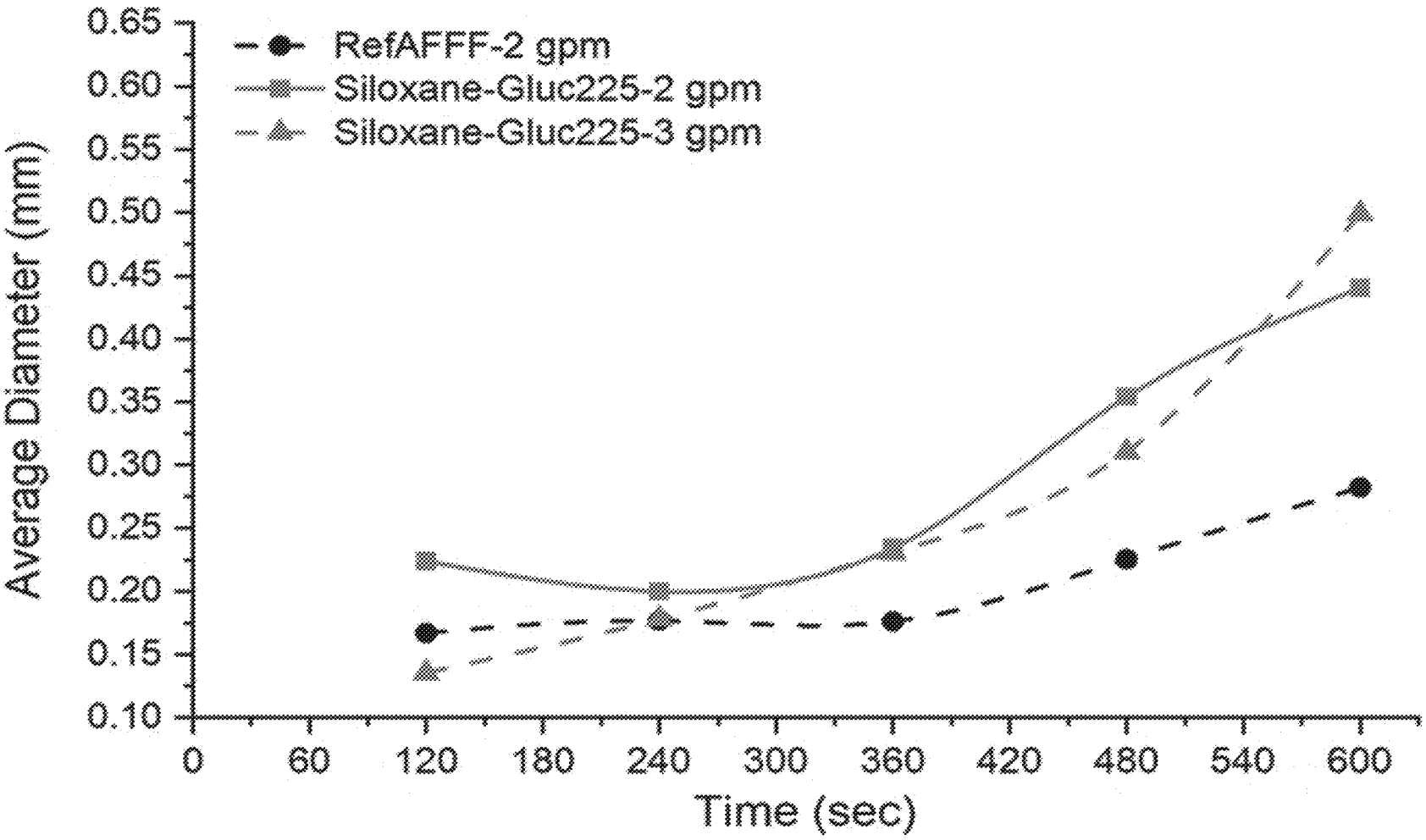
FIG. 28 shows bubble coarsening as indicated by the average bubble sizes calculated from bubble size distributions measured at different times after foam generation for RefAFFF and surfactants listed in Table 4 for large scale foams generated using air-aspirated MIL-F-24385 nozzle.
Figure 29:
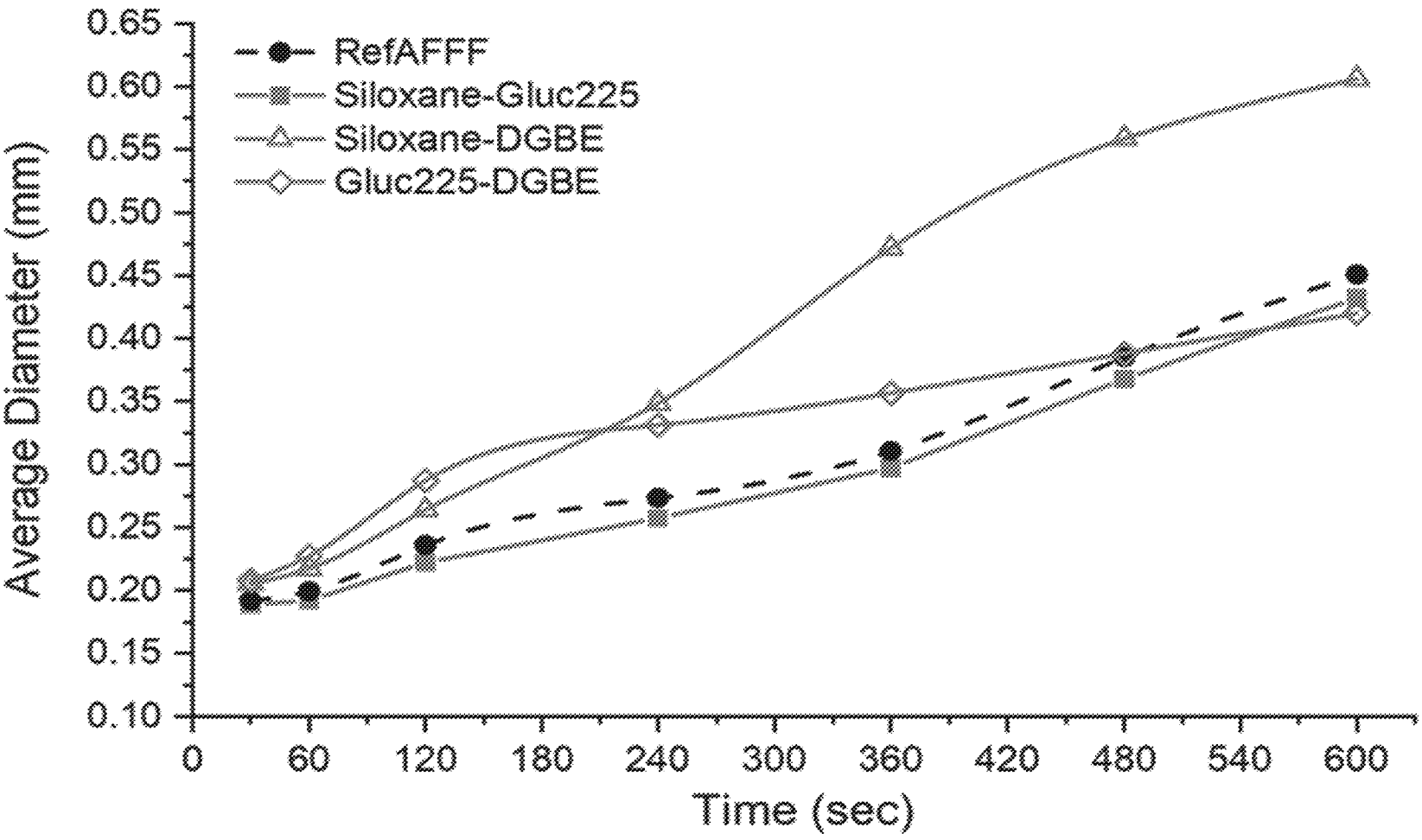
FIG. 29 shows bubble coarsening as indicated by the average bubble sizes calculated from bubble size distributions measured at different times after foam generation for RefAFFF and surfactants listed in Table 4 for bench-scale foams generated using a sparger at 1000 mL/min foam flow rate.

FIGS. 28 and 29 show increase in average bubble size with time due to coarsening that occurs when air from small bubbles diffuses to the large bubbles driven by the differences in air solubility (Oswald-Ripening). The differences in air solubility in the surfactant solution are caused by the differences in bubble curvature. FIG. 28 shows that coarsening occurs more slowly in the RefAFFF than in the siloxane formulation after the first few minutes at the large scale. It is unclear to what extent the differences in coarsening between the fluorinated and fluorine-free foams shown in FIG. 28 affect their fire extinction behavior that occurs at time scale of 30 seconds. FIG. 29 shows the coarsening behavior in fluorinated and fluorine-free foams generated at the bench scales are almost the same unlike at the large-scale shown in FIG. 28. Despite the similar coarsening behavior, there are significant differences in fire extinction times between the fluorinated and fluorine-free foams at bench-scale. FIG. 29 also shows the bubble coarsening for the individual surfactants. Within the time scale of extinction (<180 seconds), the differences in average bubble sizes between the individual and mixtures of surfactants is less than 50%. The slight degree of synergistic effects on average bubble sizes appear to be not significant enough to explain the large synergistic effects on foam stability and fire extinction shown in FIGS. 20-22.

Figure 30:
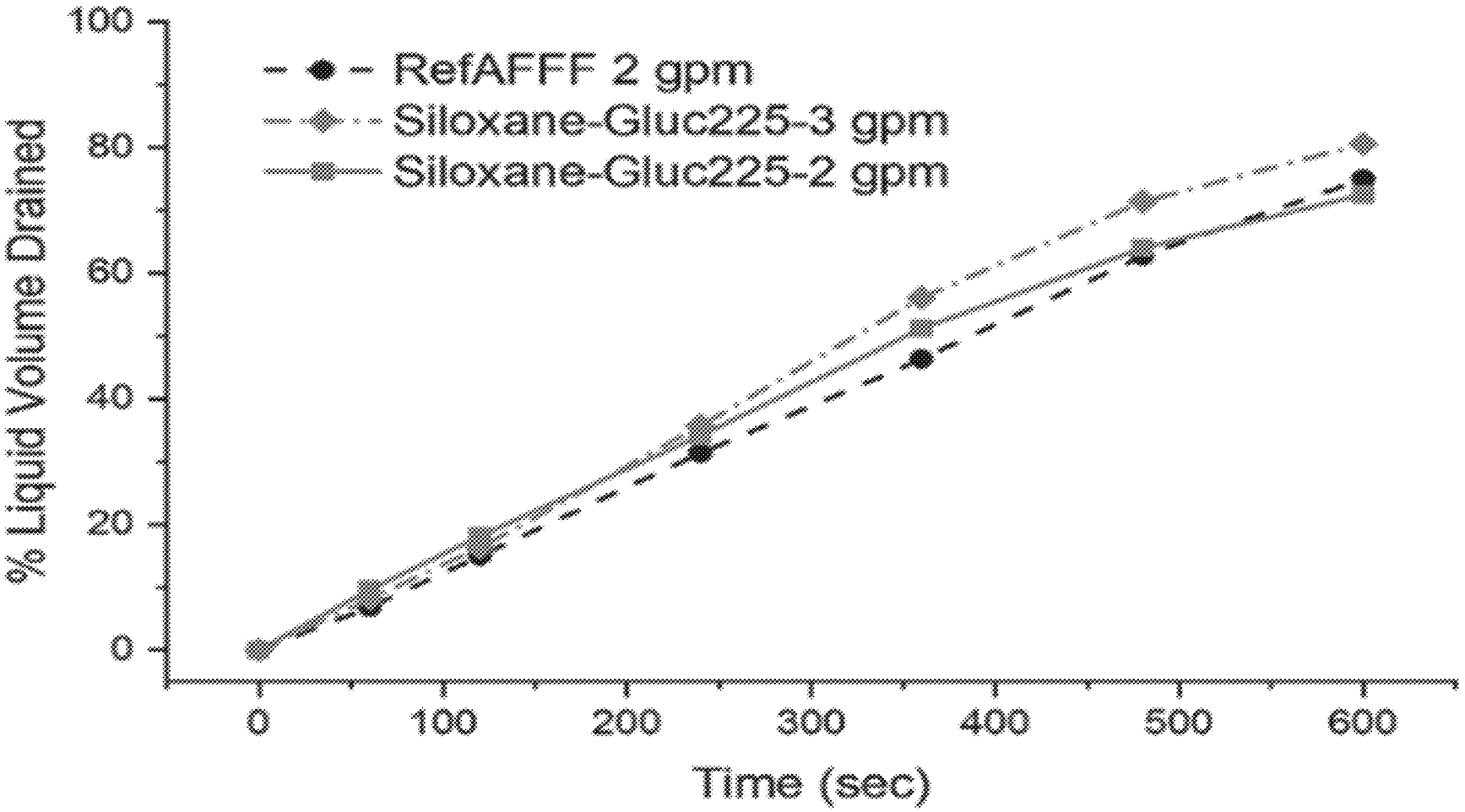
FIG. 30 shows amount of liquid drained from the bottom of a foam column with time for RefAFFF and Siloxane-Gluc225 formulations listed in Table 4 for large-scale foam generation using air-aspirated MIL-F-24385 nozzle.
Figure 31:
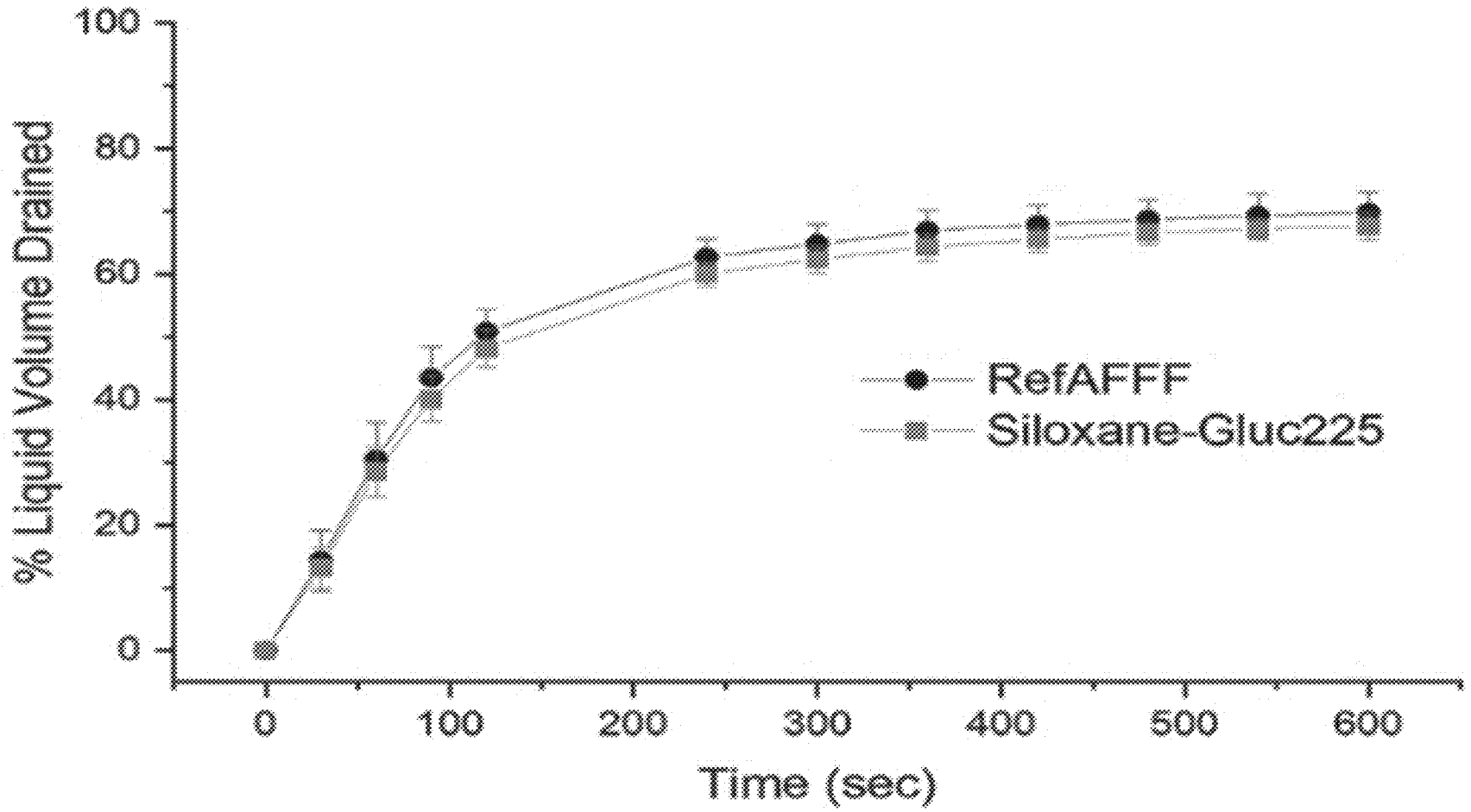
FIG. 31 shows amount of liquid drained from the bottom of a foam column with time for RefAFFF and Siloxane-Gluc225 formulations listed in Table 4 for bench-scale foam generation by using a sparger at 1000 mL/min foam flow rate.

Liquid drainage is a characteristic of the foam that depends on foam generation method and the associated bubble size distributions. The liquid drains because of competition between gravity and capillary forces that depend on the bubble size distributions in the foam. FIGS. 30 and 31 show the rate of liquid drainage from foams generated from Siloxane-Gluc225 and RefAFFF formulations at large and bench scales. At large scale and bench-scales, the liquid drainage profiles were measured by collecting the foams in to graduated cylinder (5 cm diameter and 28 cm height) and into the DFA cylinder (4 cm diameter and 25 cm height) respectively. The initial expansion ratio measured immediately after foam generation increases as the liquid drains out of the foam and can be calculated using the curves in FIGS. 30 and 31. The drainage rate is significantly faster in the air sparged foams at bench scale than in the air aspirated nozzle foams at large scale. However, the drainage rates are similar for fluorinated and fluorine-free formulations at bench-scale and large scale. A similar drainage characteristic does not seem to imply similar fire extinction times because the two formulations have different extinction times as shown in FIGS. 18 and 19.

Figure 32:
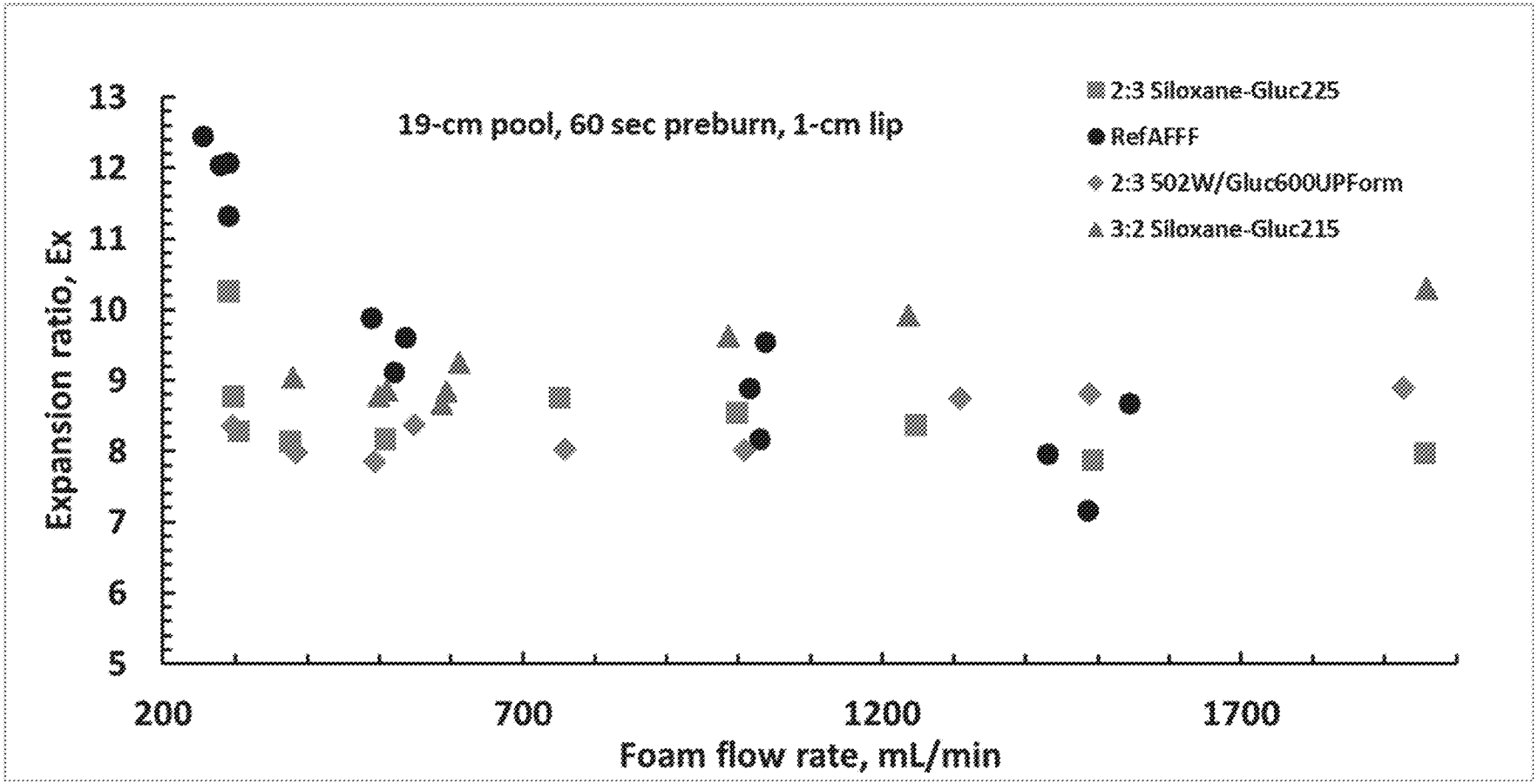
FIG. 32 shows expansion ratio versus foam flow rate for RefAFFF, Siloxane-Gluc225, Siloxane-Gluc215, and Siloxane-Gluc600 formulations listed in Table 4 for the bench scale extinction apparatus sparger generation method at 1000 mL/min foam flow rate.

The initial expansion ratio of the foam delivered onto the fuel pool can also depend on foam flow rate and generation method. The initial expansion ratios measured at two flow rates are shown in Table 5 for the large scale MilSpec aspirated nozzle. The aspirated nozzle generates wetter foams than the sparging method used in the bench-scale experiments for the siloxane and RefAFFF formulations. The initial expansion ratios of the foams generated at the bench-scale using the sparging method are shown in FIG. 32. The trends are very similar among different formulations studied in the bench-scale experiments. In the sparging method, foam collects on top of the solution above the sparger disk. At high flow rates, the residence time of the foam collected in the cup is small and liquid drainage during that time is negligible. As the flow rate is decreased, the foam residence time increases and liquid drainage increases. The expansion ratio increases with decreasing flow rate as shown in FIG. 32. At 1000 mL/min used for foam characterization shown in FIG. 26-31, the expansion ratios vary slightly between 7.8 to 9.5 for the fluorinated and fluorine-free formulations. The small differences in expansion ratio do not explain the differences in foam stability and fire extinction seen in FIGS. 20-22.

The siloxane formulations using fluorine-free surfactants can be used to generate foams with fuel vapor resistance property and fire suppression activity that exceeds that of leading commercial fluorine-free formulations and approach the fire extinction performance level of fluorocarbon surfactant containing AFFF formulations having Mil Spec qualification. The fluorine-free feature is critical for environmental regulation compliance. It also enables the selection of already commercialized siloxane and glucoside surfactants to produce a formulation with a fire suppression capability approaching that required by Mil Spec and currently only fulfilled by fluorocarbon surfactant containing AFFF formulations. A methodology was developed where the fuel resistance property measurements were used as metrics to quantitatively rank numerous commercial formulations that enable identification of superior performing fluorine-free surfactant relative to AFFF. By carefully choosing a systematic variation in the chemical structures of the surfactants, this methodology is capable of providing structure-property relationships quantitatively.

Fluorocarbon surfactants differ significantly from the flurine-free surfactants in their hydrophobic and oleophobic interactions with water and fuel leading to superior foam properties and fire performance. However, combining two fluorine-free surfactant structures in a mixture can exhibit synergistic effects leading to superior performance over the individual components. A commercial Siloxane surfactant with a polyoxyethylene head group when combined with a certain commercial alkane surfactant with polyglucoside head group exhibited quicker fire extinction of a heptane pool fire than the individual components. This was due to synergistic reduction in foam degradation rate (caused by the heptane vapors generated by the hot fuel pool) for the mixed surfactant formulation over the individual surfactants. Whether the large siloxane tail and slender polyoxyethylene head of the siloxane surfactant and the inverse for the alkylglucoside sufactant enables bilayer formation is unclear. The molecular interactions between the two surfactants' hydrophilic head groups (poly oxyethylene and poly glucoside) and precise mechanisms of the synergism are unclear. However, increasing the number of —OH functional groups by increasing the size of the polyglucoside head, reduced the foam degradation and the fire extinction time further. Indeed, small differences in the size (x=0.4, 0.5, and 0.7) of polyglucoside head had a significant effect on foam stability. It is possible that the stronger interaction between the two head groups may have suppressed the surfactant solubility in heptane resulting in increased foam stability near the foam-fuel interface. Previously, it has been shown that the fuel destabilizes the foam near the foam-fuel interface causing coalescence of bubbles in a cascading effect leading to rapid degradation (Hinnant et al., "Influence of Fuel on Foam Degradation for Fluorinated and wo Fluorine-free Foams", *Colloids and Surfaces A,* 522, 1-17 (2017)). Similarly, the micelle size and number density can affect the fuel concentration and diffusivity, which may affect the fuel transport. The mechanisms of transport for the individual versus combined surfactants are also unclear. The synergism between siloxane and glucoside structures resulted in a factor of 5 enhancement in foam stability and fire extinction performance demonstrating the key role played by the interactions between the surfactant structures in extinction. Developing understanding of molecular interactions between the fluorine-free surfactants at an interface and in micelles, and an approach based on synthesizing synergistic molecules can result in performance matching that of fluorocarbon surfactants.

The fire extinction time for the siloxane surfactant formulation to be less than 1.5 times that of an equivalent AFFF formulation containing a fluorocarbon surfactant for both the bench (19-cm diameter) and 6-ft diameter heptane pool-fires at a fixed foam application rate (22 $L/m^2/min$). Previous works (U.S. Pat. Nos. 9,446,272 and 9,687,686) relied on aqueous film formation and less volatile fuel (diesel) rather than the foam dynamics and synergistic effects to enhance fire suppression on a volatile fuel (heptane). Furthermore, the viscosity of the siloxane-formulation concentrate is within the MilSpec criteria unlike many commercial fluorine-free firefighting-foam concentrates (Solberg Inc., https://www.solbergfoam.com; Angus Inc., http://angusfire.co.uk/products, Fomtec Inc., https://www.fomtec.com, Chemguard Inc).

The difference in fire extinction between the Siloxane-Glucoside and RefAFFF formulations was due to differences in foam degradation and fuel vapor transport rates rather than the differences in surface tension (dynamic and static) or aqueous film formation, bubble size distributions and coarsening, foam spread rates, and liquid drainage rates for the foam application rates studied. Synergistic effects in foam properties are unclear and single lamella studies are needed to directly relate surfactant effects to a bubble lamella stability. Solution and foam properties cannot be ignored because they may become the controlling factors for fire extinction depending on the specific surfactant system under consideration and the foam generation methods used.

Figure 33:
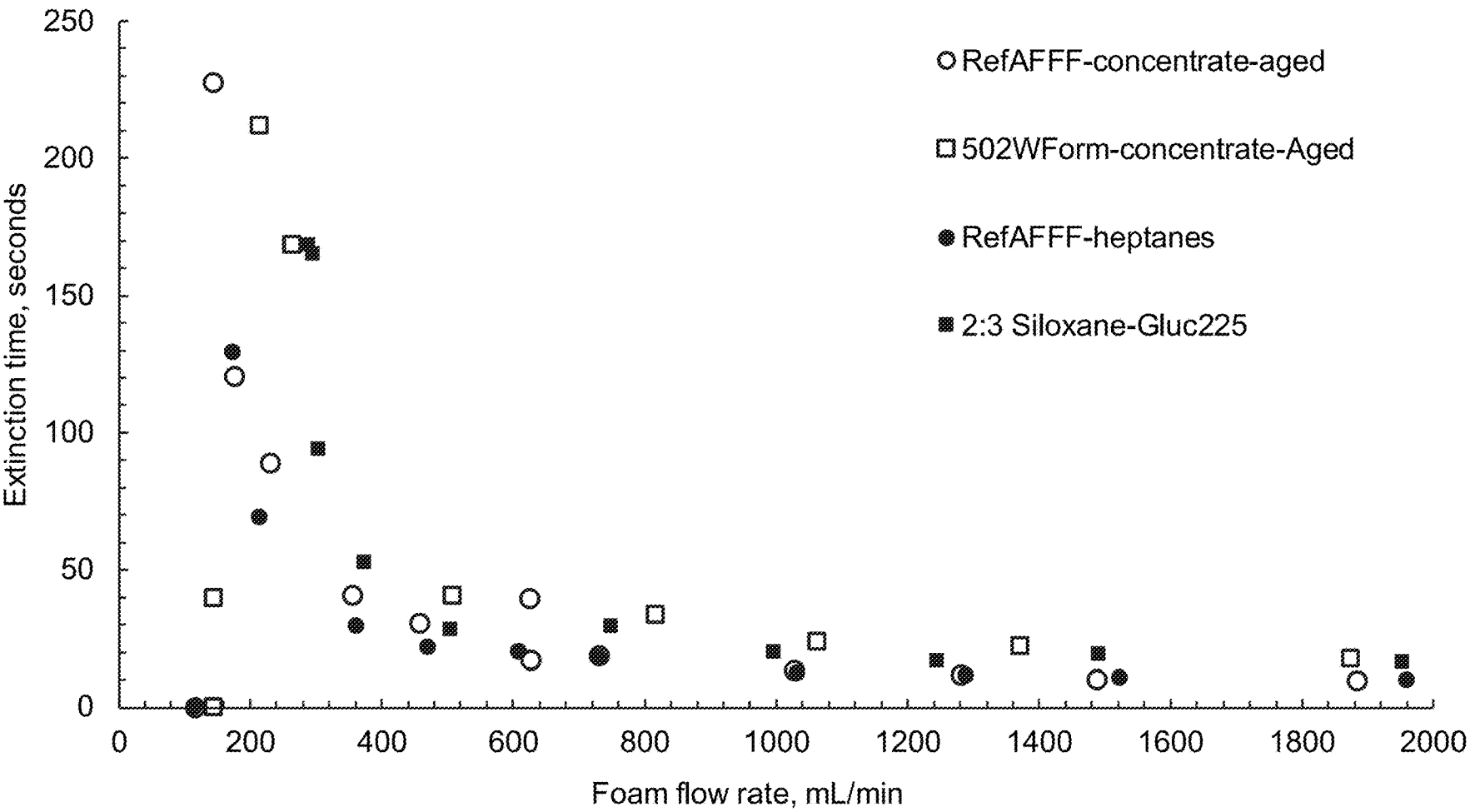
FIG. 33 shows a thermal stability test of 3% siloxane concentrate prepared with 6.66% 502W, 10% Glucopon225DK, 16.66% DGBE in distilled water and aging the concentrate at 65° C. for 10 days in an oven as per MIL-F-24385F. 19-cm heptane pool fire extinction was conducted before (solid square) and after aging (open square) to show no loss in fire extinction performance.

Siloxanes are known to undergo hydrolysis in water during long term storage. FIG. 33 shows an accelerated aging test where 3% concentrate was kept for 10 days at 65° C. in an oven. It showed no loss in 28 $ft^2$ pool fire suppression capacity.

Obviously, many modifications and variations are possible in light of the above teachings. It is therefore to be understood that the claimed subject matter may be practiced otherwise than as specifically described. Any reference to claim elements in the singular, e.g., using the articles "a", "an", "the", or "said" is not construed as limiting the element to the singular.

What is claimed is:

1. A composition comprising:

a first surfactant having the formula:

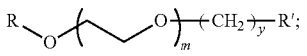

a second surfactant having the formula:

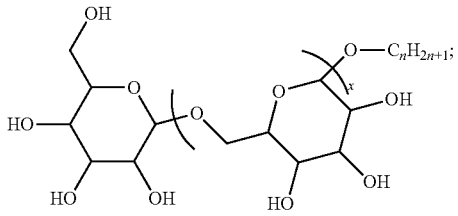

and water;

wherein m and n are independently selected positive integers;

wherein x is a non-negative integer;

wherein y is an integer from 0 to 3;

wherein R is an organic group or H; and wherein R' is a siloxane group.

2. The composition of claim 1, wherein the first surfactant has the formula:

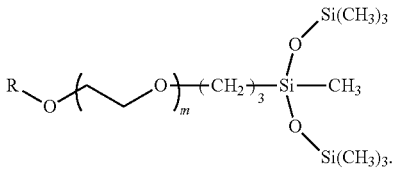

3. The composition of claim 1, wherein m is from 2 to 50.

4. The composition of claim 1, wherein n is from 1 to 20.

5. The composition of claim 1, wherein x is from 0 to 4.

6. The composition of claim 1, wherein R is $CH_3$— or H—.

7. The composition of claim 1, wherein the composition comprises more than one of the first surfactants or the second surfactants having different values of m, n, x, or y.

8. The composition of claim 1, wherein the first surfactant has a concentration in the composition that is at least the critical micelle concentration of the first surfactant.

9. The composition of claim 1, wherein the first surfactant has a concentration in the composition of up to 1.0 wt. %.

10. The composition of claim 1, wherein the second surfactant has a concentration in the composition that is at least the critical micelle concentration of the second surfactant.

11. The composition of claim 1, wherein the second surfactant has a concentration in the composition of up to 1.0 wt. %.

12. The composition of claim 1, wherein the composition further comprises:

a solvent having the formula:

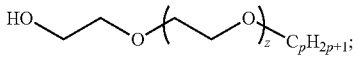

wherein p and z are positive integers.

13. The composition of claim 12, wherein p is from 4 to 12.

14. The composition of claim 12, wherein z is from 1 to 40.

15. The composition of claim 12, wherein the solvent as a concentration in the composition of up to 1 wt. %.

16. A method comprising:

forming a foam from the composition of claim 1.

17. The method of claim 16, further comprising:

applying the foam to a fire.

18. The method of claim 16, further comprising:

applying the foam to a fire in an amount sufficient to extinguish the fire.

19. A method comprising:

forming a composition of a first surfactant, a second surfactant, and water;

wherein the first surfactant has the formula:

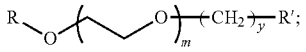

wherein the second surfactant has the formula:

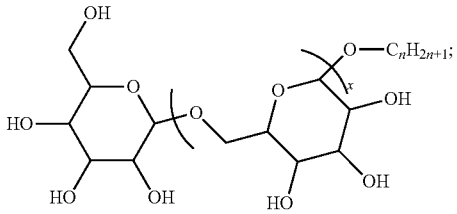

and water;

wherein m and n are independently selected positive integers;

wherein x is a non-negative integer;

wherein y is an integer from 0 to 3;

wherein R is an organic group or H; and wherein R' is a siloxane group.

20. The method of claim 19, wherein the first surfactant has the formula:

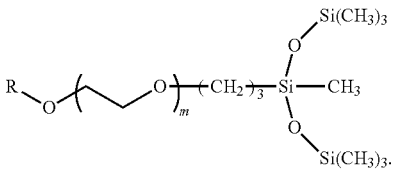

21. The method of claim 19, wherein the composition further comprises:
a solvent having the formula:
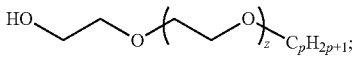
wherein p and z are positive integers.
* * * * *